US011015365B2

(12) United States Patent
Loucks et al.

(10) Patent No.: US 11,015,365 B2
(45) Date of Patent: May 25, 2021

(54) FENCE SYSTEM AND METHOD

(71) Applicant: AP Global Innovations LLC, Hialeah Gardens, FL (US)

(72) Inventors: Peter Loucks, Hialeah Gardens, FL (US); Chun Sing Lam, Hialeah Gardens, FL (US)

(73) Assignee: AP Global Innovations LLC, Hialeah Gardens, FL (US)

( * ) Notice: Subject to any disclaimer, the term of this patent is extended or adjusted under 35 U.S.C. 154(b) by 643 days.

(21) Appl. No.: 15/722,206

(22) Filed: Oct. 2, 2017

(65) Prior Publication Data

US 2018/0094452 A1 Apr. 5, 2018

Related U.S. Application Data

(60) Provisional application No. 62/402,627, filed on Sep. 30, 2016.

(51) Int. Cl.
*E04H 17/14* (2006.01)
*E04H 17/20* (2006.01)
(Continued)

(52) U.S. Cl.
CPC ..... *E04H 17/1439* (2013.01); *E04F 11/1834* (2013.01); *E04H 17/1413* (2013.01);
(Continued)

(58) Field of Classification Search
CPC .... E04H 2017/1456; E04H 2017/1465; E04H 2017/1469; E04H 2017/1491; E04H 17/1421; E04H 17/1443; E04H 17/1439; E04H 17/1413; E04H 17/20; E04H 2017/006; E04H 17/1417; E04F 11/1817; E04F 11/1834; E04F 2011/1819; E04F 2011/1823; E04F 2011/1825; E04F 2011/1831
See application file for complete search history.

(56) References Cited

U.S. PATENT DOCUMENTS 2,145,172 A 1/1939 Gustafson
2,218,953 A 10/1940 Gustafson
(Continued)

FOREIGN PATENT DOCUMENTS

WO 2016127201 8/2016

OTHER PUBLICATIONS

First Office Action, CN Application No. 2018111689035, dated Aug. 14, 2020.
(Continued)

*Primary Examiner* — Matthew R McMahon
(74) *Attorney, Agent, or Firm* — Akerman LLP

(57) ABSTRACT

A fence system may include stably coupleable posts, railings, and pickets. A post may include components configured to snap fit such as a post housing and post cover. A post cover may include a hole to snap fit to an end of a railing. A railing may include components configured to snap fit such as a railing housing and railing cover. Railing components may include holes positioned to correspond when the components are snap fit. The corresponding holes may be dimensioned to snap fit an end of a picket. Railings, pickets, or both may be pivoted when snap fit with a respective post or railing.

15 Claims, 41 Drawing Sheets

(51) Int. Cl.
*E04F 11/18* (2006.01)
*E04H 17/00* (2006.01)

(52) U.S. Cl.
CPC ..... *E04H 17/1417* (2013.01); *E04H 17/1447* (2021.01); *E04H 17/20* (2013.01); *E04H 17/006* (2021.01); *E04H 17/1456* (2021.01); *E04H 17/1465* (2021.01); *E04H 17/1469* (2021.01)

(56) References Cited

U.S. PATENT DOCUMENTS 2,563,530 A * 8/1951 Hawkins ..... E04F 11/1834 256/21
2,655,345 A * 10/1953 Lindman ..... E04F 11/1842 256/22
3,822,053 A * 7/1974 Daily ..... E04F 11/1817 256/22
3,858,850 A * 1/1975 Maxcy ..... E04F 11/1834 256/22
4,723,760 A * 2/1988 O'Sullivan ..... E04H 17/1443 256/22
5,056,283 A * 10/1991 Sapinski ..... E04F 11/1834 256/65.11
5,702,090 A * 12/1997 Edgman ..... E04H 17/1421 256/19
6,299,142 B1 * 10/2001 Chaney ..... E04F 11/1812 256/65.12
6,375,166 B1 * 4/2002 Schall ..... E04H 17/1439 256/21
6,739,583 B2 * 5/2004 Ryon ..... E04H 17/1439 256/65.02
7,021,607 B1 4/2006 Alexander
7,475,870 B2 * 1/2009 Platt ..... E04F 11/1834 256/67
7,635,115 B2 12/2009 Lehmann
7,934,699 B2 5/2011 Zell et al.
7,975,374 B2 * 7/2011 Williams ..... E04F 11/1853 29/788
8,132,791 B2 3/2012 Stucker
8,177,195 B2 5/2012 Schall et al.
8,403,303 B2 3/2013 Payne et al.
8,407,872 B2 * 4/2013 Powell ..... E04H 17/1413 29/239
8,413,332 B2 4/2013 Duffy et al.
8,413,965 B2 4/2013 Duffy et al.
8,887,370 B2 11/2014 Payne et al.
9,027,909 B1 5/2015 Peyton et al.
9,151,075 B2 10/2015 Duffy et al.
9,353,546 B2 * 5/2016 Garza Montemayor ..... E04H 17/143
2007/0080332 A1 4/2007 Allen
2010/0264388 A1 10/2010 Duffy et al.
2010/0284734 A1 * 11/2010 Tumour ..... E04F 10/00 403/291
2011/0155982 A1 6/2011 Duffy et al.
2012/0235105 A1 * 9/2012 Yasher ..... E04H 17/20 256/65.06
2015/0292236 A1 10/2015 Duffy et al.
2015/0300041 A1 * 10/2015 Feeko ..... E04H 17/1421 256/65.12
2016/0097216 A1 * 4/2016 Molina ..... E04H 17/1439 256/65.12
2017/0370121 A1 * 12/2017 Lindsay ..... E04F 11/1817

OTHER PUBLICATIONS

First Office Action, CA Application No. 3,019,402, dated Aug. 31, 2020.

* cited by examiner

FENCE SYSTEM AND METHOD

CROSS-REFERENCE TO RELATED APPLICATIONS

This patent application claims the benefit of the filing date under 35 U.S.C. § 119(e) to U.S. Provisional Patent Application No. 62/402,627, filed on Sep. 30, 2016, the contents of which are hereby incorporated by reference in their entirety.

TECHNOLOGY

The present disclosure is related to fences, more particularly post and rail fences, more particularly fences and components of fences including components configured for fastenerless assembly and/or rackability.

BACKGROUND

Fences are physical structures that have been used throughout recorded history to separate or provide barriers between two adjacent spaces. Among the numerous types of fences are post and rail type fences. Post and rail type fences are typically made of wood or metal. These fences include one or more horizontally orientated rails coupled between vertically orientated posts. Post and rail type fences may also incorporate pickets. Pickets may attach to the rails in a vertical orientation. The posts, rails, and pickets may be attached with nails, bolts, screws, or clamps. Thus, the overall design of such fences include posts that provide a base through which the rails are supported, which, in turn, support the pickets.

SUMMARY

In one aspect, a fence system for stably coupling posts, railings, and pickets to assemble fence panels may include a post having a longitudinal length. The post may include a post housing comprising a base wall and a post cover comprising a cover plate that defines a hole therethrough and adapted to position the hole over the base wall to provide an opening to a channel between the base wall and the cover plate. In one embodiment, the post cover may be configured to snap fit with the post housing above the base wall. When snap fit, the hole may provide an opening to a channel between the base wall and the cover plate.

The system may also include a railing having a longitudinal length between a first end and a second end. The first end may be dimensioned to extend into the channel through the hole and therein couple to the post. When the first end of the railing is coupled to the post, the railing may be pivotable to adjust an angle the railing extends from the post relative to the longitudinal length of the post. The railing may include a railing housing comprising an upper wall and a lower wall defining a channel. The upper wall may further define a hole into the channel. The railing may further include a railing cover comprising a cover plate that defines a hole therethrough and adapted to at least partially position the hole over the hole in the upper wall. In one embodiment, the railing cover configured to couple, e.g., slidably and/or snap fit, to the railing housing above the upper wall.

The system may also include a picket that extends along a longitudinal length between a first end and a second end. The first end of the picket may be dimensioned to extend into the channel of the railing housing through the corresponding holes through the upper wall of the railing housing and the railing cover plate and couple therein. When the first end of the picket is coupled with the railing, the picket may be pivotable to adjust an angle the picket extends from the railing relative to the longitudinal length of the railing.

In one embodiment, at least one of the post cover or railing cover is slidable with respect to the respective housing such that the cover may longitudinally slide relative to the housing when the railing or picket, respectively, is pivoted. In this or another embodiment, at least one of the post cover or the railing cover includes a tab defining at least one longitudinal end of the hole defined therethrough that bends to accommodate and increased cross-section of the railing or picket with respect to the hole when the respective railing or picket extended therethrough is pivoted.

In another aspect, a fence system for stably coupling posts and railings to assemble fence panels includes a post and a railing. The post may have a longitudinal length and include a post housing comprising a base wall and a post cover comprising a cover plate defining a hole therethrough. The post cover may be adapted to position the hole over the base wall to provide an opening to a channel between the base wall and the cover plate. The railing may have a longitudinal length between a first end and a second end. The first end may be dimensioned to extend into the channel through the hole and therein couple with the post. When the first end of the railing is coupled to the post, the railing may be longitudinally pivotable to adjust an angle the railing extends from the post relative to the longitudinal length of the post.

In one embodiment, the post cover may be slidable with respect to the post housing such that the cover may longitudinally slide relative to the housing when the railing is pivoted. In this or another embodiment, the post cover may include a tab defining at least one longitudinal end of the hole defined therethrough that bends to accommodate an increased cross-section of the railing with respect to the hole when the railing is pivoted.

In still another aspect, a fence system for stably coupling railings and pickets to assemble fence panels includes a railing and a picket. The railing may have a longitudinal length and include a railing housing and a railing cover. The railing housing may include an upper wall and a lower wall defining a channel. The upper wall may further define a hole into the channel. The railing cover may be configured to couple to the railing housing above the upper wall. The railing cover may include a cover plate defining a hole. When the railing housing and railing cover are coupled, the hole through the upper wall may at least partially position over the hole through the cover plate. The picket may extend along a longitudinal length between a first end and a second end. The first end of the picket may be dimensioned to extend into the channel of the railing housing through the corresponding holes through the upper wall of the railing housing and the railing cover plate and couple therein. When the first end of the picket is coupled to the railing, the picket may be pivotable to adjust an angle the picket extends from the railing relative to the longitudinal length of the railing. In one embodiment, the railing cover longitudinally slides relative to the housing when the picket is pivoted.

In yet another aspect, a fence system for stably coupling railings and pickets to assemble fence panels includes a railing and a picket. The railing may have a longitudinal length and include a railing housing and a railing cover. The railing housing may include a wall that defines a hole. The railing cover may be configured to couple to the railing housing above the wall to form a channel therebetween. The railing cover may include a cover plate defining a hole.

When the railing housing and railing cover are coupled, a channel may be formed between the cover plate and the upper wall and the holes through the wall and the cover plate may at least partially overlap. The picket may extend along a longitudinal length between a first end and a second end. The first end of the picket may be dimensioned to extend through the aligned holes to stably couple the picket and the railing. The first end of the picket may be adapted to couple to a stopper. When coupled to the picket, the stopper is positionable in the channel between the wall and the cover plate when the picket is extended through the at least partially aligned holes to increase a cross-section of the picket within the channel that is larger than corresponding cross-section dimensions of the hole in the wall and the hole in the cover plate.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DESCRIPTION

Figure 1A:
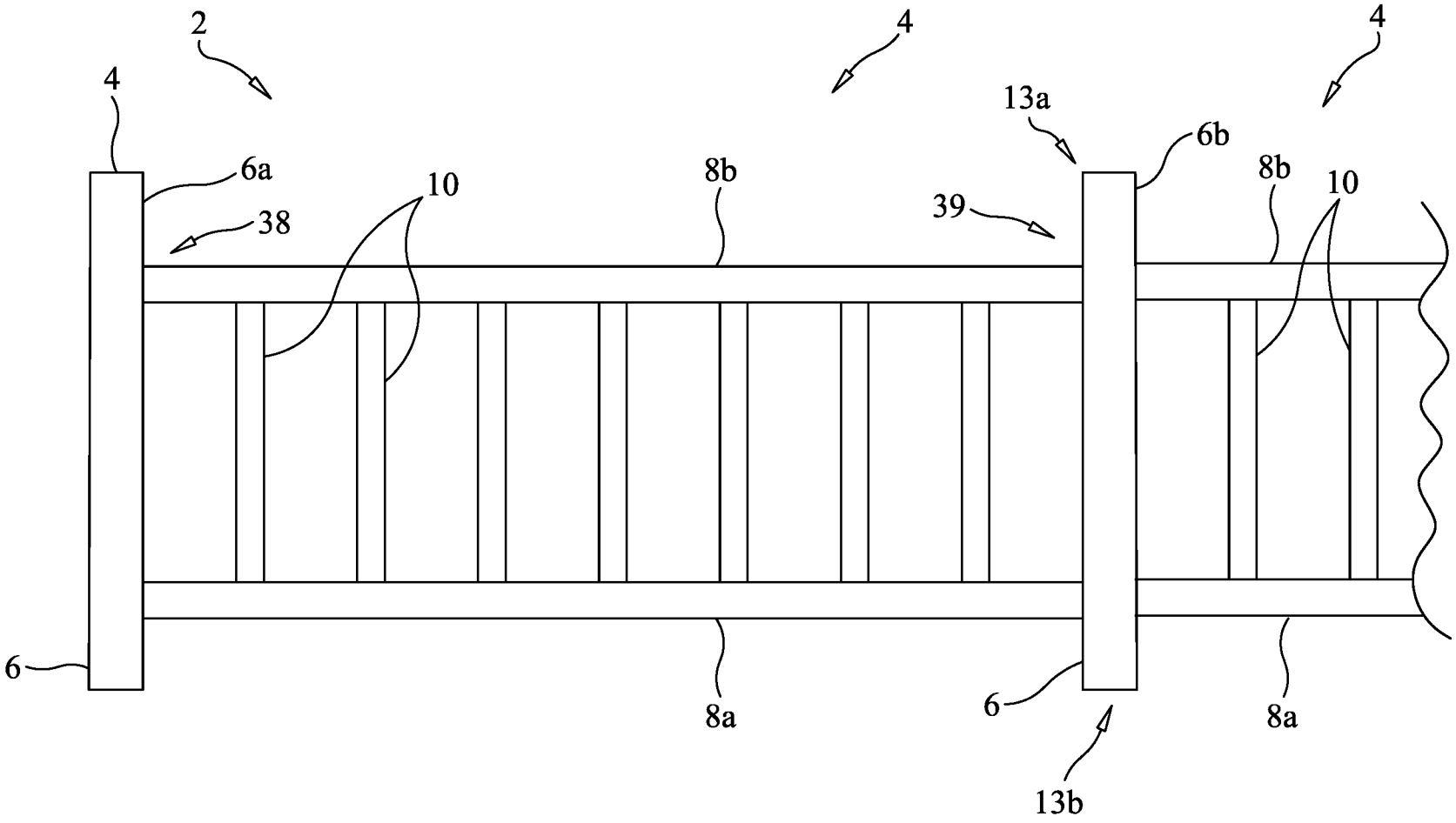
FIG. 1A shows components of a fence system according to various embodiments described herein.

This disclosure describes various elements, features, aspects, and advantages of various embodiments and examples and configurations thereof of fence systems, components for use with fence systems, and methods of assembling fencing. The systems, components, and methods are described herein with respect to the accompanying FIGS. 1A-39C, wherein like reference numerals refer to like elements. However, it is to be appreciated that upon reading the present disclosure, those having skill in the art will recognize that the teachings and descriptions disclosed herein may be applied in many ways. Such applications are contemplated and are to be considered disclosed herein. It is to be understood that certain descriptions of the various embodiments have been simplified to illustrate only those elements, features and aspects that are relevant to a clear understanding of the disclosed embodiments, while eliminating, for purposes of brevity or clarity, other elements, features and aspects.

Figure 1B:
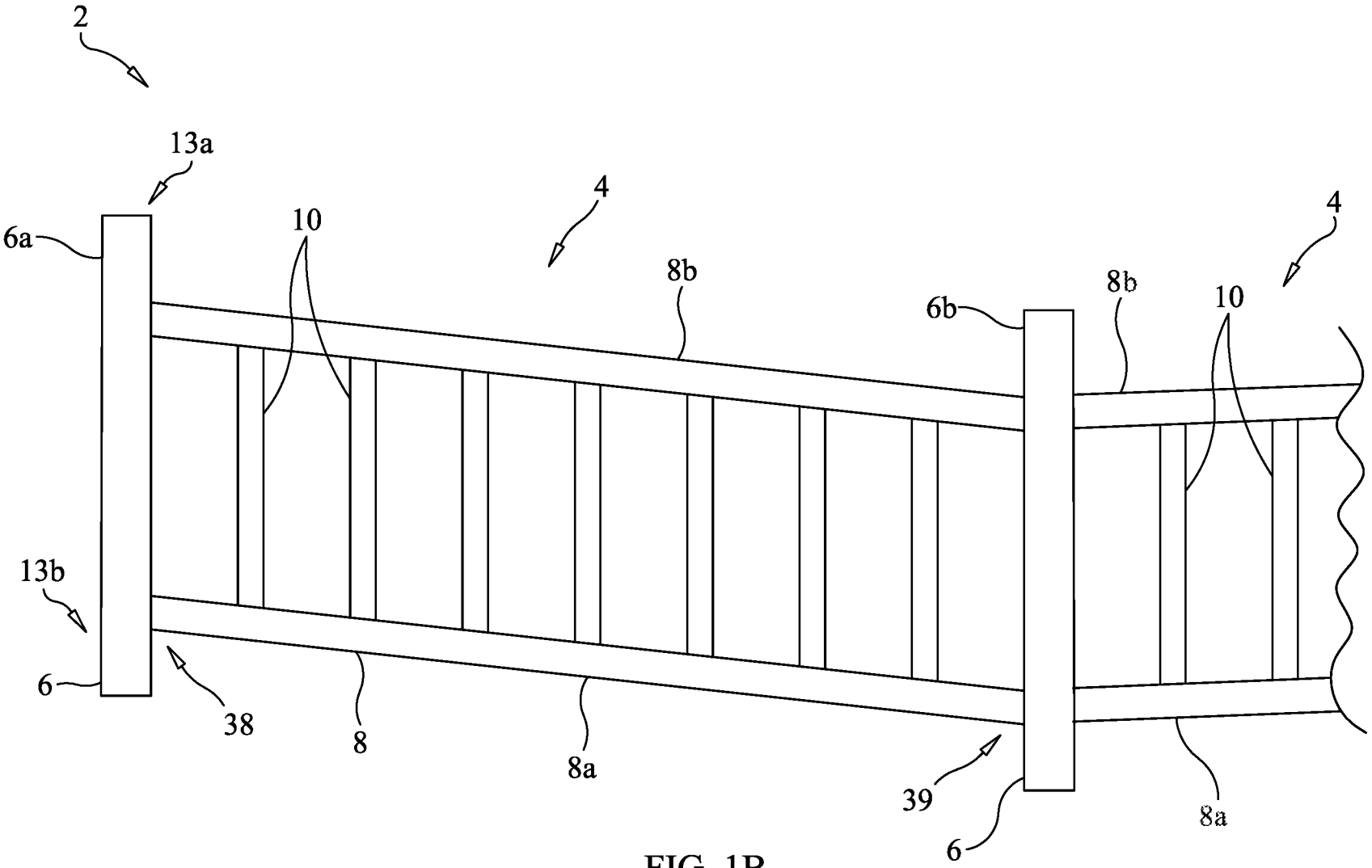
FIG. 1B shows components of the fence system racked according to various embodiments described herein.

With reference to FIGS. 1A & 1B, a fence system 2 may include various fence components that may be assembled to construct a fence or fence panel 4. Components of the fence system 2 may be fabricated from any suitable material, e.g., materials rigid enough to provide structural support to the fence or fence components, either alone or in combination with other components or materials. Example materials may include, for example, plastics, polymers, metallics, alloys, wood, composites, to name a few.

Various embodiments of the fence system 2 may include one or more posts 6, one or more railings 8, one or more pickets 10, or other components configured to be assembled to construct a fence or fence panel 4 thereof. The posts 6 include ends 13*a*, 13*b* and form the sides of the panel 4 and may typically be positioned vertically, e.g., driven into the ground or embedded in concrete if used as railings. The posts 6 are configured to stably couple to one or more railings 8, which may typically be positioned horizontally or generally horizontally. In the illustrated embodiment, the fence panel 4 includes a lower railing 8*a* and an upper railing 8*b* configured to stably couple to the posts 6 and to one or more pickets 10 between railing ends 38, 39, which may typically be positioned vertically. In further or other embodiments, the fence system 2 may include more than two railings 8 between the posts 6. Posts 6 may be structured for coupling railings 8 of a single panel 4 or multiple panels 6. As exemplified in FIGS. 1A & 1B, the fence system 2 may include posts 6 comprising end posts 6*a* structured to stably couple railings 8 from a single panel. The fence system 2 may also include posts 6 comprising multi-panel posts 6*b* structured to stably couple railings 8 of multiple panels (as indicated by the dashed lines showing coupling to another panel). One or more of the stable couplings may comprise snap fitting corresponding fitment features. Multi-panel posts 6*b* may be configured as line posts to align panels 4 linearly (180°) or corner posts to align two or more panels 4 at non-linear angles. As described in more detail below, in some embodiments, multi-panel 6*b* may be adjustable to allow a user to customize the angle a post 6 stably couples two or more panels 4.

In various embodiments, the fence system 2 includes posts 6, railings 8, and pickets 10 wherein all or a portion of the posts 6, railings 8, and pickets 10 may be configured to couple without fasteners, e.g., fastenerless fitment. In one example, the fence system 2 includes a post 6, railing 8, picket 10, or combinations thereof configured to be assembled without the use of fasteners such as rivets, screws, and the like. These components may be configured with fitment features associated with or integrated with the post 6, railing 8, picket 10, or combinations thereof. The post 6 and railing 8, for example, may include integrated fitment features dimensioned to cooperatively engage to thereby couple the post 6 and railing 8. In this or another example, the railing 8 and picket 10 may include integrated fitment features dimensioned to cooperatively engage to thereby couple the railing 8 and picket 10. Examples of fastenerless fitment may include mating complementary interfaces including slots, lips, holes, tabs, or rail and groove, which may be configured for snap fitment. Fastenerless fitment is generally described herein with respect to snap fitment; however, it will be appreciated that in such embodiments other manners of fastenerless fitment may be used. In various embodiments, components of the fence system 2 may include fitment features structured for suitable snap fitment. For example, snap fitment may include fitment features comprising levers or biased extensions to engage fitment features when fitted together. Snap fitment may include one or more fitment features structured to temporarily deform to fit corresponding fitment features and thereafter return to a general pre-deformed shape to cooperatively fit with the corresponding fitment features. In some embodiments, components structured for snap fitment may be snap fit by compressing corresponding fitment features onto each other, by sliding corresponding fitment features onto each other, or both and thereafter be slidable relative to each other when snap fit.

In various embodiments, fence system 2 may be configured for racking such that railings may track the grade of the surface along with they extend. For example, FIG. 1B illustrates an embodiment wherein the panel 4 is racked on an angled surface. The posts 6 and pickets 10 are relatively plumb and the railings 8 are relatively parallel to the angled surface.

FIGS. 2A-4B, 12-14B, & 19-26B illustrate components of a post 6 according to various embodiments.

Figure 2A:
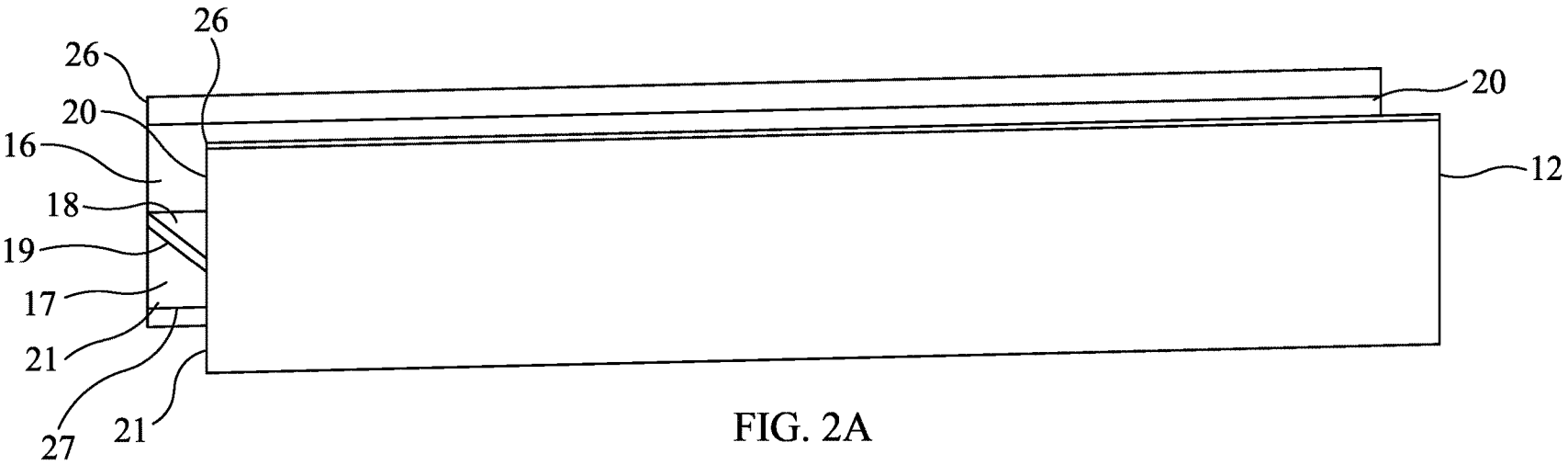
FIG. 2A is a side view in perspective of a post housing according to various embodiments described herein.
Figure 2B:
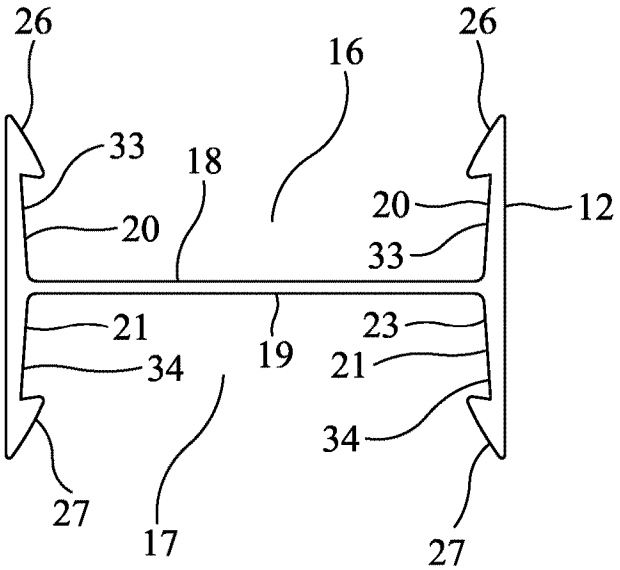
FIG. 2B is an end view of the post housing shown in FIG. 2A according to various embodiments described herein.

As shown in the side view illustrated in FIG. 2A and the end view illustrated in FIG. 2B, a post housing 12 may extend along a longitudinal length and include one or more channels 16, 17 extending along all or one or more portions of its longitudinal length. The post housing 12 may include one or more base walls 18, 19, which may be opposite sides of a single wall, one or more first sidewalls 20, and one or more second sidewalls 21.

The post housing 12 may be structured to cooperatively engage, e.g., via snap fitment, a post cover, which may include an intermediate post cover, as described in more detail below. For example, the post housing 12 includes fitment features structured to cooperatively engage corresponding fitment features positioned on a post cover or intermediate post cover to thereby couple the post housing 12 and the post cover or intermediate post cover. In the illustrated embodiment, the fitment features are structured for slidable coupling with fitment features of a post cover or intermediate post cover. Fitment features of the post housing 12 include first sidewalls 20 that extend from base wall 18 to lips 26 and that together define a first channel 16. The post housing 12 also includes a second set of fitment features structured for slidable coupling with fitment features of a second intermediate post cover. The second set of fitment features includes second sidewalls 21 that extend from base wall 19 to lips 27 and that together define a second channel 17 adjacent to the first channel 16 structured for slidable coupling with fitment features of the second intermediate post cover 75. Lips 26, 27 extend along all or a portion of the length of the post housing 12 and protrude inwardly with respect to channels 16, 17, from the first and second sidewalls 20, 21. The lips 26, 27 increase in thickness toward the base wall 18, 19 and form slots 33, 34 between a lower face of the lips 26, 27, the sidewalls 20, 21, and the base wall 18, 19. The sidewalls 20, 21 or lips 26, 27 may be resilient such that they may be compressed or bent outward and thereafter return to a pre-compressed, pre-bent, or more inward position upon a reduction or removal of compression or a bending force. The sidewalls 20, 21 or lips 26, 27 may also be configured to provide a rigid structure that opposes outwardly directed force applied by complementary fitment features of a post cover or intermediate post cover such that the complementary fitment features compress or bent inward and thereafter return to a pre-compressed, pre-bent, or more outward position upon a reduction or removal of compression or a bending force to snap fit with lips 26, 27.

Figure 4B:
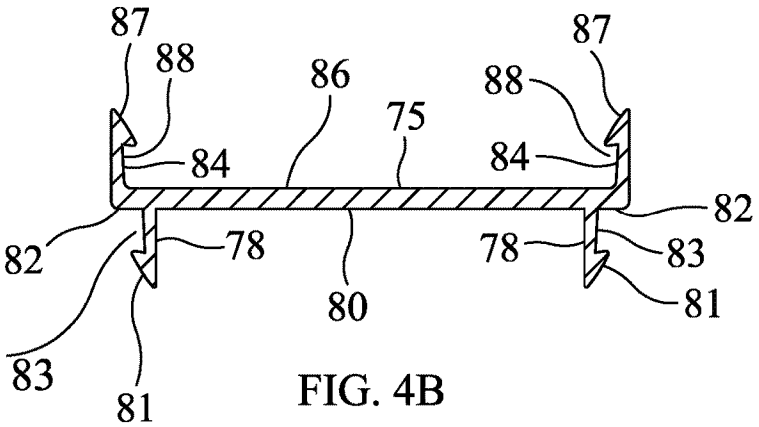
FIG. 4B is an end view of the intermediate post cover shown in FIG. 4A according to various embodiments described herein.
Figure 4A:
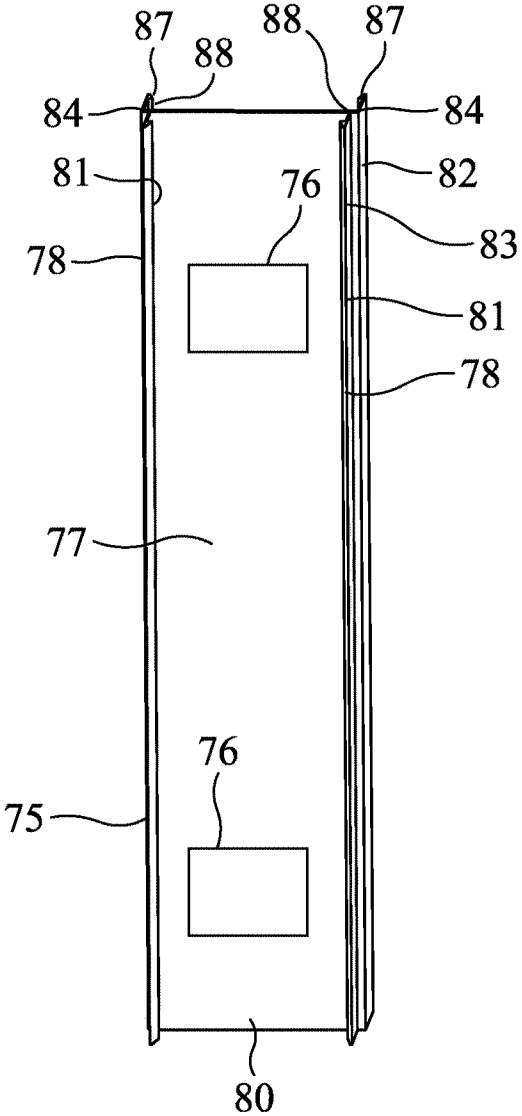
FIG. 4A is a bottom view of an intermediate post cover according to various embodiments described herein.

With further reference to FIGS. 4A & 4B, a post 6 may include an intermediate post cover 75 that extends along a longitudinal length. As introduced above, the intermediate post cover 75 may include fitment features structured for coupling, e.g., snap fitment, with corresponding fitment features of a post housing. An intermediate post cover 75 may include fitment features configured for snap fitment over all or a portion of the longitudinal length of the post housing 12 or channel 16, 17 thereof. In some embodiments, the coupling between the intermediate post cover 75 and the post housing 12 allows relative sliding along their respective longitudinal lengths when snap fit.

The intermediate post cover 75 shown in FIGS. 4A & 4B is configured for snap fitment with the post housing 12 illustrated in FIGS. 2A & 2B (as well as other post housing configurations described herein). For example, the intermediate post cover 75 includes fitment features comprising extensions 78 that extend from a lower surface 80 of an intermediate post cover plate 77 to a lip 81. Together with the lip 81 and the lower surface 80 or another lip 82, each extension 78 defines a slot 83 structured to receive a corresponding lip 26 of the post housing 12 when the post housing 12 and intermediate post cover 75 are coupled (see, e.g., FIG. 10). The intermediate post cover 75 also includes fitment features comprising extensions 84 that extend from an upper surface 86 of the intermediate post cover plate 77 to a lip 87. Together with the lip 87 and the upper surface 86 or another lip, each extension 84 defines a slot 88 structured to receive a corresponding lip 37 of the post cover 14 when the post cover 14 and intermediate post cover 75 are coupled (see, e.g., FIG. 10).

The intermediate post cover 75 may also include railing fitment features comprising a plurality of holes 76 through which a railing may be fitted. The intermediate post cover 75 extends along a longitudinal length and comprises an intermediate post cover plate 77 defining a plurality of holes 76 that extend through the intermediate post cover plate 77. One or more of the holes 76 may be defined such that when coupled to the post housing 12, the one or more holes 76 are positioned over a channel in the post housing to provide an opening therethrough. The intermediate post cover 75 shown in FIGS. 4A & 4B includes two holes 76. However, in some embodiments, the fence system 2 may include an intermediate post cover 75 having different hole designs including fewer or additional holes 76. The holes 76 may also be placed or separated at different intervals. Intermediate post covers 75 may include holes 76 having any desired cross-section shape, e.g., polygonal or other regular or irregular geometric shapes, including circular, oval, arcuate, triangular, square, rectangular, cross-sections having greater than 4 sides, or free form, which may be configured to slot a correspondingly shaped cross-section shape of a railing 8.

Figure 3A:
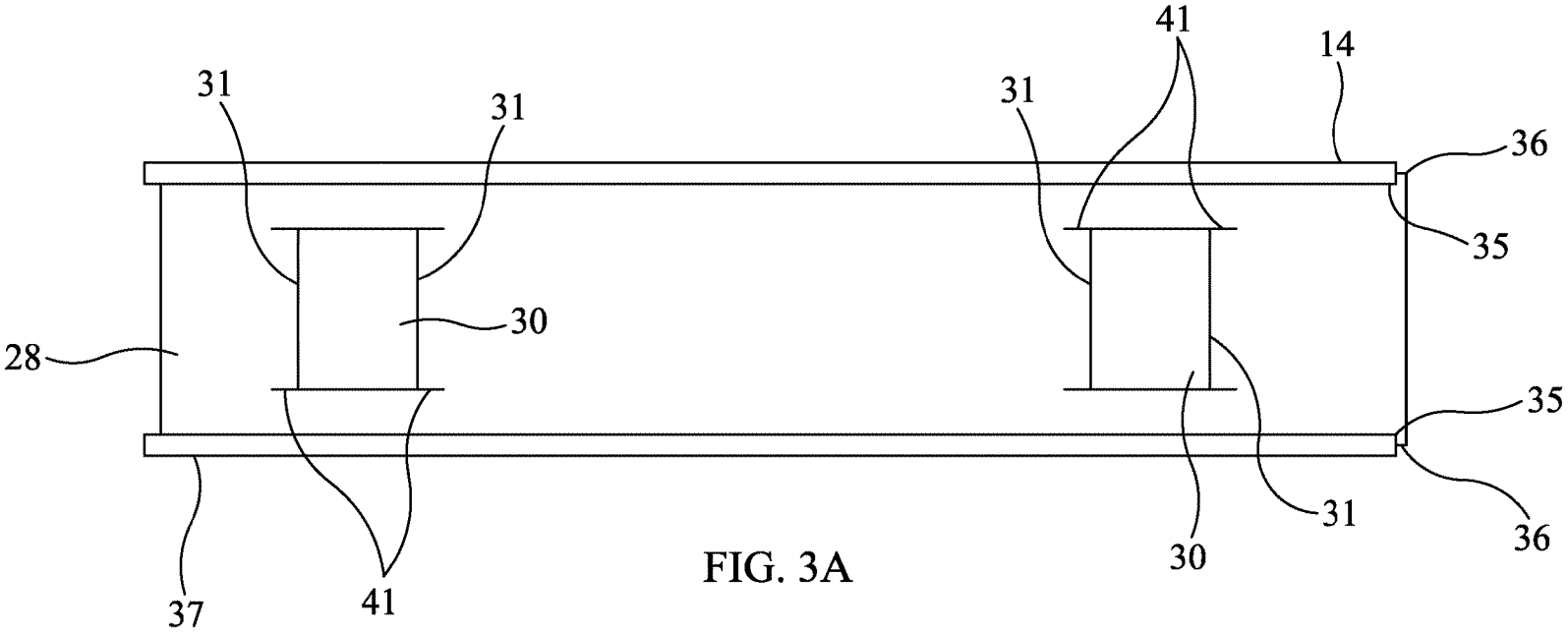
FIG. 3A is a bottom view in perspective of a post cover according to various embodiments described herein.
Figure 3B:
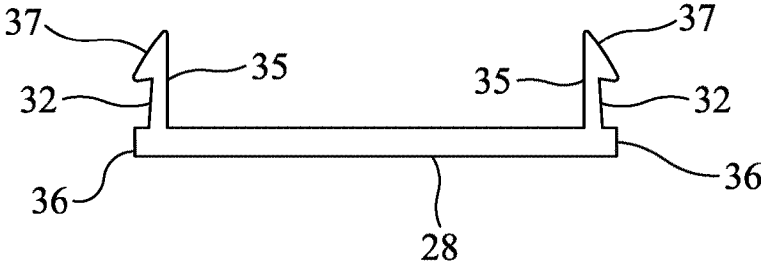
FIG. 3B is an end view of the post cover shown in FIG. 3A according to various embodiments described herein.

With reference to FIG. 3A providing a side view and FIG. 3B providing an end view of a post cover 14 according to various embodiments, a post may include a post cover 14 configured to cooperatively engage an intermediate post cover. The post cover 14 may extend along a longitudinal length, which may be the same, shorter, or longer than the longitudinal length of the post housing 12 or the intermediate post cover 75.

The post cover 14 includes fitment features structured to cooperatively engage corresponding fitment features of an intermediate post cover, e.g., to snap fit the post cover 14 and the intermediate post cover. In the illustrated embodiment, the post cover 14 includes fitment features comprising slots 32 that extend along each side of the post cover 14. The slots 32 face outwardly and are defined along the extensions 35 between first lips 36 and second lips 37. Each extension 35 extends outwardly from the post cover plate 28 between a first lip 36 and a second lip 37. The second lips 37 include an outwardly facing surface that extends away from the slot 32 at an inwardly directed angle. The first lips 36 extend a greater distance outwardly of the slots 32 than the second lips 37. However, in other embodiments, the first lips 36 may extend a same or lesser distance outwardly of the slots 32. The extensions 35 or second lips 37 may be resilient such that they may be compressed or bent inward and thereafter return to a pre-compressed, pre-bent, or more outward position upon a reduction or removal of compression or bending force.

The post cover 14 also includes railing fitment features comprising one or more holes 30 defined therein into which a railing can slot. The holes 30 may include any desired cross-section shape, e.g., polygonal or other regular or irregular geometric shapes, including circular, oval, arcuate, triangular, square, rectangular, cross-sections having greater than four sides, or free form, which may be configured to slot a correspondingly shaped cross-section shape of a railing. Thus the post cover 14 shown in FIGS. 3A & 3B is configured for coupling over all or a portion of the intermediate post cover 75 shown in FIGS. 4A & 4B and includes two holes 30. However, in some embodiments, the fence system 2 may include different designs including different numbers, placements, cross-sections for railings, which may be built by using other post cover plate 28 and intermediate post cover plate 77 designs having desired configurations of corresponding holes 30, 76. Such designs may include an H-shaped post housing (see, e.g., FIGS. 2A & 2B) or other configurations, including those described herein.

Figure 10:
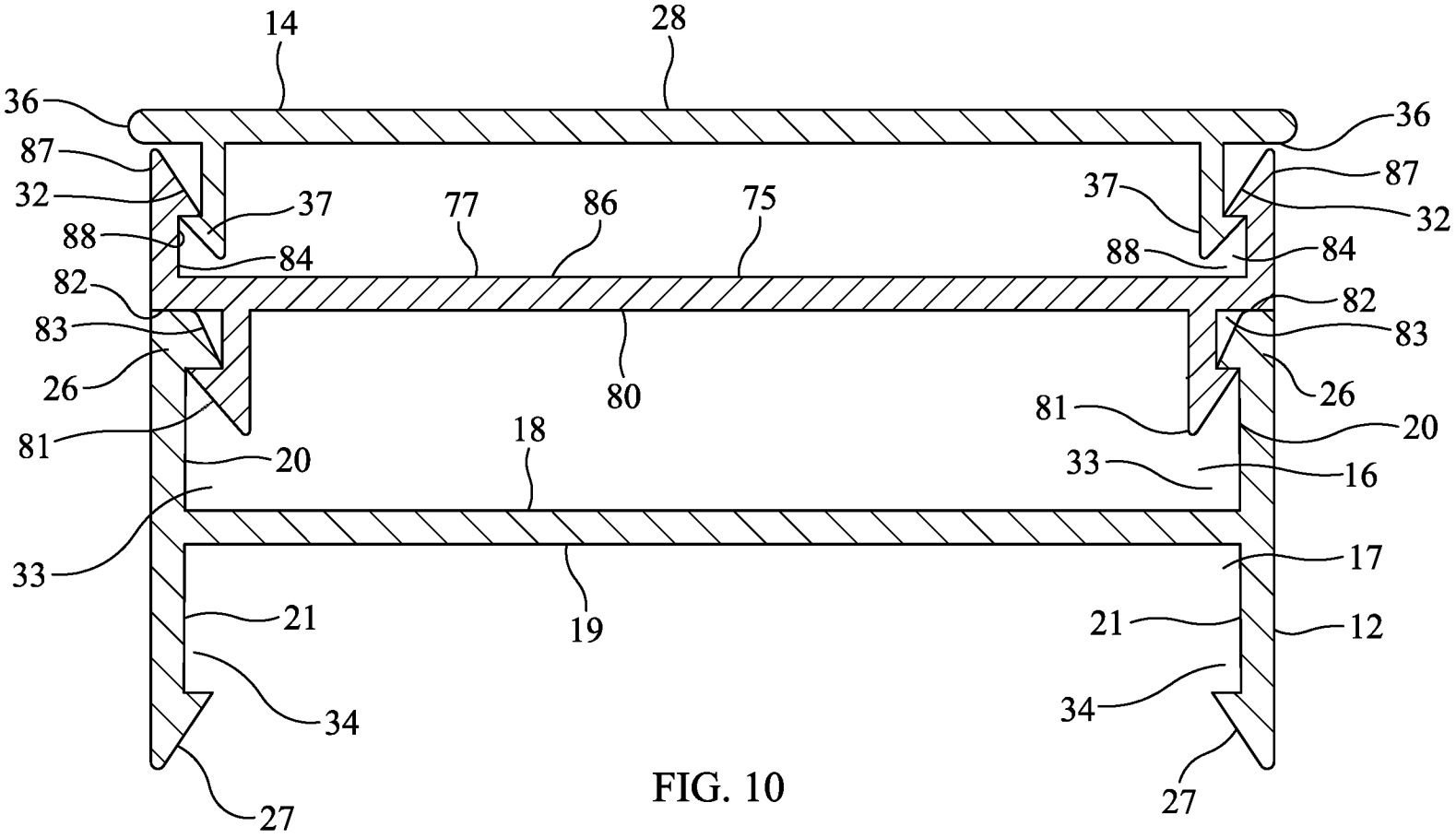
FIG. 10 is an end view of a post including the post housing shown in FIGS. 2A & 2B coupled to the intermediate post cover shown in FIGS. 4A & 4B, which is coupled to the post cover shown in FIGS. 3A & 3B according to various embodiments described herein.

FIG. 10 is an end view of the post housing 12 shown in FIGS. 2A & 2B coupled to the intermediate post cover 75 shown in FIGS. 4A & 4B, which is further coupled to the post cover 14 shown in FIGS. 3A & 3B according to various embodiments described herein. The lips 26 of the post housing 12 are positioned within the slots 83 defined along the extensions 78 between the lips 81, 82 of the intermediate post cover 75. To couple the post housing 12 and intermediate post cover 75, the intermediate post cover 75 may be positioned over the channel 16 such that the angled surfaces of the lips 26 of the post housing 12 engage with the angled surfaces of the lips 81 positioned along the intermediate post cover extensions 78. The angled surfaces may be complementary, e.g., parallel or approximately parallel (+/−30°). Force may thereafter be applied to bring the components together such that the angled surfaces of the lips 26, 81 slide past each other. The force may cause compression or bending of the extensions 78; lips 26, 81; sidewalls 20; or combination thereof until the respective lips 26, 81 are snapped into position within their corresponding slots 33, 83. As introduced above, the resiliency of one or more fitment features allows the features to spring back to an approximate pre-compressed or pre-bent form when the lips 26, 81 are positioned in the slots 33, 83. In some instances, the resiliency will result in compression of the fitment features against opposing fitment features of the other when coupled. In some embodiments, only the extensions 78 or lips 81 of the intermediate post cover 75 are resiliently compressible or bendable for fitment and the lips 26 and sidewalls 20 of the post housing 12 are rigidly positioned to inwardly bend or compress the extensions 78 or lips 81 of the intermediate post cover 75 when force is applied to snap the intermediate post cover 75 into the channel 16. In another embodiment, only the lips 26 or sidewalls 20 of the post housing 12 are resiliently compressible or bendable for fitment and the extensions 78 or lips 81 of the intermediate post cover 75 are rigidly positioned to outwardly bend or compress the lips 26 or sidewalls 20 of the post housing 12 when force is applied to snap the intermediate post cover 75 into the channel 16. Once snap fit, the intermediate post cover 75 is coupled to the post housing 12 over channel 16 and usually may not be removed outwardly without application of excessive or damaging force. In one example, the intermediate post cover 75 may be coupled by sliding the intermediate post cover 75 onto the post housing 12, which may be in addition to or instead of snap fitment by compression. As introduced above, the channel 16 may extend along all or a portion of the length of the post 6. In some embodiment, when the post housing 12 and intermediate post cover 75 are coupled, the channel 16 is continuous between at least two adjacent holes 76 through the intermediate post cover plate 77. In one embodiment, one or more ends of the channel 16 or corresponding slots 33, 83 may allow the intermediate post cover 75 to be slid over the channel 16 or removed from the channel 16 by sliding the intermediate post cover 75 from an end of the channel 16. In some embodiments, the channel 16 or corresponding slots 33, 83 may not allow sliding engagement or may be capped.

The angled surfaces of the various lips described herein may define various angles, e.g., between 45° and 75° degrees. Larger or smaller angled surfaces may be used. In one example, angled surfaces of lips are oriented at about 60° (e.g., +/−5°). The angles of corresponding lips of snap fitting components may be the same or different.

The lips 87 of the intermediate post cover 75 are positioned within the slots 32 defined along the extensions 35 between the lips 36, 37 of the post cover 14. To couple the intermediate post cover 75 and the post cover 14, the post cover 14 may be positioned over the intermediate post cover plate 77 such that the angled surfaces of the lips 87 of the intermediate post cover 75 engage with the angled surfaces of the lips 37 positioned along the post cover 14 extensions 35. The angled surfaces may be complementary, e.g., parallel or approximately parallel (+/−30°). Force may thereafter be applied to bring the components together such that the angled surfaces of the lips 37, 87 slide past each other. The force may cause compression or bending of the extensions 35, 84; lips 37, 87; or combination thereof until the lips 37, 87 are snapped into position within their corresponding slot 32, 88. As introduced above, the resiliency of one or more fitment features allows the features to spring back to an approximate pre-compressed or pre-bent form when the lips 37, 87 are positioned in the slots 33, 88. In some instances, the resiliency will result in compression of the fitment features against opposing fitment features of the other when coupled. In some embodiments, only the extensions 35 or lips 37 of the post cover 14 are resiliently compressible or bendable for fitment and the lips 87 and extensions 84 of the intermediate post cover 75 are rigidly positioned to inwardly bend or compress the extensions 35 or lips 37 of the post cover 14 when force to snap the post cover 14 and the intermediate post cover 75. In another embodiment, only the lips 87 or extensions 84 of the intermediate post cover 75 are resiliently compressible or bendable for fitment, and the extensions 35 or lips 37 of the post cover 14 are rigidly positioned to outwardly bend or compress the lips 87 or extensions 84 of the intermediate post cover 75 when force is applied to couple the post cover 14 and the intermediate post cover 75. Once snap fit, the post cover 14 is stably coupled to the intermediate post cover 75 and usually may not be removed outwardly without application of excessive or damaging force. In one embodiment, one or more ends of the intermediate post cover 75 or corresponding slots 32, 88 may allow the post cover 14 to be slid along the intermediate post cover 75 or removed from the end by sliding the post cover 14 from an end of the intermediate post cover 75. In some embodiments, the intermediate post cover 75 or corresponding slots 32, 88 may not allow sliding engagement or may be capped.

With further reference to the intermediate post cover 75 shown in FIGS. 4A & 4B, one or more of the plurality of holes 76 defined in the intermediate post cover plate 77 may each be positioned to correspond to one or more of the plurality of holes 30 that extend through the post cover plate 28 when the intermediate post cover 75 and post cover 14.

For example, a hole 30 through the post cover 14 may be positioned over at least a portion of a corresponding hole 76 through the intermediate post cover plate 77. For example, one or more of the holes 76 in the intermediate post cover 75 may be positioned to receive a railing extended through the corresponding hole 30 such that the railing 8 may be extend through the corresponding holes 30, 76 into the channel 16, 17.

In one example, a hole 76 of the intermediate post cover 75 may align over a hole 30 of the post cover 14 with respect to one or more dimensions. Where the alignment provides a perpendicular passage into the channel 16 that is substantially the same or larger than a lateral cross-sectional dimensions of an end of the railing 8, the railing may be coupled to the post 6 in a perpendicular orientation (see. e.g., FIG. 1A). The railing 8 may be coupled to the post 6 in a non-perpendicular orientation wherein the alignment provides a passage into the channel 16 that is the same or larger than a corresponding angled cross-section of the railing 8 (see, e.g., FIG. 1B). Thus, longitudinally offset holes 76, 30 or longitudinally offsetting holes 76, 30, e.g., by sliding the post cover 14 relative to the intermediate post cover 75 when snap fit, may be utilized to define the angle at which the railing 8 stably couples to the post 6. In some embodiments, a stably coupled railing 8 may be pivoted during setup to slide the post cover 14 and offset the corresponding holes 76, 30 to stably couple the railing 8 to the post 6 in a non-perpendicular orientation, thereby racking the fence panel. For example, in various embodiments, the post cover plate 28 may be coupled to the intermediate post cover 75 such that the corresponding holes 30, 76 may be longitudinally offset. For example, longitudinally offsetting the corresponding holes 30, 76 relative to the position of the holes 30, 76 for stably coupling a railing at a perpendicular orientation, e.g., by sliding the post cover 14 relative to the perpendicular orientation alignment, allows insertion or pivoting of the railing 6 to non-perpendicular orientations with respect to the post 6.

Figure 11:
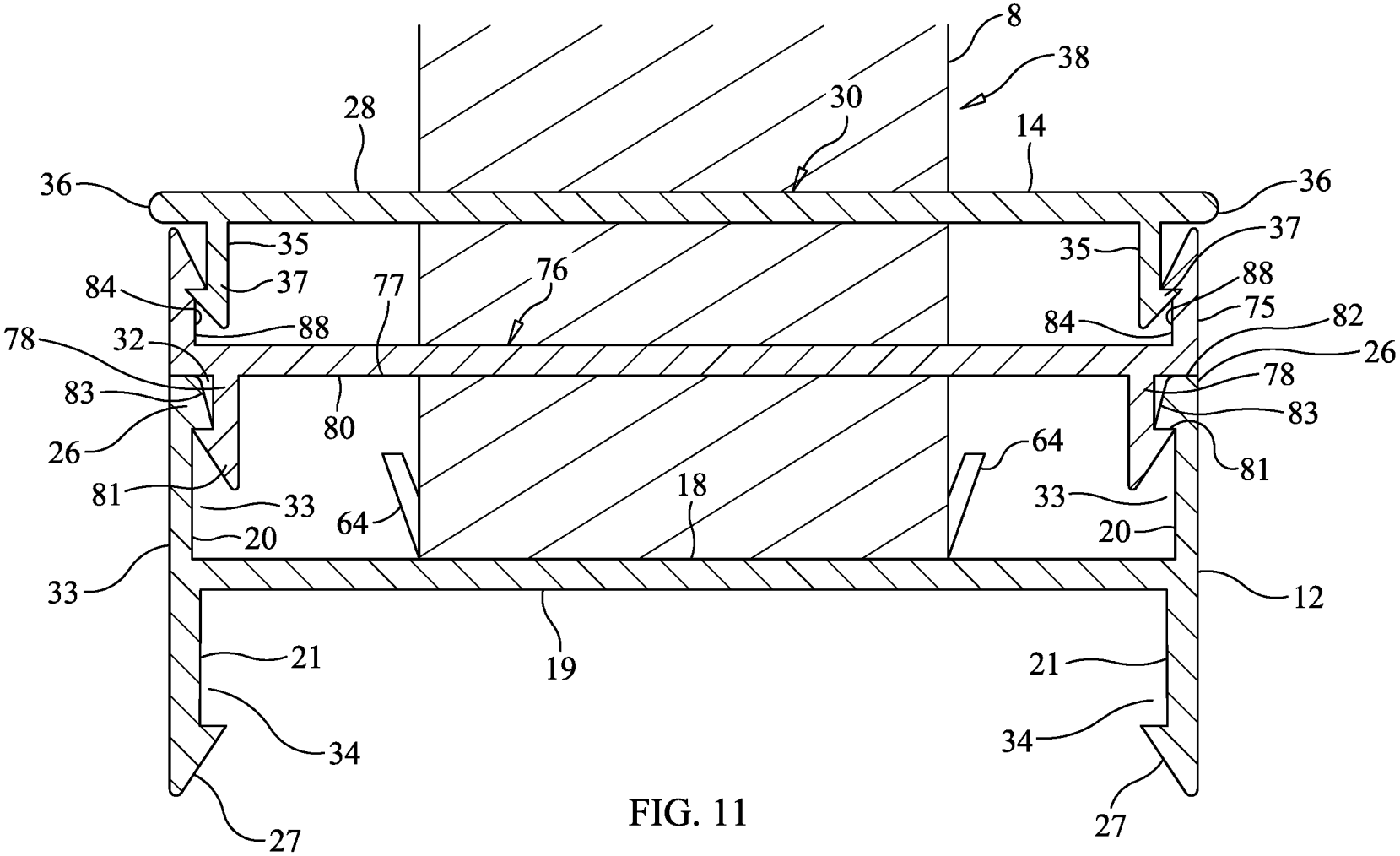
FIG. 11 is an end view of a post shown in FIG. 10 wherein the end of a railing extends into a channel of a post housing through holes in an intermediate post cover and post cover according to various embodiments described herein.

As shown in FIG. 3A, the post cover 14 may further include fitment features comprising tabs 31 adjacent to holes 30 for fitment with a railing (see, e.g., FIG. 11). For example, a hole 30 through the post cover plate 28 may be partially defined by a tab 31. As shown, the longitudinal or length dimension of each hole 30 is defined between two tabs 31 located at each longitudinal end of the hole 30. In other embodiments, tabs 31 may be located at lateral ends as well as or instead of longitudinal ends. The tabs 31 may be formed by introducing cuts 41 through the cover plate 28 that extend longitudinally away from each lateral side of the holes 30. The post cover plate 28 may be referred to as being H cut to form holes 30 and tabs 31.

The holes 76 of the intermediate post cover 75 may be larger than the corresponding holes 30 in the post cover plate 14 in one or more dimensions. For example, an elongated length dimension of the holes 76 of the intermediate post cover 75 may allow space for a railing 8 to be pivoted to non-perpendicular orientations with respect to the post 6 to provide rackability, which may be in addition to or instead of sliding of post cover 14 relative to the intermediate post cover 75 when snap fit. When pivoted, railings may compress against tabs 31 defining a length dimension of the holes 30 causing the tabs 31 to resiliently bend to allow the pivoting while maintaining a tight fit.

In one embodiment, a tab 31 may be positioned over the larger dimension of the corresponding hole 76 of the intermediate post cover 75. The tab 31 may be bendable such that a railing 8 extended through the smaller, e.g., tighter, dimension of the hole 30 may be pivoted, which may pivot the railing 8 within the available space provided by the larger dimension of the hole 76. For example, if a fence panel 4 is to be installed on a slope, elongated holes in the intermediate post cover 75, e.g., such as those shown in FIG. 4A, may allow for pivoting of the railing 8 to an appropriate angle (see, e.g., FIG. 1B).

Figure 19:
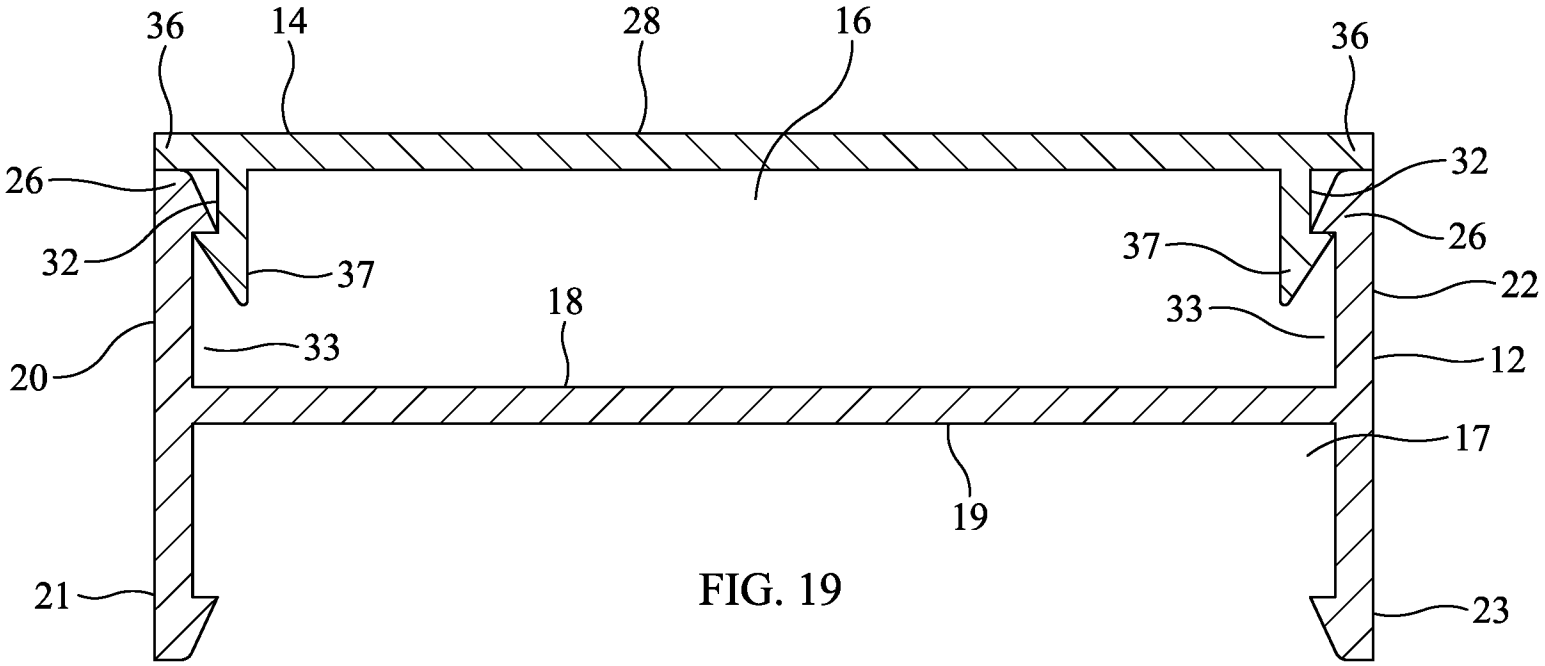
FIG. 19 is an end view of the post housing shown in FIGS. 2A & 2B coupled to the post cover shown in FIGS. 3A & 3B according to various embodiments described herein.

FIG. 19 illustrates another configuration of a post 6 that does not include an intermediate post cover 75. It is to be understood that post 6 features and various embodiments of posts 6 described herein with respect to posts 6 that include an intermediate post cover 75 may apply equally to posts 6 that do not include an intermediate post cover 75, such as post housings described to couple directly to a post cover, consistent with this disclosure. Similarly, post 6 features and various embodiments of posts 6 described herein with respect to posts 6 that does not include an intermediate post cover 75 may apply equally to a post 6 that does include an intermediate post cover 75. For example, in one embodiment, a post cover 14 may be coupled directly to any post housing described herein, such as the post housing 112 described herein with respect to FIG. 12. Similarly, in various embodiments, a post cover 14 may snap fit directly to a post housing having arms 90, such as a post housing 312 described herein with respect to FIGS. 13A-14B & 21A-26B. It will also be appreciated that the post may include an integrated housing and cover.

With reference to FIG. 19, the post housing 12 and post cover 14 of FIGS. 2A & 2B and FIGS. 3A & 3B may be configured to couple, e.g., snap fit. As shown, the lips 26 of the post housing 12 are positioned within the slots 32 defined along the extensions 34, 35 between the first and second lips 36, 37 of the post cover 14. To couple the post housing 12 and post cover 14, the post cover 14 may be positioned over the channel 16 such that the angled surfaces of the lips 32 of the post housing 12 engage with the angled surfaces of the second lips 37 positioned along the post cover 14 extensions 34, 35. The angled surfaces may be complementary, e.g., parallel or approximately parallel (+/−30°). Force may thereafter be applied to bring the components together such that the angled lip surfaces slide past each other. The force may cause compression or bending of the extensions 34, 35, lips 26, 37, sidewalls 20, 22, or combination thereof until the respective lips 26, 37 are snapped into position within the slots 32, 33. Lips 26 are positioned interiorly and the angled surfaces of the lips 26 are directed outwardly such that the lips 26 decrease in width outwardly of the base wall 18. The angled surface of lips 37 are positioned exteriorly and the angled surface of the lips 37 are directed inwardly such that the lips 37 decrease in width outwardly of the cover plate 28. In some embodiments one or more of the lips 26 or lips 37 do not include an angled surface resulting in a tapered width of the lip 26, 37.

As introduced above, the resiliency of one or more fitment features allows the features to spring back to an approximate pre-compressed or pre-bent form when the lips 26, 37 are positioned in the slots 32, 33. In some instances, the resiliency will result in compression of the fitment features against opposing fitment features of the other when coupled. In some embodiments, only the extensions 34, 35 or lips 37 of the post cover 14 are resiliently compressible or bendable for fitment and the lips 26 and sidewalls 20, 22 of the post housing 12 are rigidly positioned to inwardly bend or compress the extensions 34, 35 or lips 37 of the post cover 14 when force to snap the post cover 14 into the channel 16. In another embodiment, only the lips 26 or sidewalls 20, 22 of the post housing 12 are resiliently compressible or bendable for fitment and the extensions 34, 35 or lips 37 of the post cover 14 are rigidly positioned to outwardly bend or compress the lips 26 or sidewalls 20, 22 of the post housing 12 when force is applied to snap the post cover 14 into the channel 16. Once coupled, the post cover 14 is stably coupled to the post housing 12 over channel 16 and usually may not be removed outwardly without application of excessive or damaging force. As introduced above, the channel 16 may extend along all or a portion of the length of the post 6. In some embodiment, the channel 16 is continuous between at least two adjacent apertures 30 through the post cover plate 28. In one embodiment, one or more ends of the channel 16 or corresponding slots 30 may allow the post cover 14 to be slid over the channel 16 or removed from the channel 16 by sliding the post cover 14 from an end of the channel 16. In some embodiments, the channel 16 or corresponding slots 32, 33 may not allow sliding engagement or may be capped.

In some embodiments, the post housing 12 defines a slot 33 along an interior side (channel 16 side) of each sidewall 20. The post cover 14 may include an exteriorly positioned lip 37 configured to snap fit in slot 33. In one embodiment, the post housing 12 defines a slot (not shown) along an exterior side of each sidewall 20 and the post cover 14 includes an interiorly positioned lip (not shown) configured to snap fit in the slot. In another embodiment, the sidewalls 20 includes interiorly positioned lips 26 and the post cover 14 includes exterior side slots 32 configured to snap fit with lips 26. In one configuration, the post housing 12 includes exterior side (non-channel 16 side) lips (not shown) and the post cover 14 includes interior side slots configured to snap fit with the exterior side lips. Accordingly, the post housing 12 and post cover 14 may include one or more slots, lips, or combinations thereof configured to snap fit, which may be interiorly or exteriorly positioned. It will be appreciated that a lip or slot need not be positioned on an extension extending from the cover plate 28 or sidewall 20 that defines the channel 16. For example, a lip or slot may be positioned along a side or edge of the cover plate 28 (e.g., lip 36) or along base wall 18 or sidewall 21, e.g., in embodiments where extensions 35 may extend to define the channel 16. Further, in some embodiments, housings and covers may be coupled by sliding lips into slots.

In embodiments wherein the post housing 12 comprises an additional channel 17, such as the post housing 12 comprising an "H" configuration shown in FIGS. 2A, 2B, 19, 21A the post housing 12 may provide snap fitment for a second post cover 14 over channel 17 or second intermediate post cover 175, which may be similar to that described above or elsewhere herein. Channel 17 is orientated 180 degrees with respect to channel 16 to provide assembly of an additional panel 4 coupled to the post 6 that is aligned linearly with a first panel 4 (see, e.g., FIGS. 1A & 1B). In some embodiments, posts 6 may include other configurations. In one embodiment, channel 17 may be orientated at other angles with respect to channel 16. For example, the post housing 12 may include a second channel 17 offset at an angle with respect to the first channel 16, e.g., to provide corners to be formed with two coupled panels 4 at the post 6 (see, e.g., FIG. 23A). Posts 6 may also include only a single channel 16 for receiving components. Such posts 6 may be end posts, for example, such as those described herein with respect to FIGS. 12 & 22 or single portions post housings 12 of FIGS. 14A, 24A, & 25A. In other embodiments, the post 6 may be an integrated post that comprises both the post housing 12 and post cover 14 (not shown). Different fitment features may also be used with respect to each channel 16, 17.

In various embodiments, the post cover 14 shown in FIG. 3A may be varied with respect to the location of the apertures 30 to change the location of where railings 8 stably couple to the post 6. In some embodiments, the post housing 12 is configured for snap fitment with a plurality of interchangeable or selectable post covers 14. For example, at least one of the plurality of post covers 14 may comprise a post cover plate 28 that defines a configuration of holes 30 that is different than a configuration of holes 30 defined through a post cover plate 28 of at least one of the other post covers 14. In this way, the post 6 may be customized by selecting a post cover 14 for fitment with the post housing 12 that provides a desired railing number, size, orientation, or other aperture design.

Similar to the post 6 including the intermediate post cover 75 described above, tabs 31 of the post cover 14 may be bendable such that a railing 6 extended through hole 30 may be pivoted, which may pivot the railing within the available space provided within the channel 16 to an appropriate angle (see, e.g., FIG. 1B). In one embodiment (not shown), the post housing 12 includes the structure of the intermediate post housing described above, e.g., holes 76.

Figure 12:
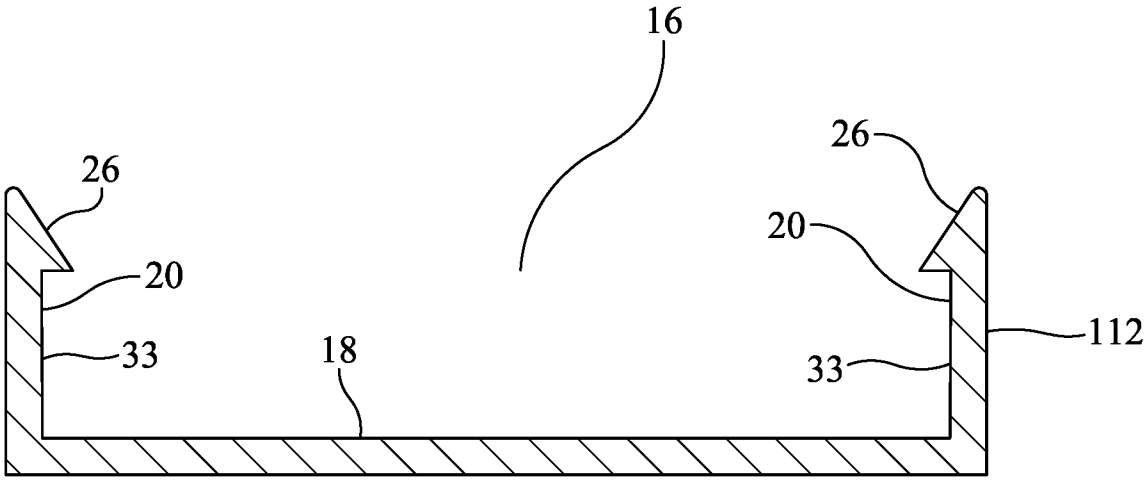
FIG. 12 is an end view of a post housing according to various embodiments described herein.

FIG. 12 illustrates another embodiment of a post housing 112, which is similar to the embodiment shown in FIG. 2A, but that defines a single channel 16 for use in an end post, such as end post 6*a* (FIGS. 1A & 1B). The post housing 112 includes fitment features structured to cooperatively engage corresponding fitment features positioned on the intermediate post cover 75 (see, e.g., FIGS. 4A & 4B) to thereby stably couple the post housing 112 and the intermediate post cover 75 via snap fitment (see, e.g., FIG. 10).

Figure 13A:
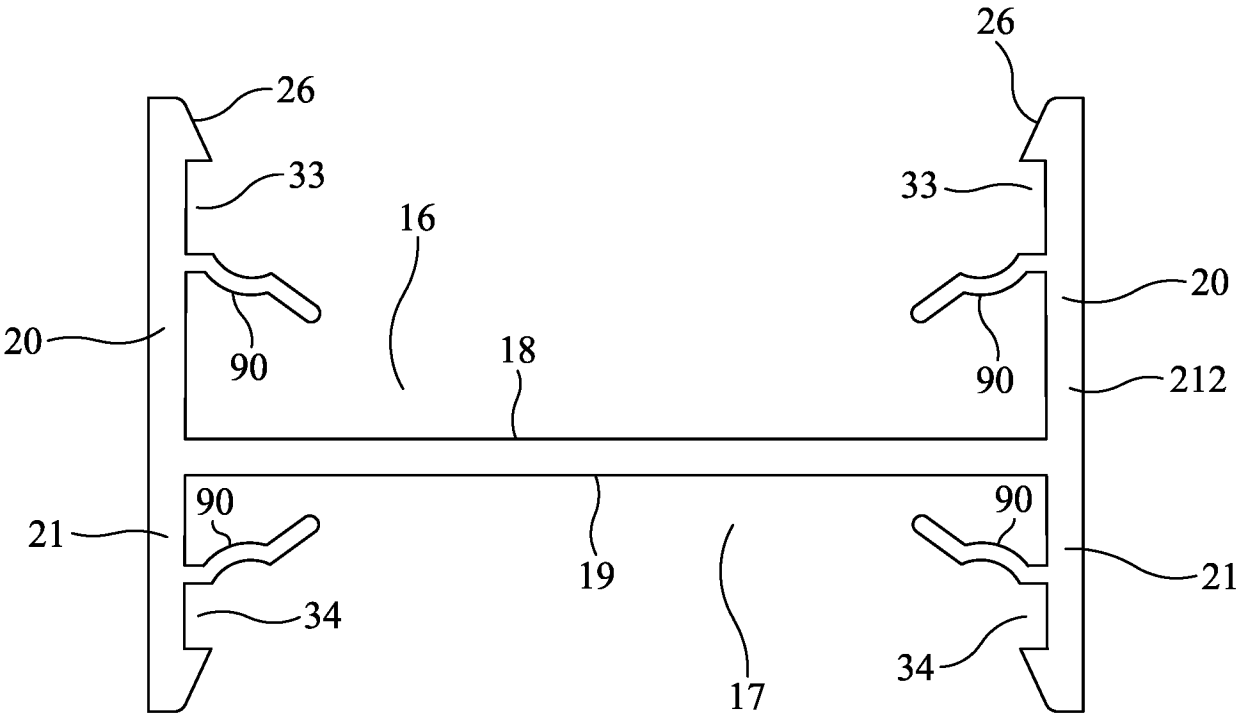
FIG. 13A is an end view of a post housing according to various embodiments described herein.
Figure 13B:
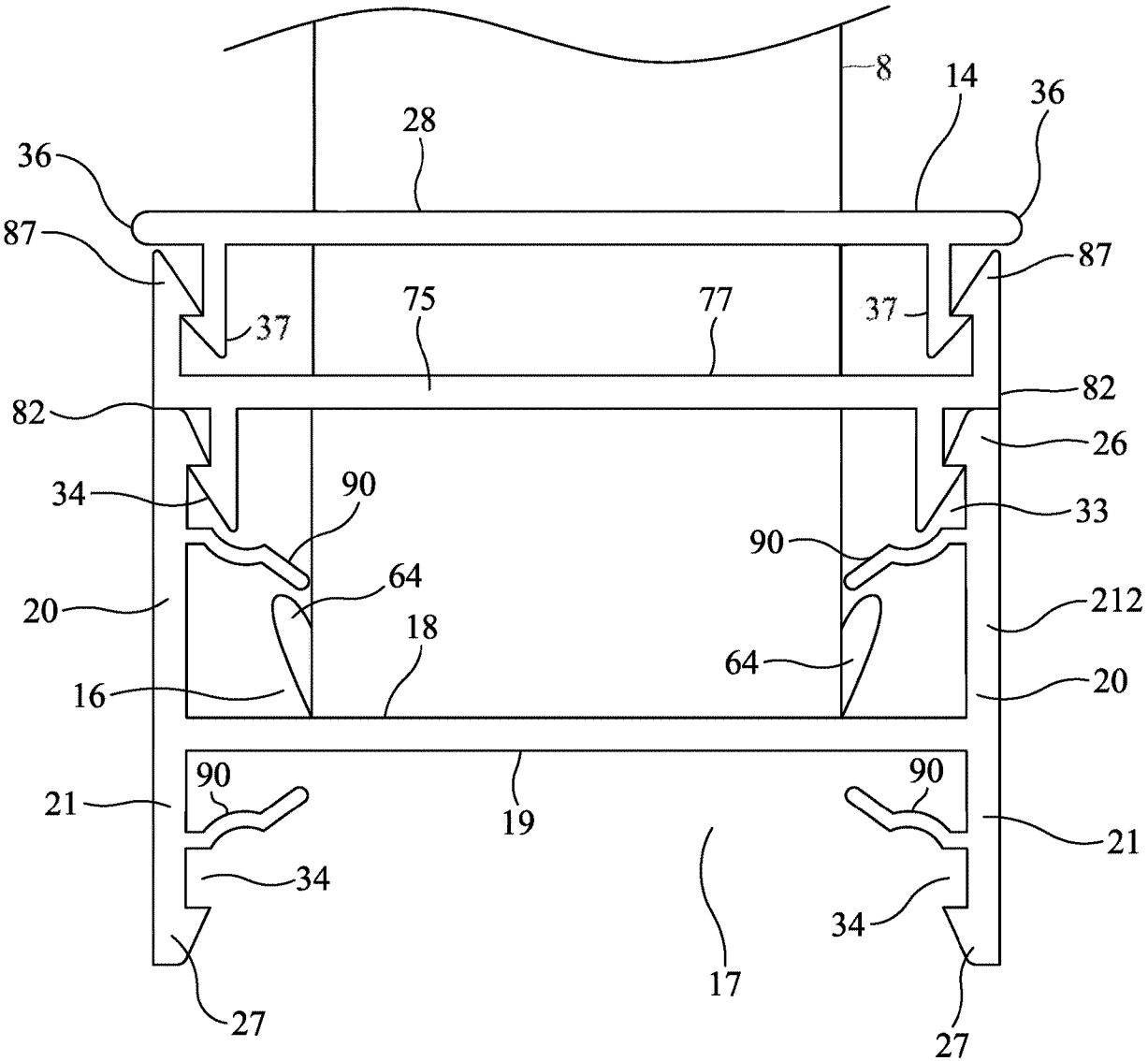
FIG. 13B is an end view of the post housing shown in FIG. 13A coupled to the intermediate post cover shown in FIGS. 4A & 4B, which is coupled to the post cover shown in FIGS. 3A & 3B according to various embodiments described herein.

FIG. 13A illustrates an end view of a post housing 212 according to various embodiments. The post housing 212 has an H configuration similar to post housing 12 described above with respect to FIGS. 2A & 2B and may be used in a line post, such as line post 6*b* described above with respect to FIGS. 1A & 1B. The post housing 212 includes fitment features similar to those described above with respect to post housing 12 and also includes arms 90. The arms 90 extend inwardly into the channels 16, 17 from the sidewalls 20, 21. The arms 90 may be configured to extend a distance from the sidewalls 20, 21 to limit lateral movement of the railing 8 when positioned in the channel 16, 17. For example, as shown in FIG. 13B, wherein the post housing 212 is shown coupled with intermediate post cover 75 and post cover 28 and with railing 8 extended into the channel 16, the arms 90 are positioned adjacent to the lateral sides of the railing 8 thereby preventing lateral movement of the railing 8 beyond arms 90. Upper ends of ears 64 (see, e.g., FIGS. 5A-5C and accompanying description below) may extend outward beyond the ends of the arms 90 such that the ears 64 engage the arms 90 if pulled outwardly from the channel 16. In some embodiments, the post housing 212 may couple to the post cover 28 without an intermediate post cover 75 therebetween. In one embodiment, the post housing 112 shown in FIG. 12 may include arms 90.

Figure 21A:
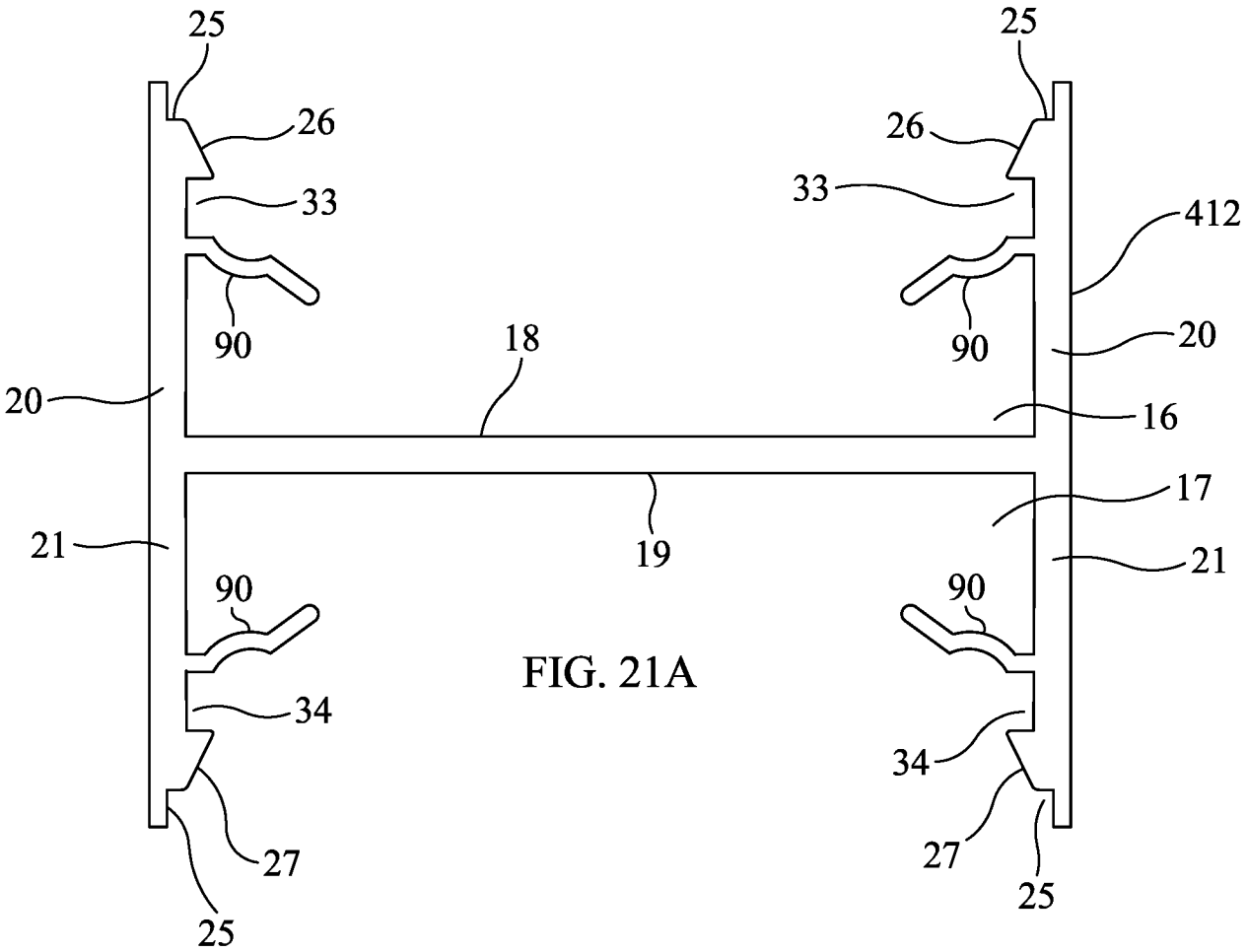
FIG. 21A is an end view of a post housing according to various embodiments described herein.
Figure 21B:
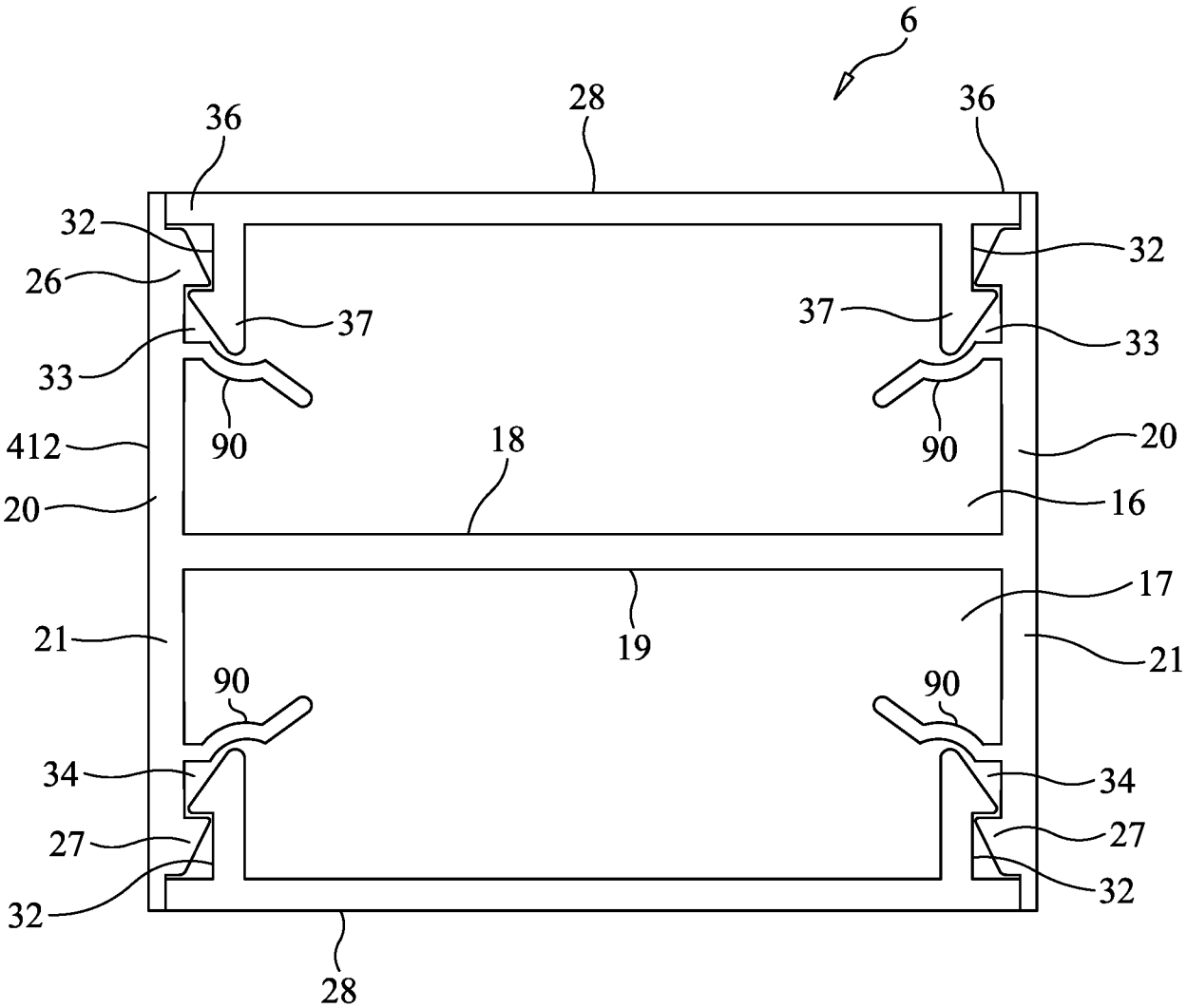
FIG. 21B is an end view of the post housing shown in FIG. 13A coupled to the post cover shown in FIGS. 3A & 3B according to various embodiments described herein.

FIG. 21A illustrates an end view of a post housing 412 according to various embodiments. The post housing 412 has an H configuration similar to post housings 12, 212 described above with respect to FIGS. 2A & 2B and FIGS. 13A & 13B and may be used in a line post, such as line post 6*b* described above with respect to FIGS. 1A & 1B. The post housing 412 includes fitment features similar to those described above with respect to post housing 12 and post housing 212. As shown in FIG. 21B, the post housing 412 may couple to a post cover 28. In some embodiments, an intermediate post cover 75 may also be used.

Figure 22:
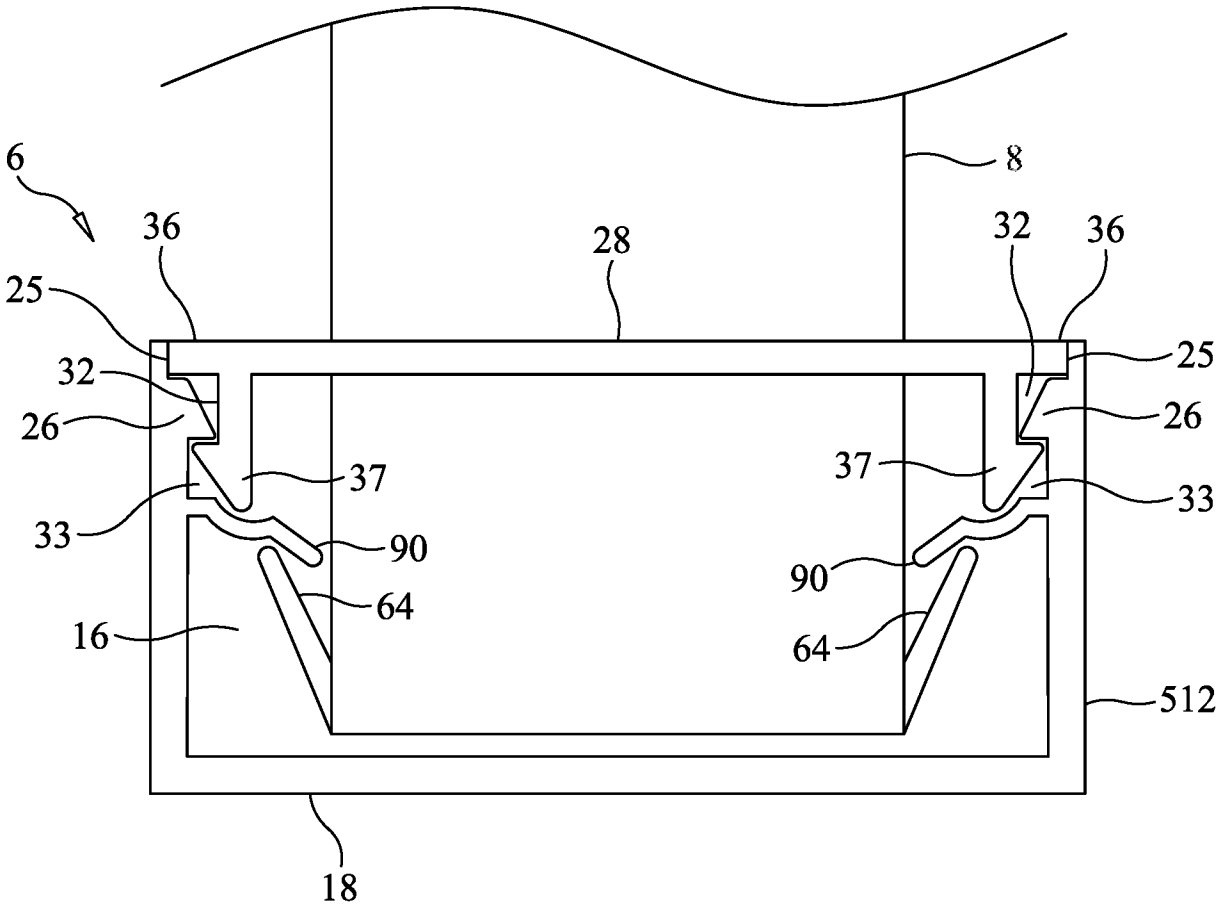
FIG. 22 is an end view of an end post coupled to a railing to stably couple the railing and post according to various embodiments described herein.

Post housing 412 also includes arms 90 that extend inwardly into the channels 16, 17 from the sidewalls 20, 21 in a configuration similar to that described above with respect to FIGS. 13A & 13B. For example, FIG. 22 illustrates a post housing 512 having the same configuration as post housing 412 but in an end post 6*a* arrangement. Post housing 512 is shown coupled to a post cover 28 and with a railing 6 extended into the channel 16. The arms 90 are positioned adjacent to the lateral sides of the railing 6 thereby preventing lateral movement of the railing 6. Upper ends of the ears 64 may extend outward beyond the ends of the arms 90 such that the ears 64 engage the arms if pulled outwardly from the channel 16.

Post housings 412 and 512 also include fitment features configured to snap fit with a post cover 28 such that the post cover 28 is recessed within the channel with respect to sidewalls 20, 21. Post housing 412 and 512 include slots 25 for recessed fitment and are positioned outward of the inward extent of the lips 26, 27. Specifically, slots 25 may include a ledge for receiving lips 36 of cover plate 28 together with sidewalls 20, 21, e.g., as shown in FIG. 21B. Lips 26, 27 may also be dimensioned to be received in slot 32 of respective covers 28 between lips 36 and 37. With reference again to FIGS. 1A & 1B multi-panel posts 6*b* may include a post housing having multiple channels into which railings 8 may slot. For example, the post housing 12 (FIGS. 2A & 2B), post housing 212 (FIGS. 13A & 13B), and post housing 412 (FIGS. 21A & 21B) each include two channels 16, 17 and fitment features for stably coupling railings 8 of multiple panels 4. The post housings 12, 212, 412 have H configurations wherein channel 17 is orientated 180 degrees with respect to channel 16 to provide assembly for an additional panel 4 in a linear orientation with respect to a first panel 4 for use in a line post 6*b*.

In other embodiments, the fence system 2 includes post housings having multiple channels that are not oriented at linear angles. For example, channel 17 of post housing 12, 212, 412 or an additional channel, such as a third or fourth channel for receiving a railings of third or fourth panels, may be orientated at other angles with respect to channel 16, e.g., to provide stable coupling between two panels 4 at a corner. A corner post, for example, may comprise a first channel positioned at 45°, 60°, 90°, 120°, 145°, 160°, or any other suitable angle with respect to a second. Multi-panel posts 6*b* or post housings structured for coupling multiple panels 4 may also include more than two channels to couple more than two panels 4. Multi-panel posts 6*b* may comprise the same or different fitment features with respect to each channel. In a further embodiment, the single channel 16 post housing 112 shown in FIG. 12 or another single channel post housing may include an additional channel adjacent to channel 16 that is not structured to receive a railing 8. For example, the additional channel may provide strength or body to the post housing 112. In one embodiment, such a post housing may have a cross-sectional configuration similar to that shown with respect to the end view of the railing housing 40 in FIG. 5B.

Figure 23B:
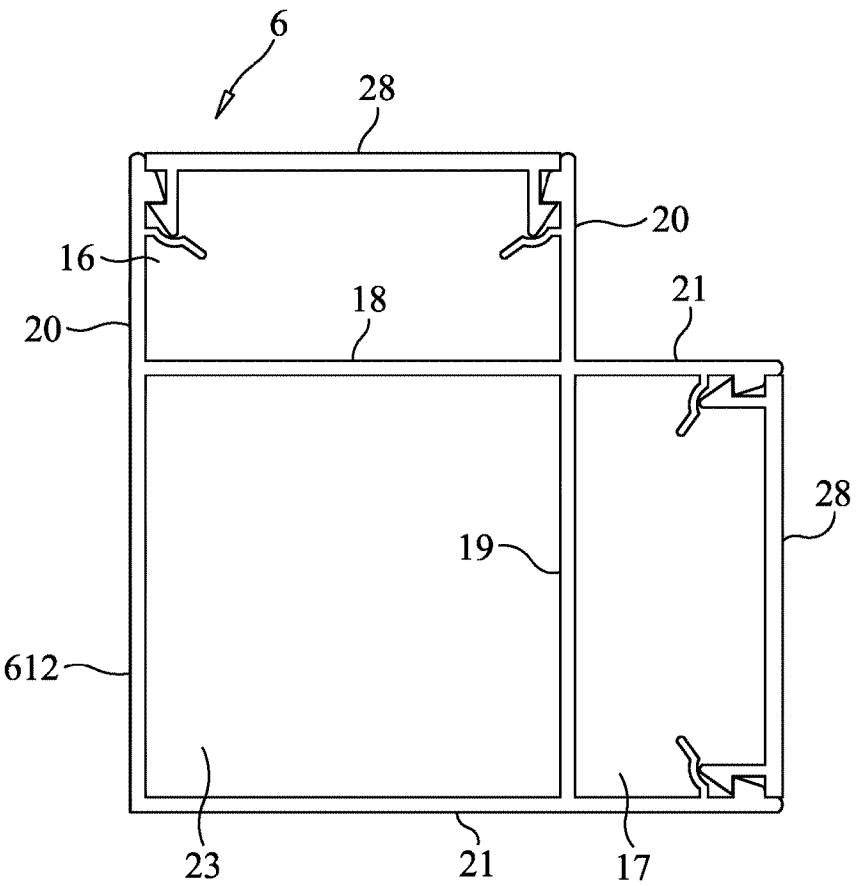
FIG. 23B is an end view of the corner post of FIG. 23A coupled to post covers post according to various embodiments described herein.
Figure 23A:
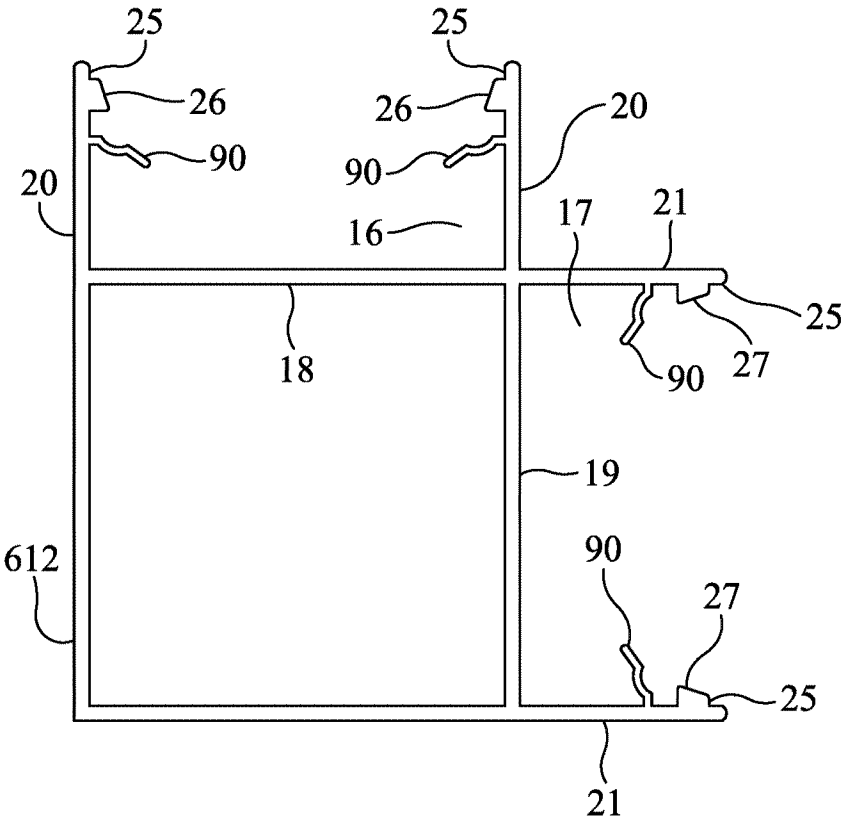
FIG. 23A is an end view of a corner post according to various embodiments described herein.

FIG. 23A illustrates a corner post housing 612 according to various embodiments. The corner post housing 612 includes fitment features similar to those described with respect to post housing 412 and 512 and includes arms 90 and slot 25 for recessed fitment of cover plates 28, as shown in FIG. 23B. Railings 8 may be received within channels 16, 17 as described above with respect to post housings 412, 512 and FIG. 22. Post housing 612 is a fixed corner post that positions channel 16 at a 90° angle relative to channel 17. Outer sidewalls 20 and 21 of each channel 16, 17 extend beyond base walls 18 and 19 and meet at approximately a 90° angle to form an outer edge. Inner sidewalls 20 and 21 each extend to respective base walls 18 and 19 and meet at approximately a 90° angle to form an inner edge. In other embodiments, the outer or inner edges may be formed at round edges or edges formed at greater or lesser angles. As shown, the outer sidewalls form a cavity 23 together with base walls 18 and 19 defining a square cross-section. In other embodiments, cavities with different cross-sections may be formed, e.g., arcuate, rectangle, pentagon, geometric or non-geometric shapes, to name a few. For example, in one embodiment (not shown), outer sidewalls 20, 21 of each channel 16, 17 may be connected by a wall segment that together with base walls 18 and 19 form a cavity defining a triangular cross-section.

Figure 14A:
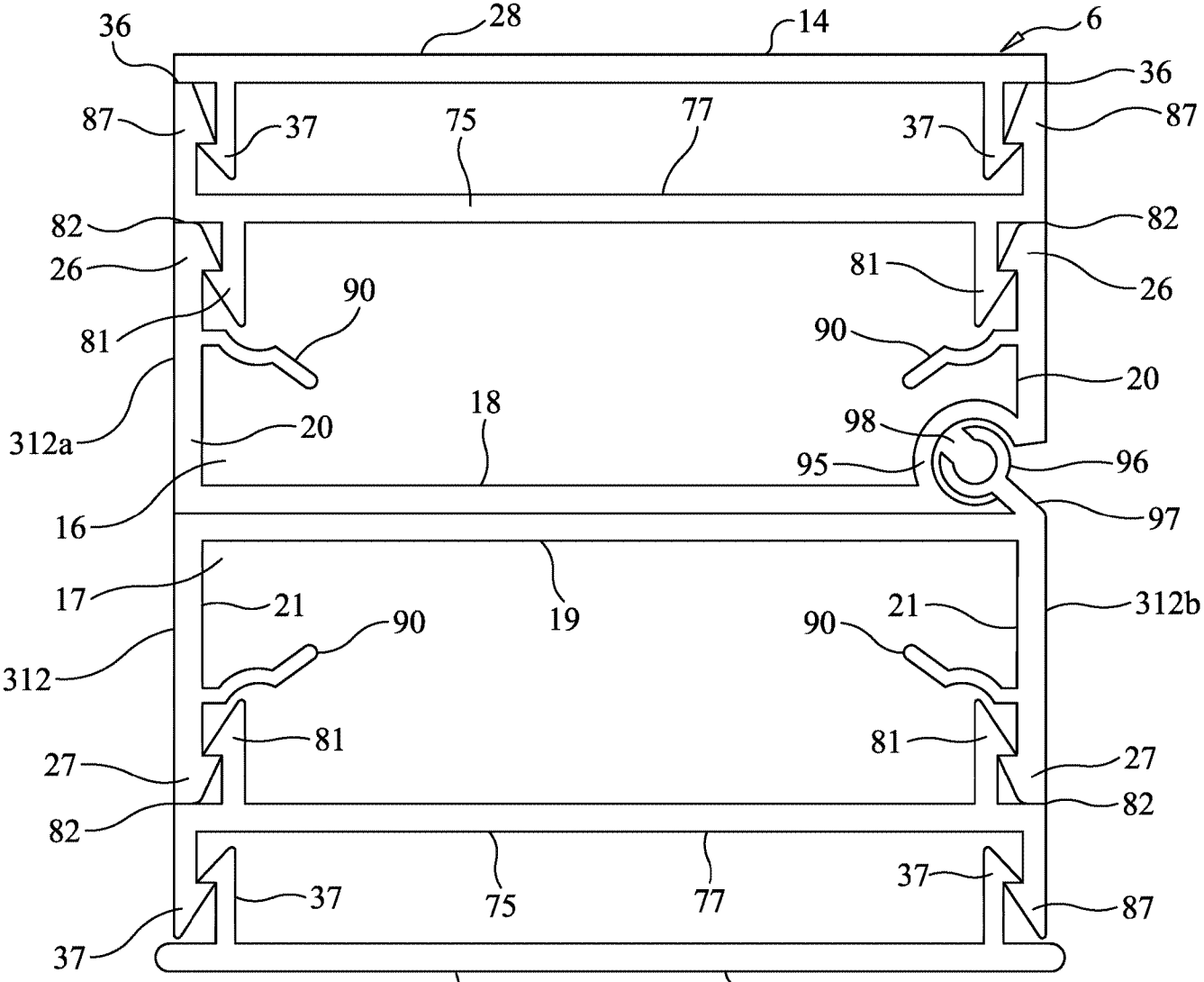
FIG. 14A is an end view of a turning post including two mated post housings each coupled to an intermediate post cover and a post cover according to various embodiments described herein.
Figure 14B:
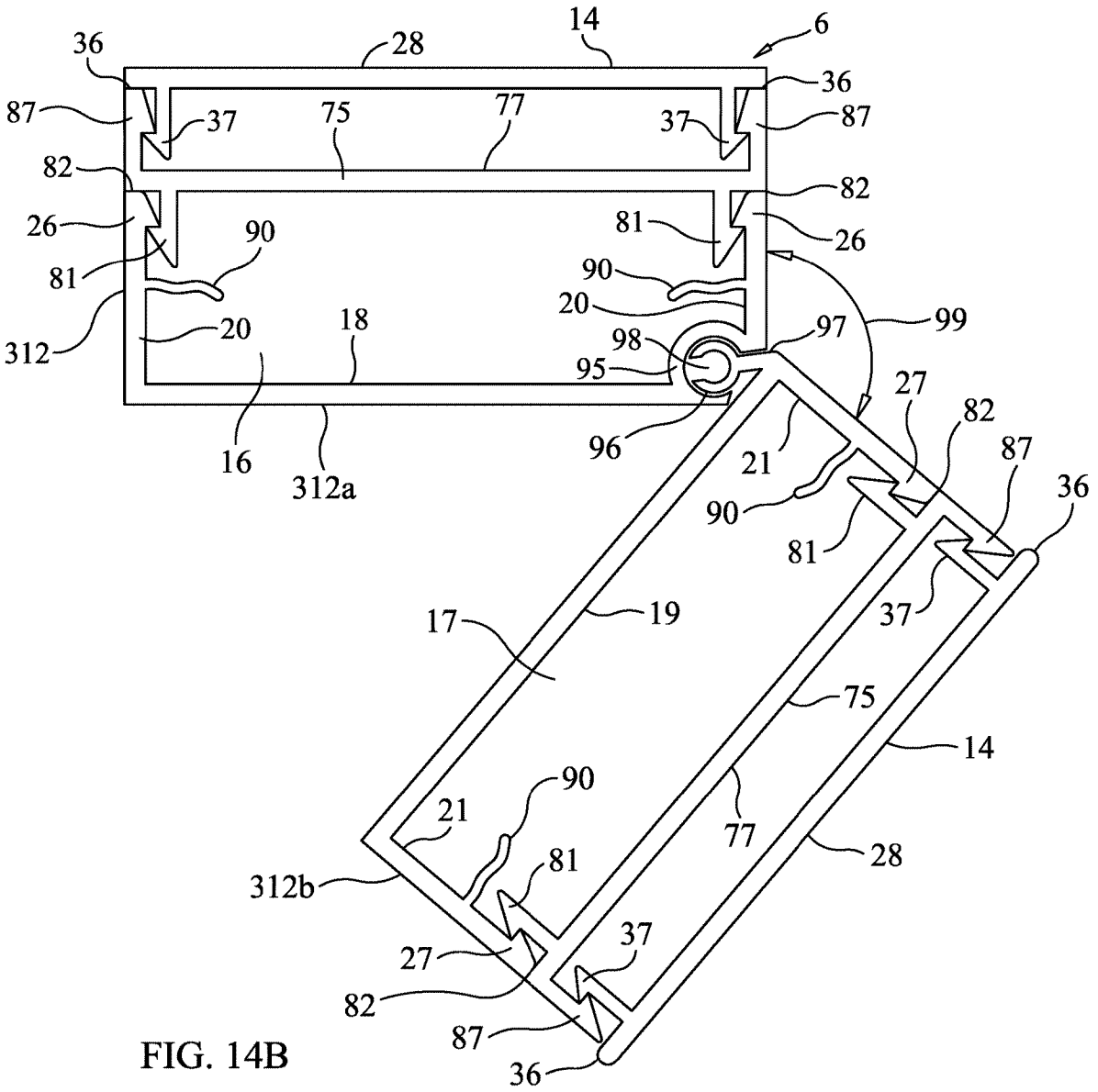
FIG. 14B is an end view of the turning post shown in FIG. 14A depicting relative pivoting between the mated post housings according to various embodiments described herein.

FIGS. 14A & 14B illustrate a post housing 312 for use in a turning post according to various embodiments. Post housing 312 includes a first post housing 312*a* and a second post housing 312*b*, each including a channel 16, 17 and respective fitment features. The fitment features of the first post housing 312*a* and the second post housing 312*b* are similar to those of as post housings 212 (FIGS. 13A & 13B) for stably coupling via snap fitment, e.g., slidable snap fitment, to a post cover 14 or to an intermediate cover 75, which may stably couple via snap fitment, e.g., slidable snap fitment, to a post cover 28 in a manner similar to that described above. Other configurations of fitment features may be used. In some embodiments, one or both of the first post housing 312*a* or second post housing 312*a*, 312*b* do not include arms 90.

The first post housing 312*a* and the second post housing 312*b* are further configured to pivotably couple. The first post housing 312*a* includes a groove 95 that extends along its length between base 18 and a sidewall 20. The second post housing 312*b* includes a rail 96 that extends from an arm 97 positioned between base 19 and a sidewall 21. The groove 95, rail 96, or arm 97 may extend along all or one or more portions of the lengths of the respective first post housing 312*a* and second post housing 312*b*. Other configurations of pivotably coupling the first post housing 312*a* and the second post housing may be used. For example, ball and socket, pins, hinges, or other pivotable couplings may be used. The rail 96 has a "c" cross-section including a gap 98. The gap 98 may decrease friction when pivoting (along arc 99) the rail 96 within the groove 95. The rail 96 may be introduced into the groove 95 by aligning an end of the rail 96 at an end of the groove 95 and then sliding the rail 96 therein. In one embodiment, the "c" cross-section of the rail 96 may be resiliently compressible to allow a user to snap fit the first post housing 312*a* and second post housing 312*b* to thereby pivotably couple the two. In one embodiment, the rail 96 does not include a gap 98 and the rail 96 may be slide fit into the groove 95 from an end thereof. When pivotably coupled, the first post housing 312*a* and second post housing 312*b* may be pivoted 99 relative to each other to orient channels 16, 17 to a desired angle. In the embodiment illustrated, the first post housing 312*a* and second post housing 312*b* may be pivoted 99 to orient the channels 16, 17 between 180° (FIG. 14A) and 120° (FIG. 14B) relative to each other. In other embodiments, the rail 96 and groove 95 or another pivotable coupling may be configured to provide different turning radiuses. For example, the arm 97 may extend at a different angle from sidewall 21 or base 19 or the groove 95 may be positioned at a different portion of base 18 or sidewall 20 to provide an orientation or range of orientations that include smaller angles, e.g., angles less than 120° or less than 90°. The first post housing 312*a* and the second post housing 312*b* may be configured to be used separately in end posts or together in turning posts by pivotably coupling the two.

Figure 24A:
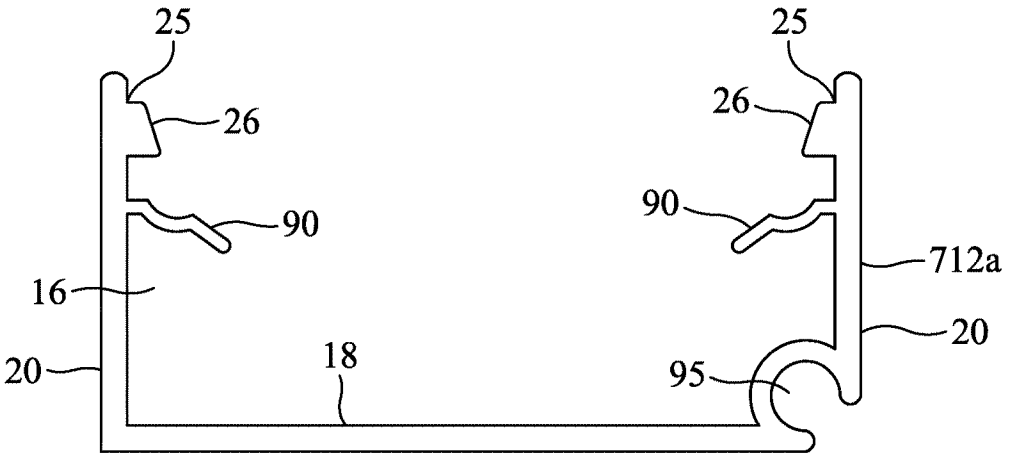
FIG. 24A is an end view of a female turning post housing according to various embodiments described herein.
Figure 24B:
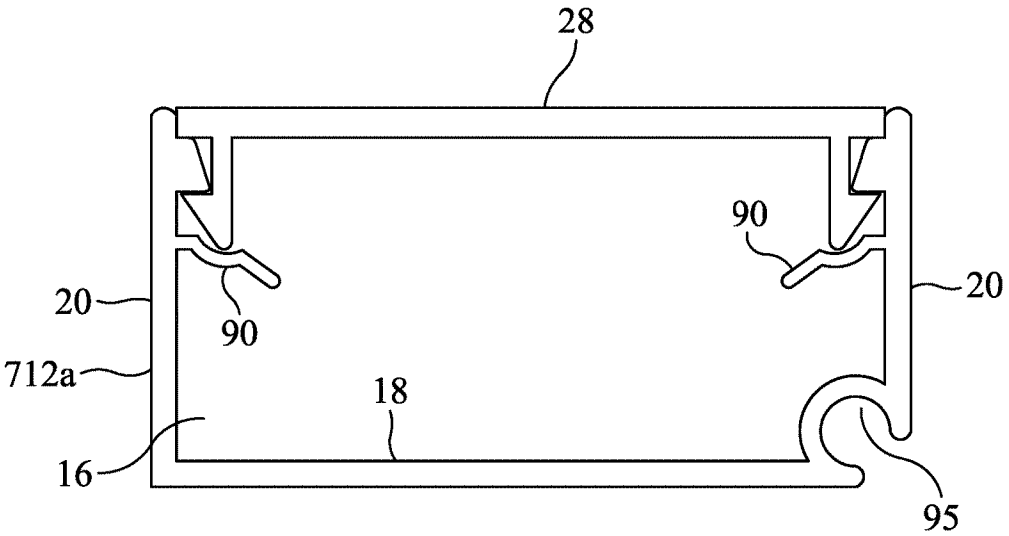
FIG. 24B is an end view of the turning post housing of FIG. 24A coupled to a post cover according to various embodiments described herein.
Figure 25A:
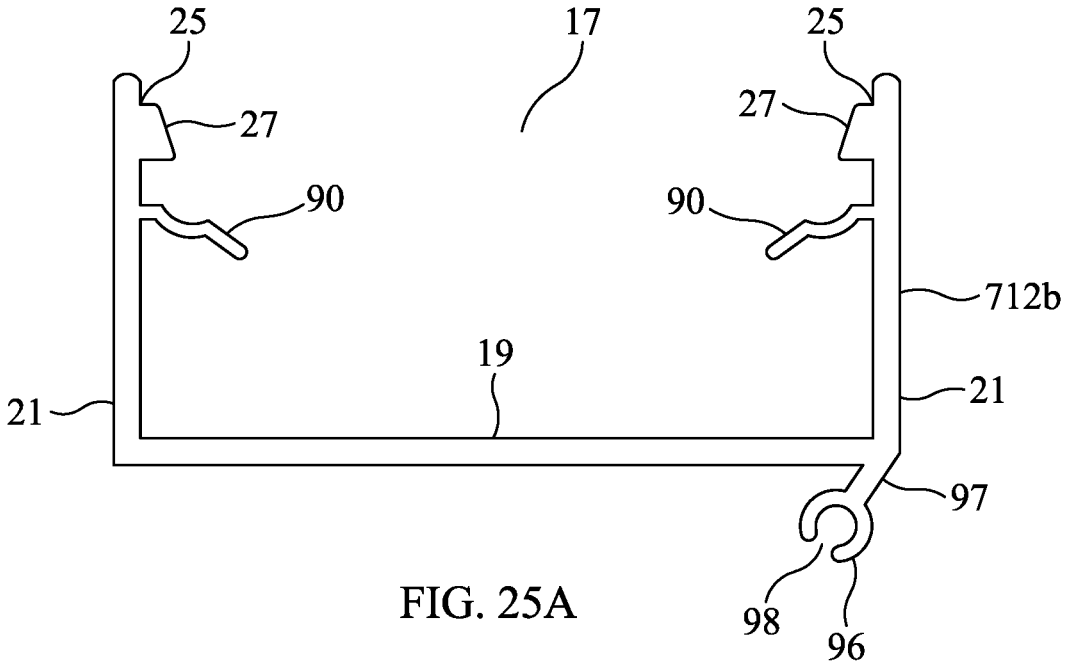
FIG. 25A is an end view of a male turning post housing according to various embodiments described herein.
Figure 25B:
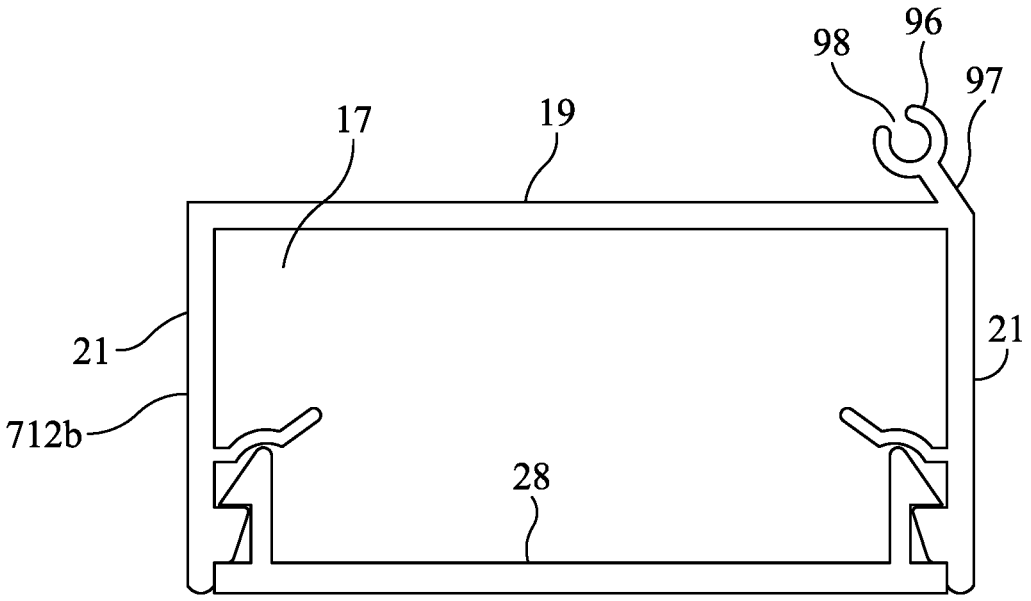
FIG. 25B is an end view of the turning post housing of FIG. 25A coupled to a post cover according to various embodiments described herein.

FIGS. 24A & 25A illustrate post housings 712*a*, 712*b* for use in a turning post according to various embodiments. Post housing 712*a* and post housing 712*b*, each include a channel 16, 17 and respective fitment features similar post housings 412, 512, and 612 for stably coupling via snap fitment, e.g., recessed slidable snap fitment, to a post cover 28 in a manner similar to that described above. Other configurations of fitment features may be used. For example, in some embodiments, one or both of the post housings 712*a*, 712*b* do not include arms 90. As shown in FIGS. 24B & 25B, post housings 712*a*, 712*b* may directly couple to post covers 28. In other embodiments, intermediate covers 75 may be used between the post housings 712*a*, 712*b* and the covers 28.

Similar to turning post housings 312*a* and 312*b*, turning post housings 713*b* and 712*b* are configured to pivotably couple. For example, post housing 712*a* includes a groove 95 that extends along its length between base 18 and a sidewall 20. Post housing 712*b* includes a rail 96 extending from an arm 97 positioned between base 19 and a sidewall 21. The groove 95, rail 96, or arm 97 may extend along all or one or more portions of the lengths of the respect post housings 712*a*, 712*b*. Similar to the embodiment described above with respect to FIGS. 14A & 14B, other configurations of pivotably coupling the housings 712*a*, 712*b* may be used, e.g., ball and socket, pins, hinges, or other pivotable couplings may be used. The rail 96 has a "c" cross-section including a gap 98. The gap 98 may decrease friction when pivoting the rail 96 within the groove 95. The rail 96 may be introduced into the groove 95 by aligning an end of the rail 96 at an end of the groove 95 and then sliding the rail 96 therein. In one embodiment, the "c" cross-section of the rail 96 may be resiliently compressible to allow a user to snap fit the post housings 712*a*, 712*b* to thereby pivotably couple the two. In one embodiment, the rail 96 does not include a gap 98 and the rail 96 may be slide fit into the groove 95 from an end thereof. When pivotably coupled, post housings 712*a* and 712*b* may be pivoted 99 relative to each other to orient channels 16, 17 to a desired angle, e.g., as described above with respect to FIGS. 14A & 14B or below as described with respect to FIGS. 26A & 26B.

Figure 26B:
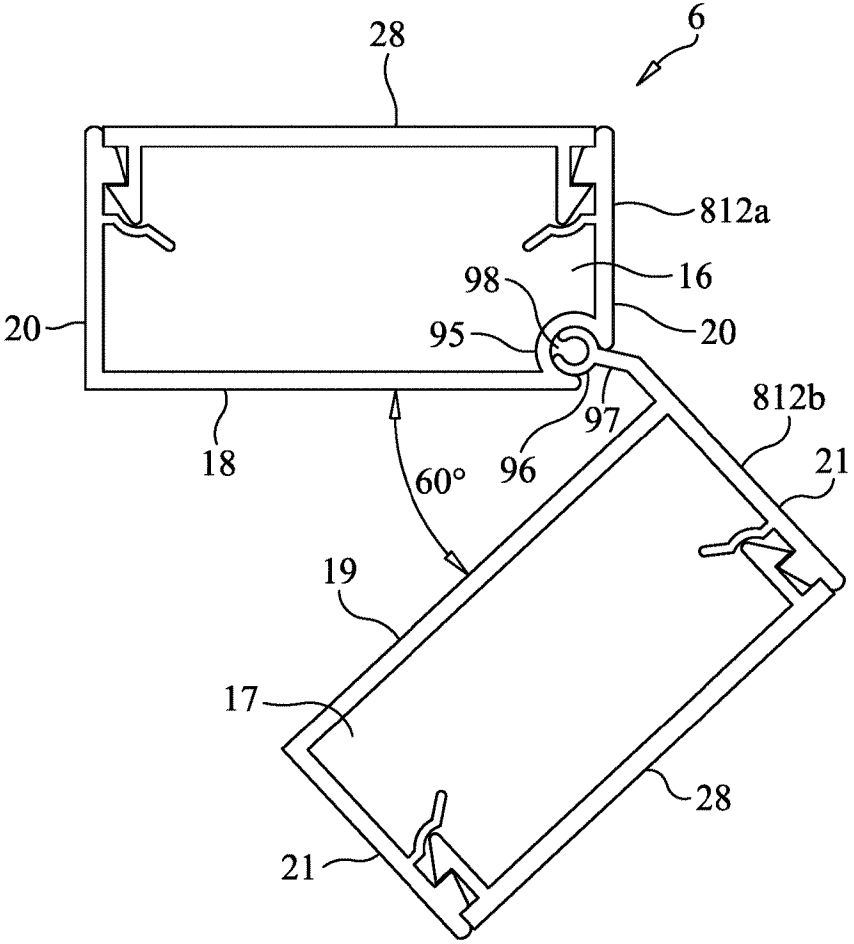
FIGS. 26A & 26B depict pivoting of a turning post according to various embodiments described herein.
Figure 26A:
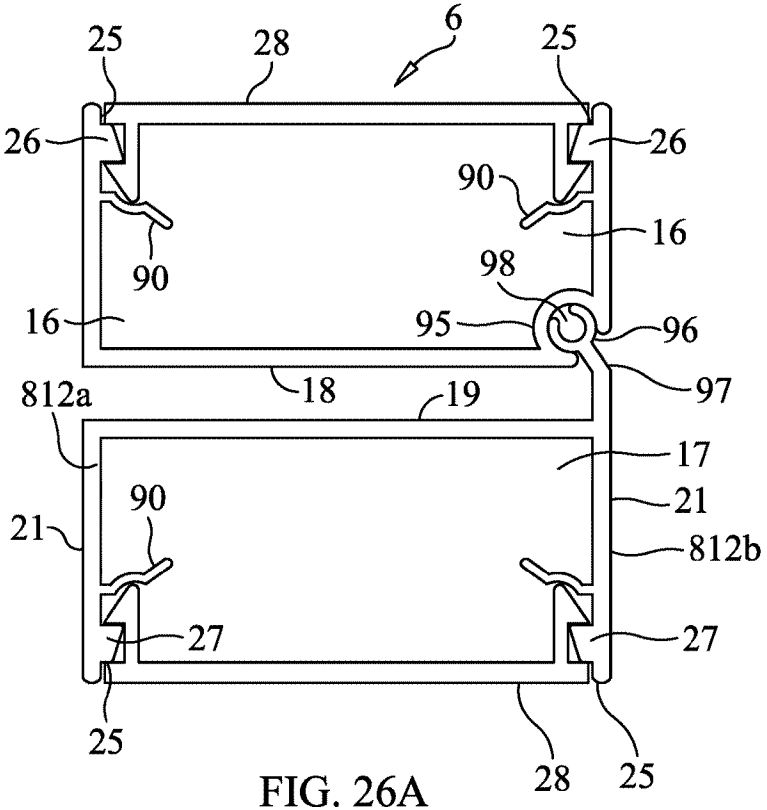

FIGS. 26A & 26B illustrate a turning post that includes a first post housing 812*a* and a second post housing 812*b*. Post housing 812*a* is similar to post housing 712*a*. Post housing 812*b* is similar to post housing 712*b* except rail 96 and arm 97 are further extended by arm extension 100. Accordingly, rail 96 may be extended from sidewalls 21 or base wall 19 at various angles and distances by modifying arm 97 or extension 100 to provide the desired separation distance and orientation between the respective channels 16, 17 or respective base walls 18, 19 at the desired turning angle. As shown, the first post housing 812*a* and second post housing 812*b* are pivotably coupled and may be pivoted 99 relative to each other to orient channels 16, 17 to a desired angle. In the embodiment illustrated, the first post housing 812*a* and second post housing 812*b* may be pivoted 99 to orient the channels 16, 17 between 180° (FIG. 14A) and 120° (FIG. 14B) relative to each other. In other embodiments, the rail 96 and groove 95 or another pivotable coupling may be configured to provide different turning radiuses. For example, the arm 97 may extend at a different angle from sidewall 21 or base 19 or the groove 95 may be positioned at a different portion of base 18 or sidewall 20 to provide an orientation or range of orientations that include smaller angles, e.g., angles less than 120° or less than 90°.

As introduced above with respect to FIGS. 1A-1B, the fence system 2 and components for use with the fence system 2 may also include one or more railings 8. Railings 8 may extend along a longitudinal length between a first end 38 and a second end 39 and be configured to stably couple to a first post 6 at the first end 38 and to a second post 6 at the second end 39. For example, the first end 38 may be dimensioned to extend into the channel defined in the post housing through corresponding holes extending through the post cover plate or intermediate post cover plate and cover plate and stably couple the railing 8 and post 6. In some embodiments, stably coupled railings may be pivoted to change the angle the railing extends from the post. Railings may be further configured to stably couple to one or more pickets 10. In some embodiments, the fence system 2 may include a plurality of configurations of railings 8. For example, the fence system 2 may comprise posts 6 configured to stably couple two or more railings 8, e.g., an upper railing 8*a* and a lower railing 8*b*. The fence system 2 may also comprise posts 6 configured to stably couple additional railings 8, such as middle railings (not shown) through which pickets 10 extend.

Figure 5A:
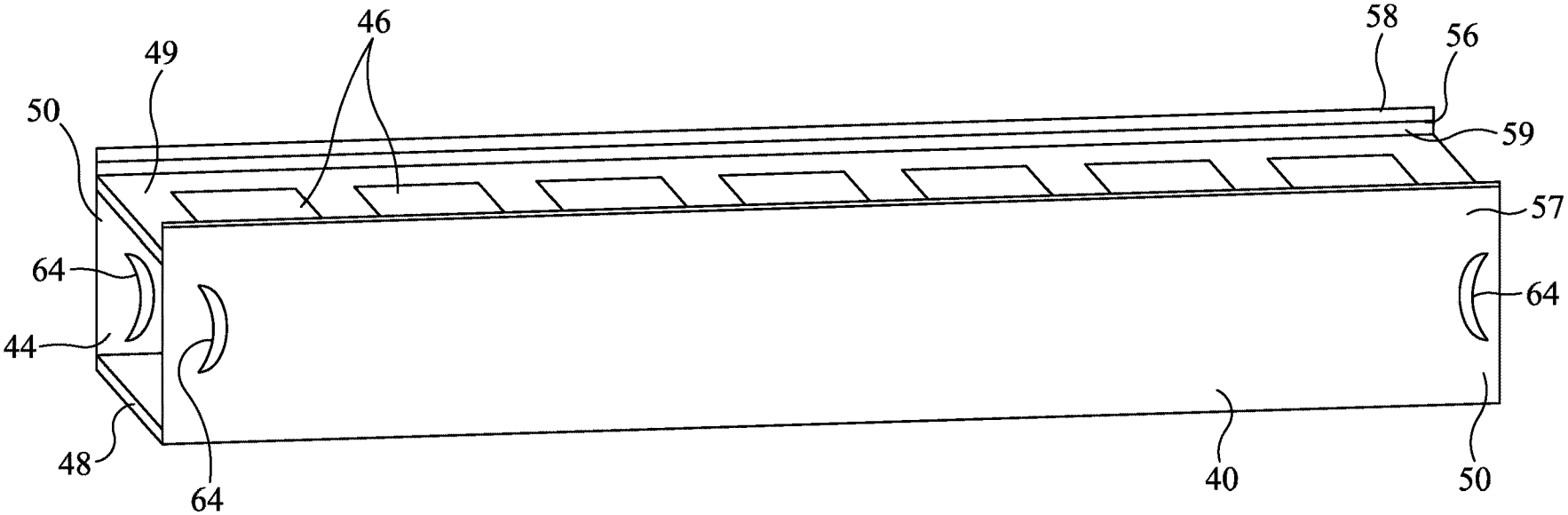
FIG. 5A is a side view in perspective of a railing housing according to various embodiments described herein.

With further reference to FIGS. 5A-7, in various embodiments, a railing 8 may comprise a railing housing 40 and a railing cover 42. The railing housing 40 and cover 42 may be coupleable or integrated. FIGS. 5A-5C illustrate a side view, end view, and top view, respectively, of a railing housing 40 according to various embodiments. The railing housing 40 may extend along a longitudinal length and include a channel 44 extending along all or one or more portions of the longitudinal length. The railing housing 40 may include fitment features comprising one or more holes 46 forming openings to the channel 44. The holes 46 may be positioned roughly where it is desired that pickets be installed. Holes 46 may be dimensioned to have any desired cross-section shape, e.g., polygonal or other regular or irregular geometric shapes, including circular, oval, arcuate, triangular, square, rectangular, cross-sections having greater than 4 sides, or free form. In the illustrated embodiment, the railing housing 40 includes seven rectangular holes 46. However, in some embodiments, the fence system may include a railing housing 40 having different configurations of holes 46 including fewer or additional holes 46. For example, in one embodiment, the railing housing 40 includes twelve holes 46 or 15 holes. The holes 46 may also be placed or separated at different intervals. In another embodiment, the railing housing 40 does not include holds 46 and defines an elongated slot for receiving pickets in the channel. The slot may be formed within the channel and include arms extending from the sidewalls or extension extending from the lower wall 48 adapted to limit lateral movement of the picket 10.

The railing housing 40 comprises a lower wall 48, an upper wall 49, and two sidewalls 50 extending between lower and upper walls 48, 49, which, together with the lower and upper walls 48, 49, define the channel 44. Additional channels 44 may be provided. The railing housing 40 includes fitment features for snap fitment with corresponding fitment features on a railing cover 42. The fitment features include a first sidewall 56 and a second sidewall 57, each extending from the upper wall 49 and defining a lip 58. In some embodiments, the railing housing 40 may be further configured to snap fit railing covers 42 on the opposing side of the channel 44, e.g., forming a lower wall, or along another channel adjacent to the lower wall 48. The railing housing 40 may include additional fitment features comprising resilient ears 64 formed along the sidewalls 50. The ears 64 may be cut at both ends of the railing housing 40. The ears 64 may be formed by roughly semi-circular cuts in two opposite sidewalls 50. However, other cut shapes may be used. For example, arcuate or straight edge cuts may be used. The cuts may be made close to the ends or as otherwise needed for coupling within a channel of a post housing. For example, ears 64 may be positioned at ends of the railing housing 40 and be resiliently structured to compress inwardly when inserted through a hole of a post cover or corresponding holes of an intermediate post cover and post cover and thereafter return to an outward position that provides the railing housing 40 with a cross-section along the tab 64 that is larger than the corresponding cross-section of the holes through which it has been extended when the tabs 64 are located within the channel of the post.

Figure 6A:
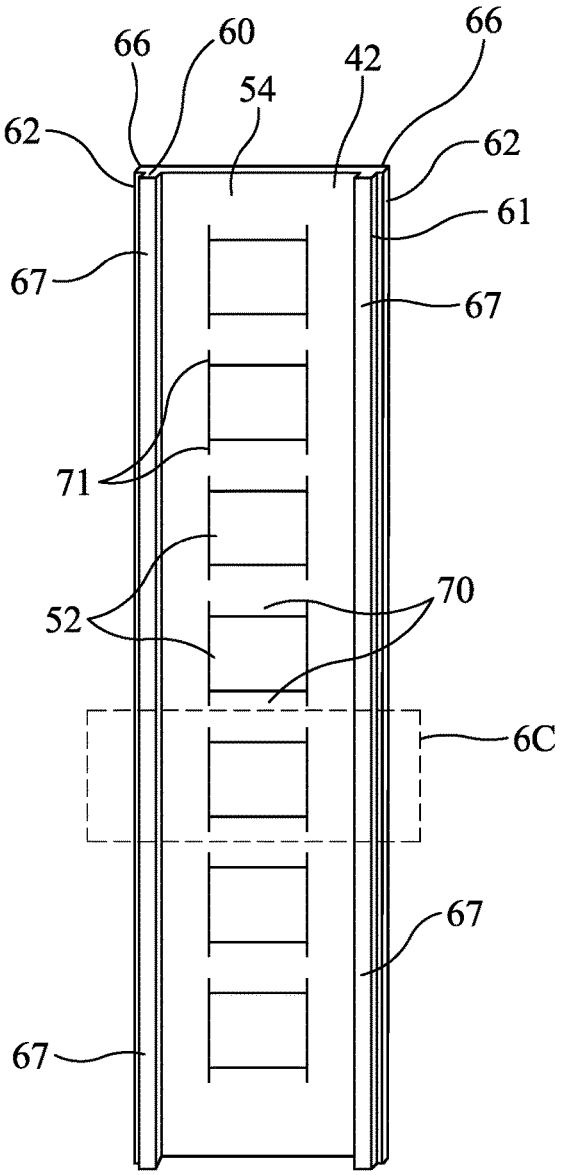
FIG. 6A is a bottom view in perspective of a railing cover according to various embodiments described herein.
Figure 6B:
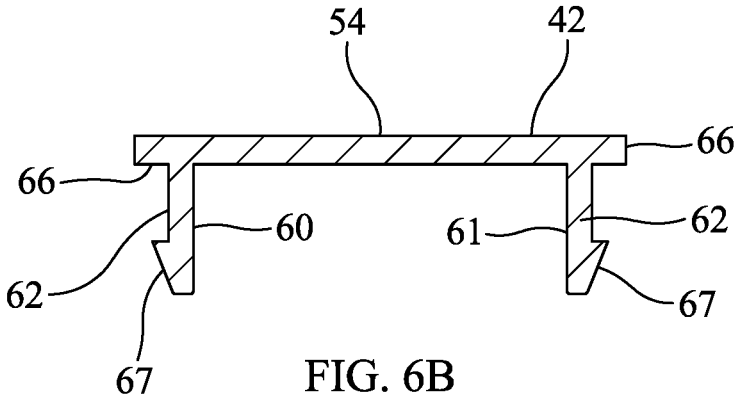
FIG. 6B is an end view of the railing cover shown in FIG. 6A according to various embodiments described herein.

FIGS. 6A & 6B illustrate a bottom view and end view, respectively, of a railing cover 42 according to various embodiments. The railing cover 42 may include fitment features comprising a plurality of holes 52 defined therein and through which a picket can be tightly fitted. Railing covers 42 may include holes 46 having any desired cross-section shape, e.g., polygonal or other regular or irregular geometric shapes, including circular, oval, arcuate, triangular, square, rectangular, cross-sections having greater than four sides, or free form, which may be configured to slot a correspondingly shaped cross-section shape of a picket. The railing cover 42 shown in FIGS. 6A & 6B includes seven rectangular holes 52. However, in some embodiments, the fence system 2 may include a railing cover 42 having different hole configurations including fewer or additional holes. For example, in one embodiment, the railing cover 42 includes twelve or fifteen holes 52. The holes 52 may also be placed or separated at different intervals.

The railing cover 42 is configured to stably couple over all or a portion of the longitudinal length of the railing housing 40 or channel 44. The coupling may be slidable to thereby allow relative longitudinal sliding between the railing cover 42 and railing housing 40. The railing cover 42 includes fitment features comprising a first extension 60 and a second extension 61, both extending from a railing cover plate 54 and defining a slot 62 that corresponds to a lip 58 when the railing housing 40 and railing cover 42 are coupled. Slot 62 may be defined between one or more lips 66, 67.

One or more of the holes 52 may be defined in the railing cover plate 54 such that the one or more of the holes 52 of the railing cover 42 at least partially are positioned over one or more of the holes 46 defined in the upper wall 49 of the channel 44. When coupled, e.g., snap fit, one or more of the holes 52 in the railing cover 42 may be at least partially positioned over the holes 46 of the railing housing 40 with respect to one or more dimensions. For example, one or more of the plurality of holes 52 may each be positioned to correspond to one or more of the plurality of holes 46 that extend through the upper wall 49 when the railing housing 40 and railing cover 42 are snap fit such that, when snap fit, the corresponding hole 52 through the railing cover plate 54 is at least partially positioned over the corresponding hole 46 through the upper wall 49.

Figure 5B:
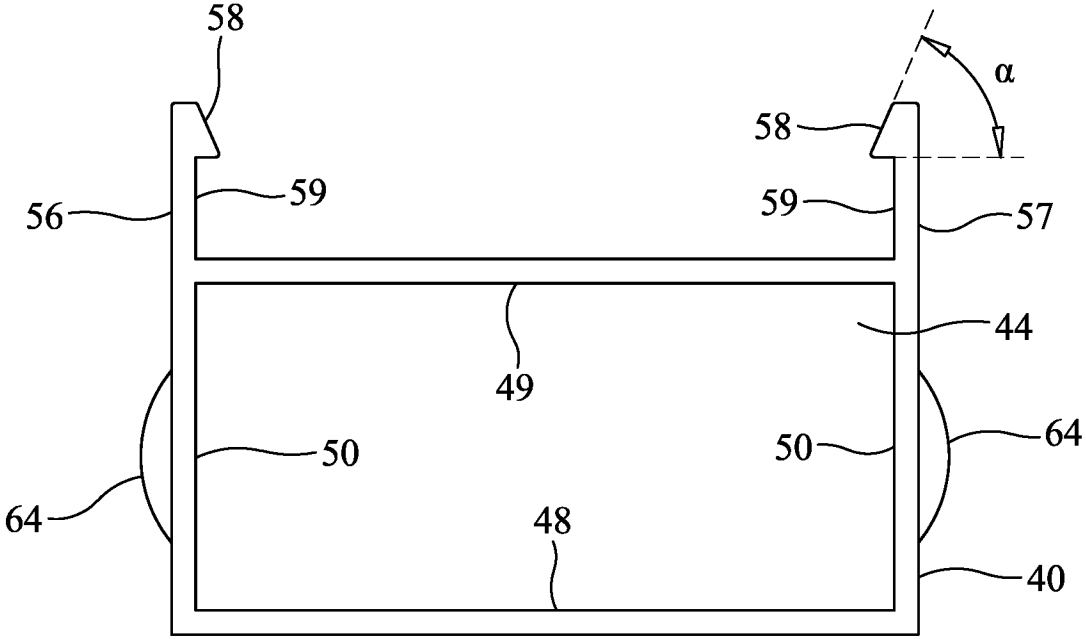
FIG. 5B is an end view of the railing housing shown in FIG. 5A according to various embodiments described herein.
Figure 5C:
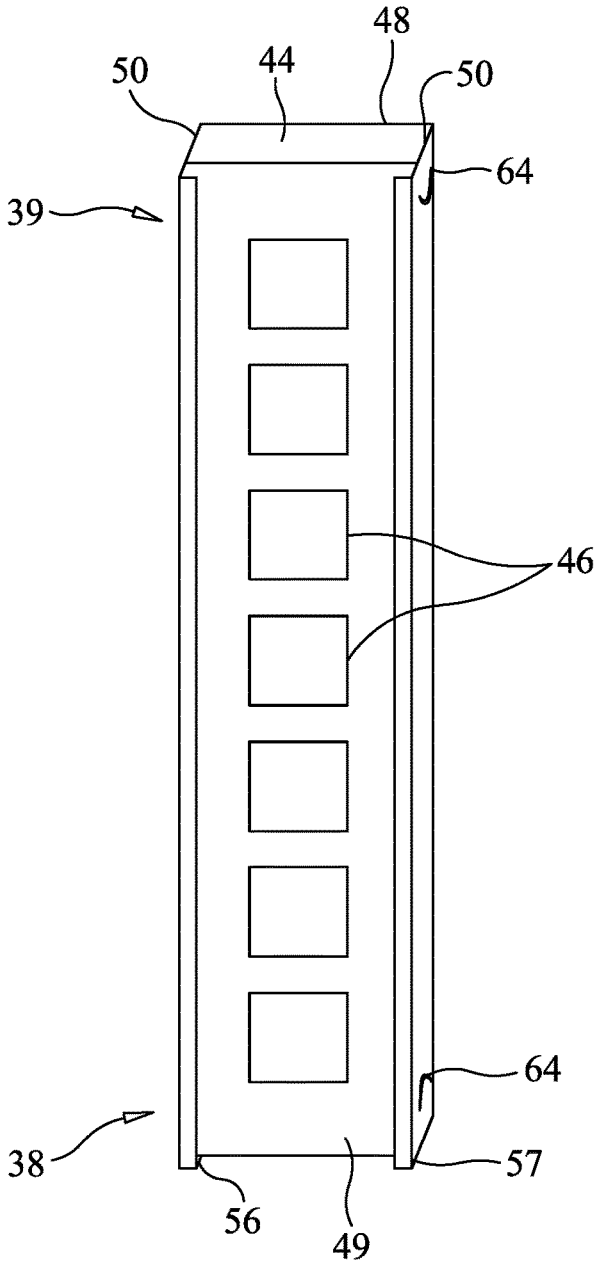
FIG. 5C is a top view in perspective of the railing housing shown in FIGS. 5A & 5B according to various embodiments described herein.
Figure 6C:
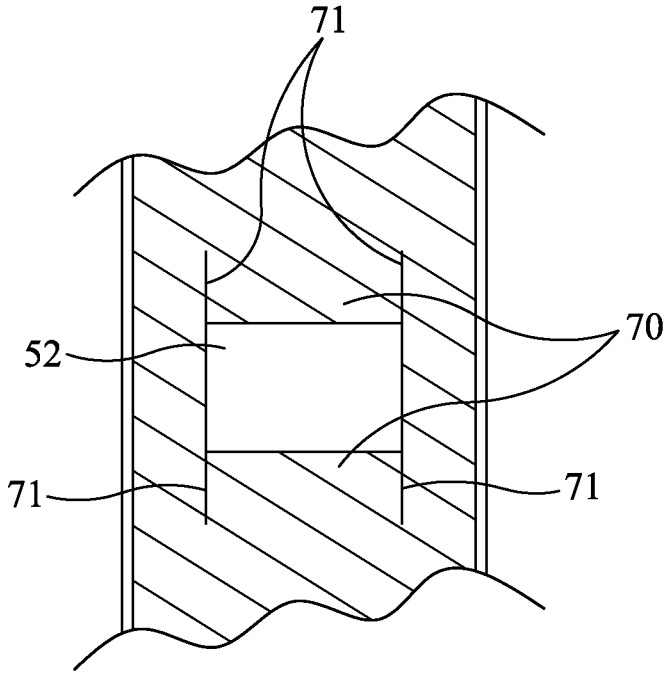
FIG. 6C is a magnified view of the portion of the railing cover indicated by box 6C in FIG. 6A according to various embodiments described herein.

The holes 52 in the railing cover plate 54 shown in FIGS. 6A-6C are configured to be at least partially positioned over the holes 46 in the upper wall 49 of the railing housing 40 shown in FIGS. 5A-5C, to receive a picket therethrough. In particular, the holes 52 in the railing cover plate 54 are configured to be positioned over the elongated rectangular holes 46 in the railing housing 40. As described in more detail below, the holes 46 of the railing housing 40 may be larger than the holes 52 in the railing cover plate 54. In one embodiment, the upper wall 49 includes fewer holes 46 than the cover plate 54 or no holes 46. For example, the upper wall 49 may comprise extensions or arms that extend laterally into the channel from each of the sidewalls and include a gap for receiving the picket wherein the gap is dimensioned to limit lateral movement of the picket. As such, in some embodiments, the upper wall 49 may include two laterally extending walls that may or may not meet within the channel. In one embodiment, one or more extensions or arms may extend from the lower wall 48 and may be adapted to define a lateral range of movement of the picket set by a lateral distance between the extension and arm and one or more additional extensions or arms or other physical obstruction to a lateral movement.

The holes 52 in the railing cover plate 54 may include fitment features comprising tabs 70 structured for tightly fitting a picket. As shown in the magnified view of FIG. 6C, taken within box 6C in FIG. 6A, the tabs 70 may be formed by introducing cuts 71 through the cover plate 54 that extend longitudinally beyond each lateral side of the holes 52. In this embodiment, the longitudinal or length dimensions of each hole 52 is defined between two tabs 70 located at each longitudinal end of the hole 52. In other embodiments, tabs 70 may be located at lateral ends as well as or instead of longitudinal ends. Additional or fewer tabs 70 may also be used. The pattern of the cuts 71 may be referred to as H-cut and may be structured to allow a picket that is tightly fit perpendicular with the railing to be pivoted to non-perpendicular orientations with respect to the railing to provide an option of rackability, which may be in addition to or instead of sliding of railing cover 42 over railing housing 40 when snap fit, as described in more detail below. For example, when pivoted, pickets may compress against tabs 70 causing the tabs 70 to resiliently bend to allow the pivoting while still maintaining a tight fit. If holes 52, 46 are offset to allow pickets to be received at non-perpendicular angles, the tabs 70 may allow pickets to be pivoted to other non-perpendicular angles or perpendicular with respect to the railing.

Figure 7:
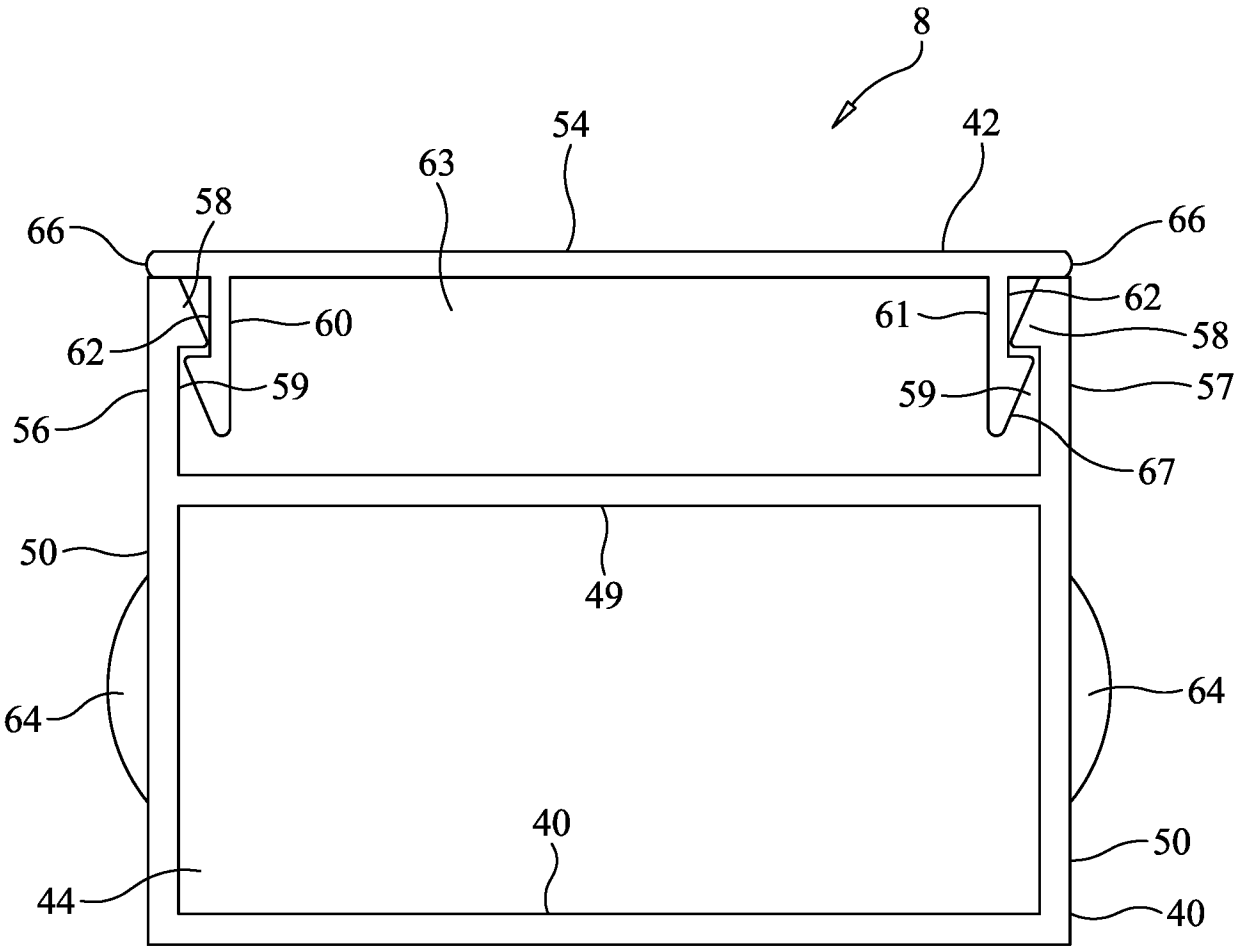
FIG. 7 is an end view of the railing housing shown in FIGS. 5A-5C coupled to the railing cover shown in FIGS. 6A & 6B according to various embodiments described herein.

FIG. 7 is an end view of a railing 8 comprising the railing housing 40 shown in FIGS. 5A-5C couple with the railing cover 42 shown in FIGS. 6A-6C. In the illustrated embodiment, a channel 63 is formed between the upper wall 49 and the cover plate 48 when the railing cover 42 is coupled to the railing housing 40. Also in the illustrated embodiment, the lips 58 on the first and second sidewalls 56, 57 snap fit into corresponding slots 62. Once snap fit, the railing cover 42 is stably coupled to the rail housing 40 over the upper wall 49 and usually may not be removed outwardly without application of excessive or damaging force. However, the rail cover 42 may be slidable along the railing housing 40 when coupled. Thus, stable coupling may include slidable coupling. A distance between the lips 58 and a distance between the slots 62 may be similar to provide a tight snap fit. For example, the distance between the lips 58 may be the same, slightly less, or slightly greater than the distance between the slots 62. One of the sidewalls 56, 57, one of the first extension 60 or second extension 61, or combinations thereof, may be resiliently bendable to allow the lips 58 on the first and second sidewalls 56, 57 to snap fit into the corresponding slots 62.

As shown, the lips 58 of the railing housing 40 are positioned within the slots 62 defined along the sidewalls 56, 57 between the first and second lips 66, 67 of the railing cover 42. To couple the railing housing 40 and railing cover 42, the railing cover 42 may be positioned over the upper wall 49 such that the angled surfaces of the lips 58 of the railing housing 40 engage with the angled surfaces of the second lips 67 positioned along the sidewalls 60, 61 of the railing cover 42. The angled surfaces may be complementary, e.g., parallel or approximately parallel (+/−30°). Force may thereafter be applied to bring the components together such that the angled lip surfaces slide past each other. The force may cause compression or bending of the sidewalls 56, 57, sidewalls 61, 62, lips 67, lips 58, or combination thereof until the respective lips 58, 67 are snapped into position within the slots 59, 62. Lips 59 are positioned interiorly and the angled surfaces of the lips 59 are directed outwardly such that the lips 59 decrease in width outwardly of the upper wall 49. The angled surface of lips 67 are positioned exteriorly and the angled surface of the lips 67 are directed inwardly such that the lips 67 decrease in width outwardly of the cover plate 54. In some embodiments one or more of the lips 59 or lips 67 do not include an angled surface resulting in a tapered width of the lip 59, 67.

As introduced above, the resiliency of one or more fitment features allows the features to spring back to an approximate pre-compressed or pre-bent form when the lips 58, 67 are positioned in the slots 59, 62. In some instances, the resiliency will result in compression of the fitment features against opposing fitment features of the other. In some embodiments, only the sidewalls 56, 57 or lips 67 of the railing cover 42 are resiliently compressible or bendable for fitment and the lips 58 and sidewalls 56, 57 of the railing housing 40 are rigidly positioned to inwardly bend or compress the sidewalls 60, 61 or lips 67 of the railing cover 42 when force to snap the railing cover 42 over the upper wall 49. In another embodiment, only the lips 58 or sidewalls 56, 57 of the railing housing 40 are resiliently compressible or bendable for fitment and the sidewalls 60, 61 or lips 67 of the railing cover 42 are rigidly positioned to outwardly bend or compress the lips 26 or sidewalls 56, 57 of the railing housing 40 when force is applied to snap the railing cover 42 over the upper wall 49. Once snap fit, the railing cover 42 is stably coupled to the railing housing 40 and usually may not be removed outwardly without application of excessive or damaging force.

In some embodiments, the railing housing 40 defines a slot 59 along an interior side of each sidewall 60, 61 and the railing cover 42 may include an exteriorly positioned lip 67 configured to snap fit into the slot 59. In one embodiment, the railing housing 40 defines a slot (not shown) along an exterior side of each sidewall 56, 57 and the railing cover 42 includes an interiorly positioned lip (not shown) configured to snap fit in the slot. In another embodiment, the sidewalls 56, 57 include interiorly positioned lips 58 and the railing cover 42 includes exterior side slots 62 configured to snap fit with lips 58. In one configuration, the railing cover 42 includes exterior side lips (not shown) and the railing cover 42 includes interior side slots (not shown) configured to snap fit with the exterior side lips. Accordingly, the railing housing 40 and railing cover 42 may include one or more slots, lips, or combinations thereof configured to snap fit, which may be interiorly or exteriorly positioned. It will be appreciated that a lip or slot need not be positioned on a sidewall 61 of the railing cover 42 or sidewall 56, 57 positioned above upper wall 49. For example, a lip or slot may be positioned along a side or edge of the cover plate 54 (e.g., lip 66) or along a sidewall below upper wall 49. Additionally, in some embodiments, coupling may be by sliding lips in slots, for example.

FIG. 11 is an end view of a railing 8 stably coupled to a post 6 wherein an end 38 of the railing 8 extends through corresponding holes 30, 76 of the post cover 14 and intermediate post cover 75 (see, e.g., FIG. 10) and is snap fit within the channel 16. In various embodiments, snap fitting the railing 8 and post 6 includes snap fitting ears 64 within the channel 16. For example, the ends 38, 39 of the railing 8, or railing housing 40, may include resilient ears 64, e.g., tabs, positioned along an outer perimeter of the ends 38, 39 of the railing 8. A cross-sectional dimension of the railing 8 at the end 38, 29, such as a length or width, taken from an outer perimeter formed by the ear 64 may be greater than a corresponding dimension, such as a length or width, of the corresponding holes 30, 76 through which the end 38, 39 of the railing 8 extends to stably couple the railing 8 and the post 6. The ears 64 may be configured to resiliently bend or compress inward when extended through the corresponding dimensions of the holes 30, 76, decreasing the cross-sectional dimension of the railing 8 at the end 38, 39, and spring open or outward when positioned within the channel 16 to thereby increase the cross-sectional dimension of the end 38, 39 of the railing 8 to a greater cross-sectional dimension than the corresponding dimension of the holes 30, 76, thereby preventing the railing 8 from being removed from the channel 16. The ears 64 may be movable to decrease the cross-sectional dimension for insertion. For example, the ears 64 may be structured such that insertion of the end 38, 39 moves or compresses ears 64 inward to reduce the cross-sectional dimension when passed against the edges of holes 30, 76. The ears 64 may further be structured to return outward to a larger cross-sectional dimension once inserted through the holes 30, 70 and not be movable to decrease the cross-sectional dimension as a result of a pulling force directed out of the holes 30, 76. Thus, the ears 64 may be structured to move to reduce the cross-sectional dimension for insertion and to thereafter move to increase the cross-sectional dimension to snap fit once inserted. For example, the ears 64 may present an outwardly extending surface structured to engage the intermediate cover plate 77 and there against prevent passage out of the hole 76 but that moves to reduce the cross-sectional dimension for insertion. In the illustrated embodiment, the longitudinal or length dimension of hole 76 is greater than the corresponding cross-sectional dimension of the railing 8. The larger hole 76 dimension may allow a user to orient the railing 8 at non-perpendicular orientations as well as perpendicular orientations with respect to the post 6, thereby providing rackability. For example, the railing 8 may be pivoted within channel 16 of the post 6.

Pivoting may bend tabs 31 at longitudinal ends of the holes 30 of the post cover 14 allowing the railing 8 to move within the increased longitudinal dimension of hole 76. In some embodiments, one longitudinal end of the hole 30 is defined by a tab 31. Additionally or alternatively, pivoting may slide the post cover 14 relative to the intermediate post cover 75, the post cover 14 and the intermediate post cover 75 relative to the post housing, or both. In one embodiment, the post cover 14 does not include a tab 31 and may slidably couple to the post housing 12 such that pivoting the railing 8 slides the cover 14 relative to the housing 12. In some such embodiments, holes 30 may be configured with sufficient dimensions accommodate the increased cross-section of the railing 6. As noted above, upper wall arms or lower wall extensions may be used. The pivoting may be similar to that depicted in FIGS. 39A-39C, which illustrates an embodiment including a slidably coupled post cover 14 and a tab 31*a*, 31*b* at both longitudinal ends of the hole 30 that may bend when the railing 8 is pivoted. When the railing 8 is pivoted a tab 31*a*, 31*b* adjacent to the railing 8 along the side of the decreasing or acute angle, e.g., angle B and tab 31*b* in FIG. 39B or angle A and tab 31*a* in FIG. 39C, between the railing 8 and the post 6 may bend toward the base wall 18. Pivoting the railing 8 may slide the cover 14 toward the post end 13*a*, 13*b* corresponding to the increasing or obtuse angle. The other tab 31 adjacent to the railing 8 along the side of the increasing or obtuse angle, e.g., angle A and tab 31*a* in FIG. 39B or angle B and tab 31*b* in FIG. 39C, may or may not bend outward, away from the base wall 18. For example, in embodiments with a sliding cover 14, the tab 31 adjacent to the railing 8 along the increasing or obtuse angle between the railing 8 and the post 6 may be sufficiently rigid such that it does not noticeably bend and the post cover 14 slides relative to the housing 12. Thus, in some embodiments, only one longitudinal end of a hole 30 may be defined by a tab 31 to accommodate pivoting that decreases the angle between the railing 8 and the post 6 along the longitudinal side of the post 12 at which the tab 31 is positioned.

With specific reference again to FIG. 11, the ears 64 extend from sidewalls 50 and position outwardly therefrom, increasing a lateral cross-section of the railing 8 therebetween that is larger than the corresponding lateral cross-section of the holes 30, 76 through the respective post cover plate 28 and intermediate post cover plate 77 through which it extends, thereby locking the railing within the channel 16. In some embodiments, ears 64 may be provided on multiple, including all sides. As shown, ears 64 are provided on two opposing sides of the railing housing 40, at each end 38, 39 of the railing 8, and insert through the holes 30, 76 along different sides than the tabs 31. Other configurations of ears 64 may be used that decrease the cross-sectional dimension of the railing 8 during insertion and thereafter increase the cross-sectional dimension greater than that of the holes 30, 76.

Figure 20:
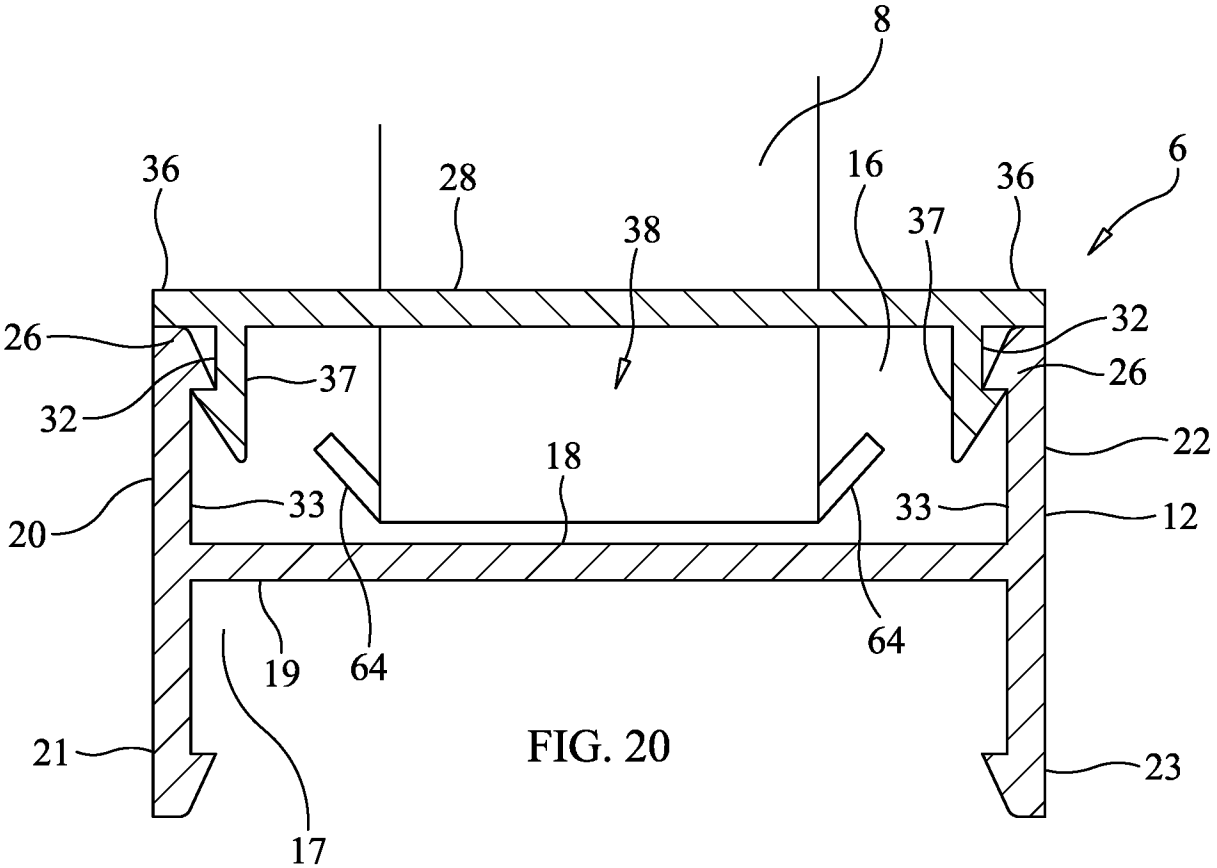
FIG. 20 is an end view of a railing stably coupled to the post of FIG. 19 wherein the end of the railing extends through the hole in the railing and is coupled within the channel of the post according to various embodiments described herein.

FIG. 20 is an end view of a railing 8 stably coupled to a post 6 shown in FIG. 19 wherein an end 38 of the railing 8 extends through the hole 30 (see FIGS. 3A & 3B) in the post cover 14 and is coupled within the channel 16. In various embodiments, coupling the railing 8 and post 6 includes snap fitting ears 64 within the channel 16. For example, as noted above, the ends 38, 39 of the railing 8, or railing housing 40, may include resilient ears 64, e.g., tabs, positioned along an outer perimeter of the ends 38, 39 of the railing 8. A cross-sectional dimension of the railing 8 at the end 38, 39 taken from the outer perimeter formed by the ear 64 may be greater than a corresponding cross-sectional dimension of the opening 30 through the post cover plate 28 through which the end 38, 39 of the railing 8 extends to stably couple the railing 8 and the post 6. The ears 64 may be configured to resiliently bend or compress inward when extended through the corresponding cross-sectional dimension of the hole 30, decreasing the cross-sectional dimension of the railing 8 at the end 38, 39, and spring open or outward when positioned within the channel 16 to thereby increase the cross-sectional dimension of the end 38, 39 of the railing 8 to a greater cross-sectional dimension than the corresponding cross-sectional dimension of the hole 30.

In various embodiments, ears 64 may be cut at both ends 38, 39 of the railing 8, e.g., both ends of the railing housing 40. As shown in FIGS. 5A-5C, the ears 64 may be formed by roughly semi-circular cuts in two opposite walls, e.g., sidewalls 50, of the railing 8. The cuts may be made close to the ends 38, 39 of the railing 8 or as otherwise needed for snap fitment within the channel 16. The cut may form a tab that may then be bent outwardly to form an ear 64 opening toward the opposing end 38, 39 of the railing housing 40. In the illustrated embodiment, ears 64 extend outwardly of the channel from each of the two sidewalls 50 and may be resiliently bent or compressed inward when extended through one of the plurality of holes 30 defined through the post cover plate 28. When in the channel 16, the ears 64 spring open or outward to stably couple the post 6 and railing 8 by increasing a cross-section dimension of the end 38, 39 of the railing 8 greater than a corresponding cross-sectional dimension of the hole 30 through the post cover plate 28 through which it is extended. In various embodiments, when stably coupled, the railing may be pivoted as described herein. Other configurations of ears 64 may be used such that the ears 64 may move to decrease the cross-sectional dimension during insertion and thereafter move to increase the cross-sectional dimension greater than that of the hole 30. Ears 64 may be provided on multiple, including all, sides. In the illustrated embodiment, ears 64 are provided on two opposing sides of each end 38, 39 of the railing housing 40.

The railing housing 40 and railing cover 42 may define the same or different numbers of holes 46, 52. In some embodiments, the railing housing 40 includes a hole 46 having a larger dimension, such as a length or width, and an approximately same or smaller dimension than corresponding dimensions of a corresponding hole 52 of the railing cover 42, that is a hole 52 that is at least partially positioned over or at least partially positioned over and at least partially aligned with the hole 46. Such a configuration may result in railing housings 40 that may be adaptable for multiple arrangements of pickets by selecting a railing 8 specifically dimensioned for such a design. For example, a railing cover 42 having holes 52 dimensioned to provide a desired fence design, e.g., picket orientation, angle, number, spacing, pattern, cross-sectional dimension, etc., may be selected from a plurality of rail covers 42, each suitable for coupling with the rail housing 40, and thereafter cooperatively stably coupling a picket that extends through the holes 46, 52. Each of the plurality of railing covers 42 may have a different hole design, e.g., hole orientation, angle, number, spacing, pattern, cross-sectional dimension, etc.

In some embodiments, a hole 46 through the upper wall 49 of the railing housing 40 includes a larger cross-sectional dimension than a corresponding hole 52 through the railing cover plate 54. For example, the holes 46 defined through the upper wall 49 of the railing housing 40 shown in FIGS. 5A-5C include an elongated longitudinal or length dimension along its length relative to the corresponding longitudinal or length dimension of the holes 52 defined through the railing cover plate 54 shown in FIGS. 6A-6C. In these or other embodiments, a hole 46 through the upper wall 49 of the railing housing 40 may include a length or width dimension that is approximately equivalent to that of a dimension of the corresponding hole 52 through the railing cover plate 54. For example, the holes 46 defined through the upper wall 49 of the railing housing 40 shown in FIGS. 5A-5C include width dimensions that are approximately equivalent to the corresponding width dimensions of the holes 52 defined through the railing cover plate 54 shown in FIGS. 6A-6C. In these or other embodiments, corresponding holes 46, 52 through the upper wall 49 of the railing housing 40 and railing cover plate 54 may be aligned along the approximately equivalent dimension. For example, the corresponding holes 46, 52 defined through the upper wall 49 of the railing housing 40 shown in FIGS. 5A-5C and the railing cover plate 54 shown in FIGS. 6A-6C laterally align along the approximately equivalent width dimensions.

In one embodiment, the railing housing 40 and railing cover plate 54 are configured such that a hole 52 through the railing cover plate 54 is positioned above a corresponding hole 46 through the upper wall 49 of the railing housing 40 having a larger dimension. The larger dimension may be with respect to a longitudinal or length dimension such that the hole 46 is elongated along its length relative to the corresponding hole 52, e.g., as shown in the example embodiments of FIGS. 5A-6C.

In some embodiments, the railing housing 40 is configured to couple with a plurality interchangeable or selectable railing covers 42. For example, at least one of the plurality of railing covers 42 may define a hole configuration that is different than a hole configuration defined through another railing cover 42. In this way, the railing 8 may be customized by selecting a railing cover 42 for fitment with the railing housing 40 that provides a desired railing number, size, orientation, or other hole design. In some embodiments, for example, the railing cover 42 may define fewer holes 52 than the railing housing 40.

As introduced above with respect to FIGS. 1A & 1B, the fence system 2 and components for use with the fence system 2 may also include one or more pickets 10.

Figure 8:
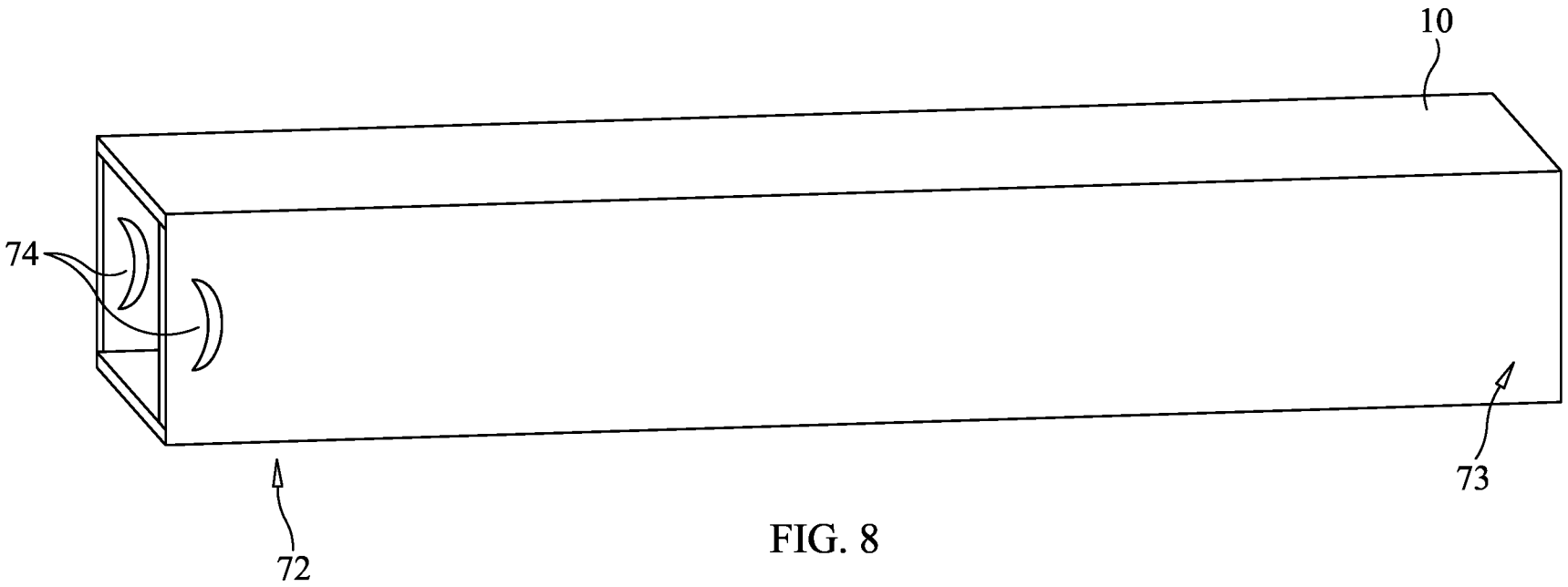
FIG. 8 is a side view in perspective of a picket according to various embodiments described herein.

FIG. 8 is a side view of a picket 10 according to various embodiments described herein. The picket 10 extends along a longitudinal length between a first end 72 and a second end 73 and is configured to stably couple between at least two railings. The picket 10 is configured to snap fit with at least one railing 8 at its first end 72. As shown, the first end 72 of the picket 10 is dimensioned to extend into the channel 44 defined in the railing housing 40 through the corresponding holes 46, 52 of the railing housing 40 and railing cover 42 and snap fit therein to stably couple with the railing 8.

The picket 10 includes fitment features comprising ears 74, which may be similar to the ears 64 described above with respect to FIGS. 5A-5C and FIG. 11. In some embodiments, ears 74 may be provided at one end 72 or both ends 72, 73. The ears 74 shown are positioned along an outer perimeter of the first end 72 of the picket 10.

Figure 9:
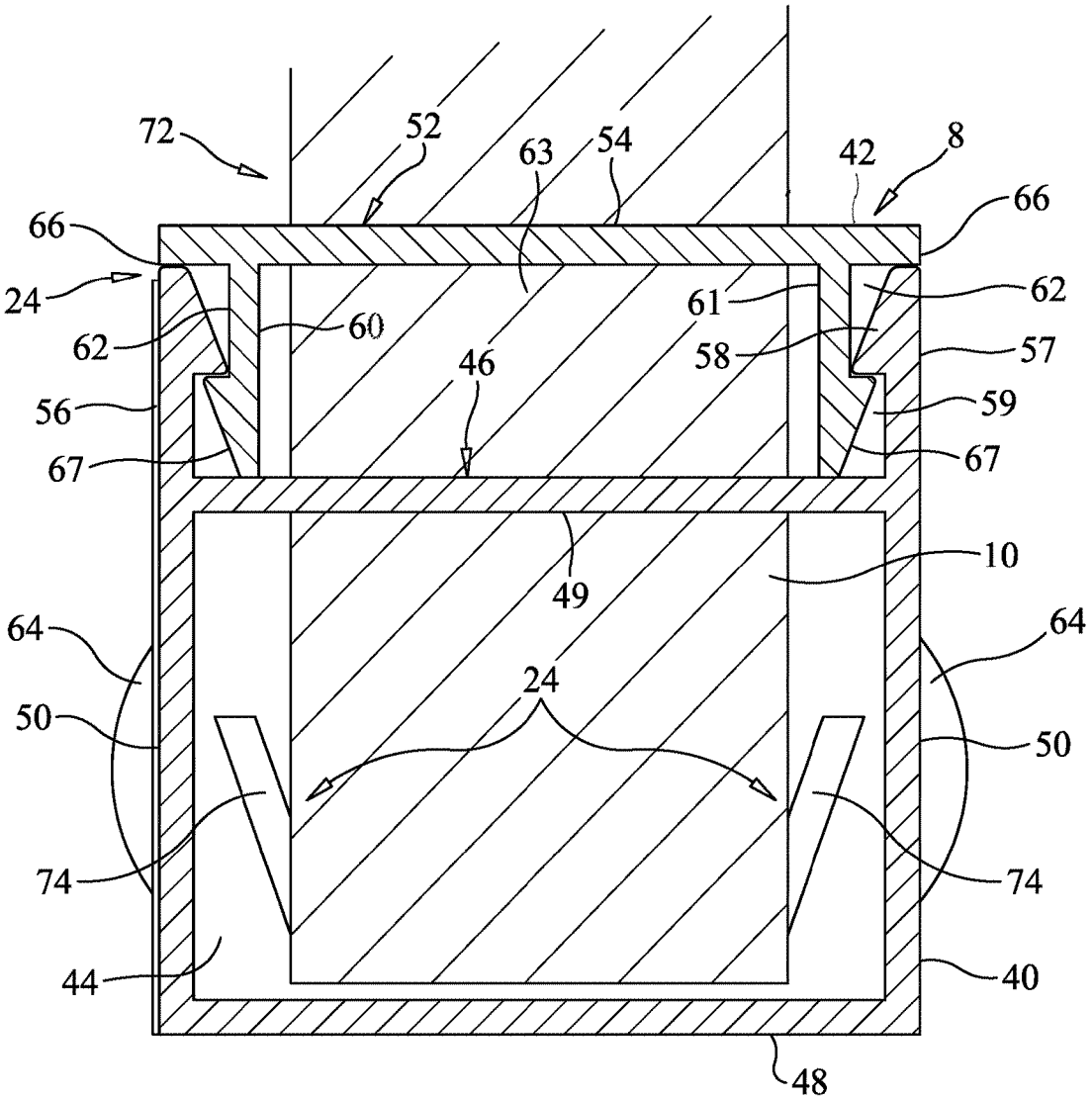
FIG. 9 is an end view of a railing wherein the end of the picket extends through the corresponding holes in the railing cover and into a channel of the railing for coupling with the railing cover according to various embodiments described herein.

FIG. 9 shows an end view of the picket 10 stably coupled to a railing 8 wherein the end 72 of the picket 10 extends through the corresponding holes 46, 52 of the railing 8 and is coupled within the channel 44 according to one embodiment. The cross-sectional dimension of the picket 10 at the first end 72 taken from the outer perimeter comprising the ear 74 is greater than a corresponding dimension of the hole 46 through the upper wall 49 of the railing housing 40 through which the first end 72 extends to stably couple the picket 10 and railing 8. When extended through the corresponding holes 46, 52, the ear 74 resiliently bends or compresses inward when extended through the corresponding dimension of hole 46 through the upper wall 49, decreasing the cross-sectional dimension of the picket 10 at the first end 72, and springs open or outward when positioned within the channel 44, thereby increasing the cross-sectional dimension of the picket 10 at the first end 72 greater than the corresponding dimension of the hole 46 through the upper wall 49.

The first end 72 of the picket 10 shown in FIG. 8 defines a rectangular cross-section. The corresponding holes 46, 52 through the railing housing 40 and railing cover plate 54 in the snap fit rail 8 may each comprise a dimension less than a cross-sectional dimension between the short sides of the rectangular cross-section at the first end 72 of the picket 10 to prevent the first end 72 of the picket 10 from being extended through the corresponding holes 46, 52 in an orientation that aligns the cross-sectional dimension between the short sides of the picket 10 and the lesser dimensions of the corresponding holes 46, 52. In the illustrated embodiment, the ears 74 are positioned along the long sides of the picket 10. Also in the illustrated embodiment, the dimensions of the holes 52 are substantially the same as the corresponding cross-sectional dimensions of the picket 10 taken adjacent to the ears 74. In various embodiments, when the railing housing 40 and railing cover 42 are snap fit, such as when the railing housing 40 and railing cover 42 shown in FIGS. 5A-6C are snap fit, the corresponding holes 46, 52 are aligned laterally along approximately equivalent width dimensions. The corresponding holes 46, 52 may be aligned longitudinally such that tabs 70 positioned at longitudinal ends of each hole 52 of the railing cover plate 54 and which define a length dimension of each hole 52 therebetween are positioned over the corresponding hole 46 through the upper wall 49 of the railing housing 40. The first end 72 of the picket 10 may have a cross-sectional width dimension taken between a first resilient ear 74 positioned on a first side of the picket 10 and a second resilient ear 74 positioned on a second side of the picket 10 that is greater than the approximately equivalent width dimensions of the corresponding holes 46, 52. The ears 74 may be configured to compress or bend inward when extended through the width dimensions of the corresponding holes 46, 52 to decrease the cross-sectional width dimension therebetween less than the approximately equivalent width dimensions of the corresponding holes 46, 52 and then spring outward or open when within the channel 44 to increase the cross-sectional width dimension therebetween greater than the approximately equivalent width dimensions of the corresponding holes 46, 52 to therein couple within the channel 44 and stably couple the railing 8 and picket 10.

The railing 8 and picket 10 may also be configured to be rackable. For example, corresponding channels 46, 52 may be aligned at offset angles. In some embodiments, the railing cover 46 may be slidable when coupled along the railing housing 40 to longitudinally offset corresponding holes 46, 52. A picket 10 may be pivoted within the railing 8 channel 44 by sliding the railing cover 46 to longitudinally offset the corresponding holes 46, 52 or may be inserted through longitudinally offset corresponding holes 46, 52. Thus, railings 8 and pickets 10 may be configured such that the picket 10 may be stably coupled to the railing 8 at non-perpendicular orientations, e.g., 10°, 20°, 30°, 40° degrees or more, as well as perpendicular orientations. For example, by sliding the railing cover 46 along the railing housing 40 when the two are coupled, the corresponding holes 46, 52 may be longitudinally offset, thereby allowing pickets 10 to remain plumb while stably coupled to railings 8 at non-perpendicular angles. In these or another configuration, railing cover plates 54 may be provided with the holes 52 slightly offset to holes 46 to allow the picket 10 to be installed at the desired angle. Thus, longitudinally offset holes 46, 52 or longitudinally offsetting holes 46, 52, e.g., by sliding the railing cover 42 relative to the railing housing 40, may provide rackability. Rackability features may also include tabs 70 that maintain a tight fit with a picket 10 when pivoted. For example, when the railing housing 40 and railing cover 42 are coupled (see, e.g., FIG. 7), tabs 70 may be positioned over a larger dimension of the corresponding holes 46 or slot (not shown) through the upper wall 49 of the railing housing 40. As introduced above, the tabs 70 may be bendable such that pivoting a picket 10 extended through the smaller, e.g., tighter, dimension of the hole 52 pivots the picket within the available space provided by the larger dimension of the hole 46 or slot. For example, if a fence panel is to be installed on a slope, elongated holes 46 in the railing housing 40 may allow for pivoting of the picket 10 to an appropriate angle within upper and lower railings 8*a*, 8*b* (see, e.g., FIG. 1B). When pivoted, the tabs 70 bend to accommodate the larger angled cross-section of the picket while maintaining a tight fit with the walls of the picket 10. In some embodiments, a picket 10 may be pivoted during setup to slide the railing cover 42 and offset the corresponding holes 46, 52 to stably couple the picket 10 and railing 8 in a non-perpendicular orientation. For example, in various embodiments, the railing cover plate 54 may be slidable when coupled to the railing housing 40 such that the corresponding holes 46, 52 may be longitudinally offset. For example, longitudinally offsetting the corresponding holes 46, 52 relative to the position of the holes 46, 52 for stably coupling a picket 10 at a perpendicular orientation, e.g., by sliding the railing cover 42 relative to the perpendicular orientation alignment, allows insertion or pivoting of the picket 10 to non-perpendicular orientations with respect to the railing 8. Pivoting the picket 10 resulting in sliding of railing cover 42 and/or bending of tabs 70 may be similar to the sliding of post cover 14 relative to post housing 12 and the bending of tabs 31*a*, 31*b* when a railing 8 is pivoted, e.g., as described above with respect FIGS. 39A-39C. For example, in various embodiments, the railing cover 42 may be slidable relative to the railing housing 40, a tab 70 may be positioned at one or more longitudinal ends of the hole 52, or combination thereof. In one embodiment, for example, the railing cover 42 does not include a tab 70 and may be slidable with respect to the railing housing 40 such that pivoting the picket 10 slides the cover 42 relative to the housing 40 and holes 52 having sufficient dimensions accommodate the increased cross-section of the picket 10. In another embodiment, only one end of the hole 52 includes a tab 70 adapted to bend and accommodate the increased cross-section of the picket 10 when pivoted to decrease the angle between the picket 10 and railing 8 along the longitudinal side of the railing 8 at which the tab 70 is positioned. Tabs 70 at longitudinal ends of the hole 52 may be provided to accommodate pivoting in multiple directions, for example. Thus, slidable covers and tabs 70 may be used alone or in combination to provide rackability. When the picket is pivoted a tab 70 adjacent to the picket 10 along the side of the decreasing or acute angle relative to the end of the railing 38, 39 may bend toward the upper wall 49. The other tab 70 adjacent to the picket 10 along the side of the increasing or obtuse angle may or may not bend outward, away from the upper wall 49. Pivoting the picket 10 may slide the cover 42 toward the railing end 38, 39 corresponding to the increasing or obtuse angle.

As introduced above, railings 8 may include different numbers and placements for pickets 10. In one embodiment, the railing cover plate 54 defines holes 52 that are longitudinally offset with respect to the corresponding holes 46 through the railing housing 40 such that when the railing housing 40 and railing cover 42 are coupled, the corresponding holes 46, 52 are aligned laterally along approximately equivalent width dimensions and are offset longitudinally to allow the picket to be installed at a non-perpendicular angle. In various embodiments, railing covers 42 and railing cover plates 54 may be used to provide an esthetic effect so that holes 46, e.g., elongated holes 46, in the railing housings 40 are not seen in use. As noted above, elongated holes or specifically oriented and aligned holes 46, 52 may be provided such that the railing 8 allows the use of the fence system for fences on slopes as the holes 52 of the railing cover plate 54 may be offset slightly from the underlying holes 46 of the railing housing 40. In the illustrated embodiment, the holes 52 of the railing cover 42 (FIGS. 6A-6C) include substantially similar lateral dimensions as the lateral cross-sectional dimensions of the picket 10 (FIG. 8), excluding the ears 74.

Figure 15:
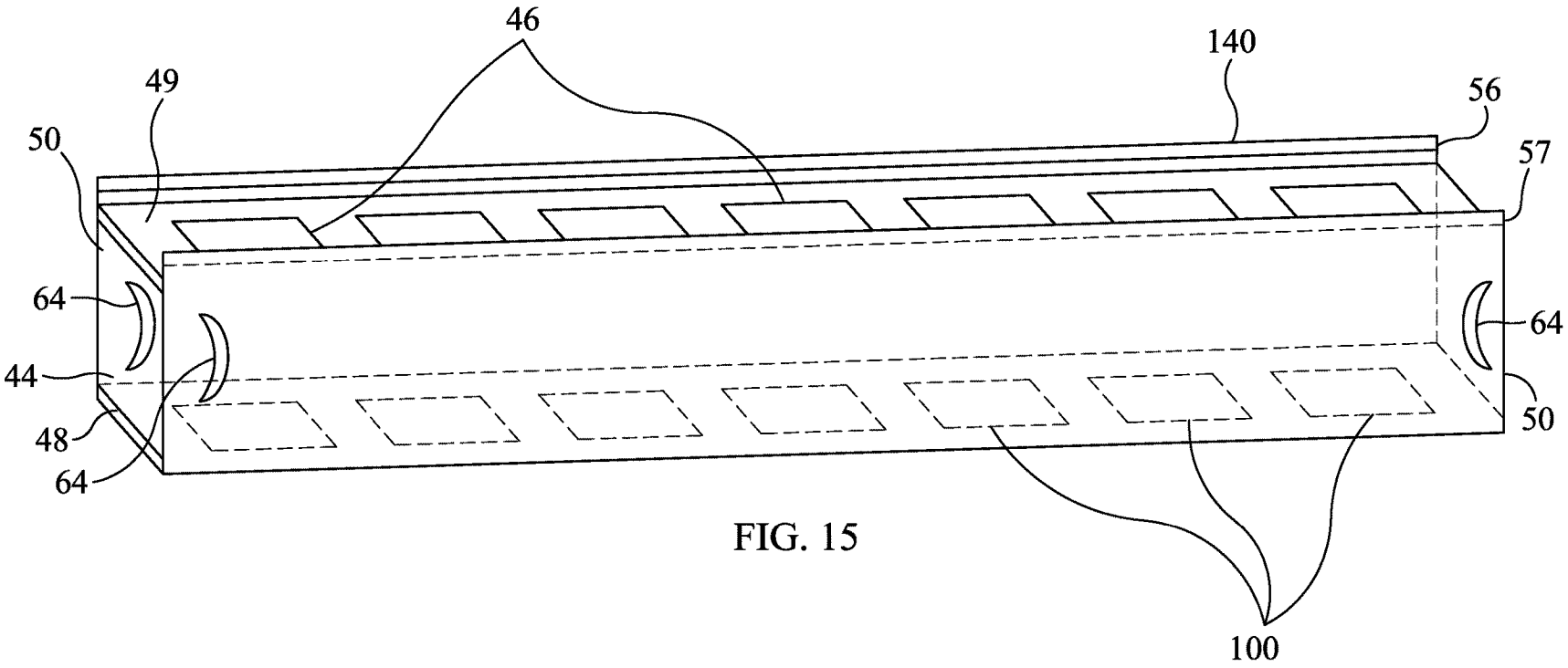
FIG. 15 is a side view in perspective of a railing housing according to various embodiments described herein.

FIG. 15 illustrates an embodiment of a railing housing 140 for use as a middle or pass through railing wherein pickets extend completely through the railing housing 140. Such railings may be positioned between two railings that snap fit the ends of a picket into channels. Such railings may also be used as top railings. In the illustrated embodiment, the railing housing 140 is similar to railing housing 40 (see, e.g., FIGS. 5A-5C) and includes similar fitment features for coupling a railing cover 42 (see, e.g., FIG. 7). The railing housing 140 also includes corresponding holes 46, 100 formed through the upper wall 49 and lower wall 48, respectively. In some embodiments, holes 100 include H-cut tabs formed from cuts through the lower wall 48 similar to that described above with respect to tabs 31, 70 (FIGS. 3A, 6A & 6C) to tightly fit a picket along the lower wall 48. In other embodiments, holes 100 may not include H-cut tabs. In the illustrated embodiment, the holes 100 have similar elongated dimensions as corresponding holes 46. When the railing housing 140 is coupled to a railing cover, as described above with respect to FIG. 7, a picket may be extended through the holes formed through the railing cover and the corresponding holes 46, 100 formed in the railing housing 140. The hole in the railing cover may be dimensioned to provide a tight fit along the sides of the picket. For example, the hole through the railing cover may be shorter than the elongated holes 46, 100 and approximate the dimensions of the picket. As described above, the hole in the railing cover may also be partially defined at its longitudinal ends by H-cut tabs and may be dimensioned to similarly provide a tight fit along the sides of the picket. In some embodiments, the railing cover may not include H-cut tabs. Holes 46, 100 may provide a tight fit along lateral cross-section dimensions of the picket and may be elongated along at their longitudinal dimension relative to the picket and the hole in the railing cover. Once passed through the railing, the picket may be pivoted to achieve rackability such that tabs at the longitudinal ends of the hole in the railing cover bend to maintain a tight fit with the pivoted picket. The pivoting may also include the railing housing 140 sliding longitudinally relative to the railing cover. In another embodiment, a railing housing for use in a middle or pass through rail does not include a lower wall 48. In one embodiment, a railing housing for use in a middle or pass through rail includes fitment features for coupling a second railing cover at the lower side.

Figure 27:
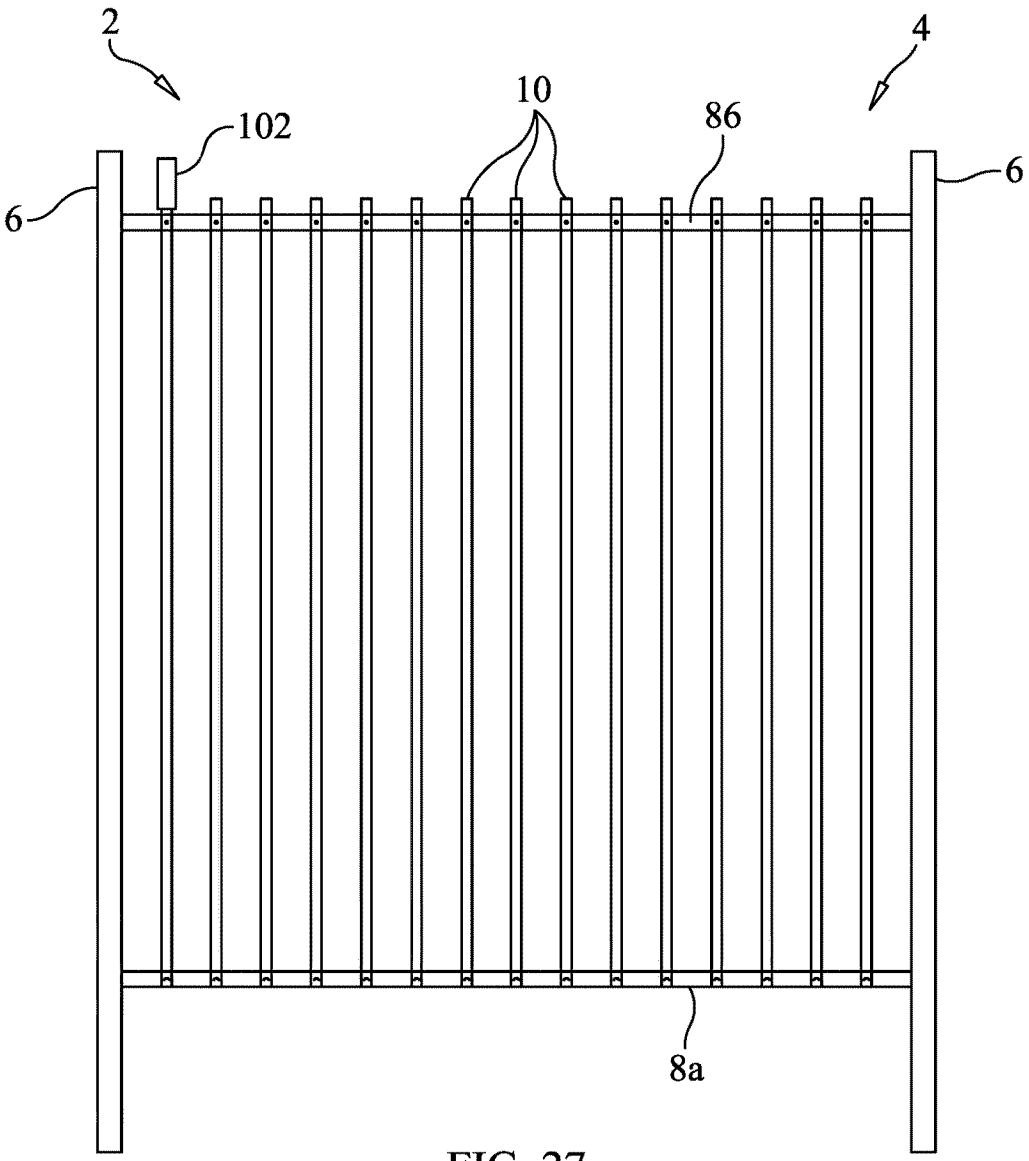
FIG. 27 is a fence panel according to various embodiments described herein.

FIG. 27 illustrates fence panel 4 according to various embodiments. The fence panel 4 includes an upper railing 8*b* configured as a pass through railing wherein pickets 10 extend completely through the rail 8*b*. Pickets 10 may also be capped with picket caps 102. The fence panel 4 may otherwise be similar to the fence panels 4 describe above with respect to FIGS. 1A & 1B. The upper railing 8*b* may be similar to railing housing 140 described above with respect to FIG. 15. Lower railing 8*a* may be similar to railing housing 40 described above with respect to FIGS. 5A-5C. Railing 8*a* and 8*b* may be oriented such that lower walls 48 are positioned below their respective upper walls 49 (see, e.g., FIGS. 5A-5C & 15).

Figure 28:
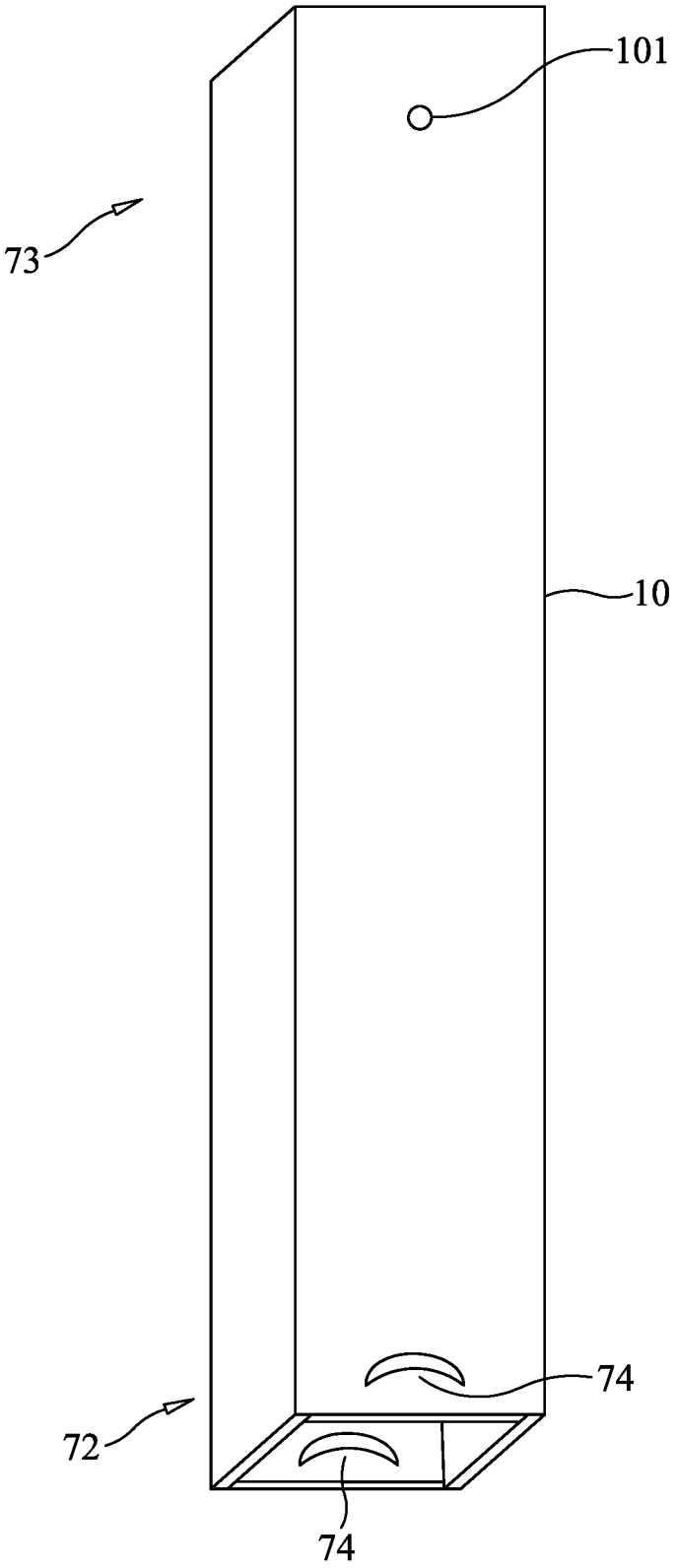
FIG. 28 is a picket according to various embodiments described herein.

FIG. 28 illustrates a picket 10 according to various embodiments. The picket 10 may be similar to the picket 10 described with respect to FIG. 8. As shown, the picket 10 includes fitment features comprising ears 74 positioned along a first end 72 configured to extend into a channel 44 and therein coupled to lower railing 8*b* of FIG. 27 in a manner similar to that described with respect to FIG. 9. The second end 73 of the picket 10 is configured to extend through the upper railing 8*b* of FIG. 27. While ears 74 or, in some embodiments, no fitment features may be used at the second end 73, in the illustrated embodiment the picket 10 is configured to couple to a stopper to secure a vertical position of the picket 10 with respect to the railing 8*b*. In particular, one or more holes 101 are provided along the second end 73 for receiving a stopper. When coupled to the picket 10, the stopper positions within the railing 8*b* to secure the vertical position of the picket 10.

Figure 29:
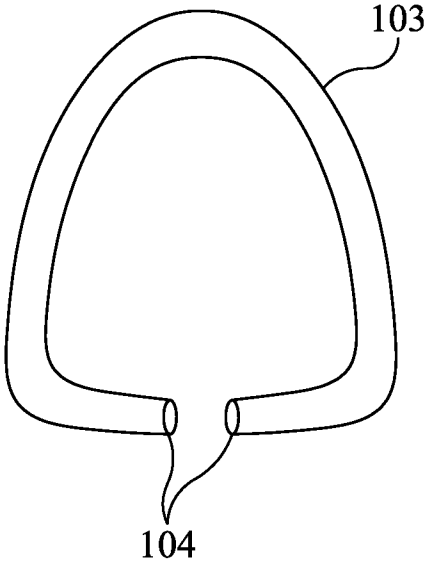
FIG. 29 is a stopper according to various embodiments described herein.

With reference to FIG. 29, a stopper 103 may include a physical obstruction attached to the picket 10 to prevent movement of the picket 10 through the railing 8*b* in one or both directions. The stopper 103 will typically position in the channel 63 between the upper wall 49 of the railing housing 40 and the cover plate 54 of the cover 42 (see, e.g., FIG. 7); however, the stopper 103 may position at other locations such as outside the lower wall 40 of the railing housing or outside the cover plate 54 of the railing cover 42. As shown, the stopper 103 includes an arcuate bend extending between two couplings 104 comprising pins configured to be received in corresponding holes 101 defined in the picket 10. The stopper 103 may be resilient such that pins 104 may be separated a sufficient distance to engage holes 101 and then insert to couple the stopper 103 to the picket 10. In other embodiments, the stopper may have rectangular or other dimensions that wrap around all or a portion of the picket 10. Other configurations may also be used. For example, in one embodiment, the stopper 103 includes a bar that may be passed through the picket 10 between holes 101, which may include extending through holes 101 in adjacent pickets 10.

Figure 30:
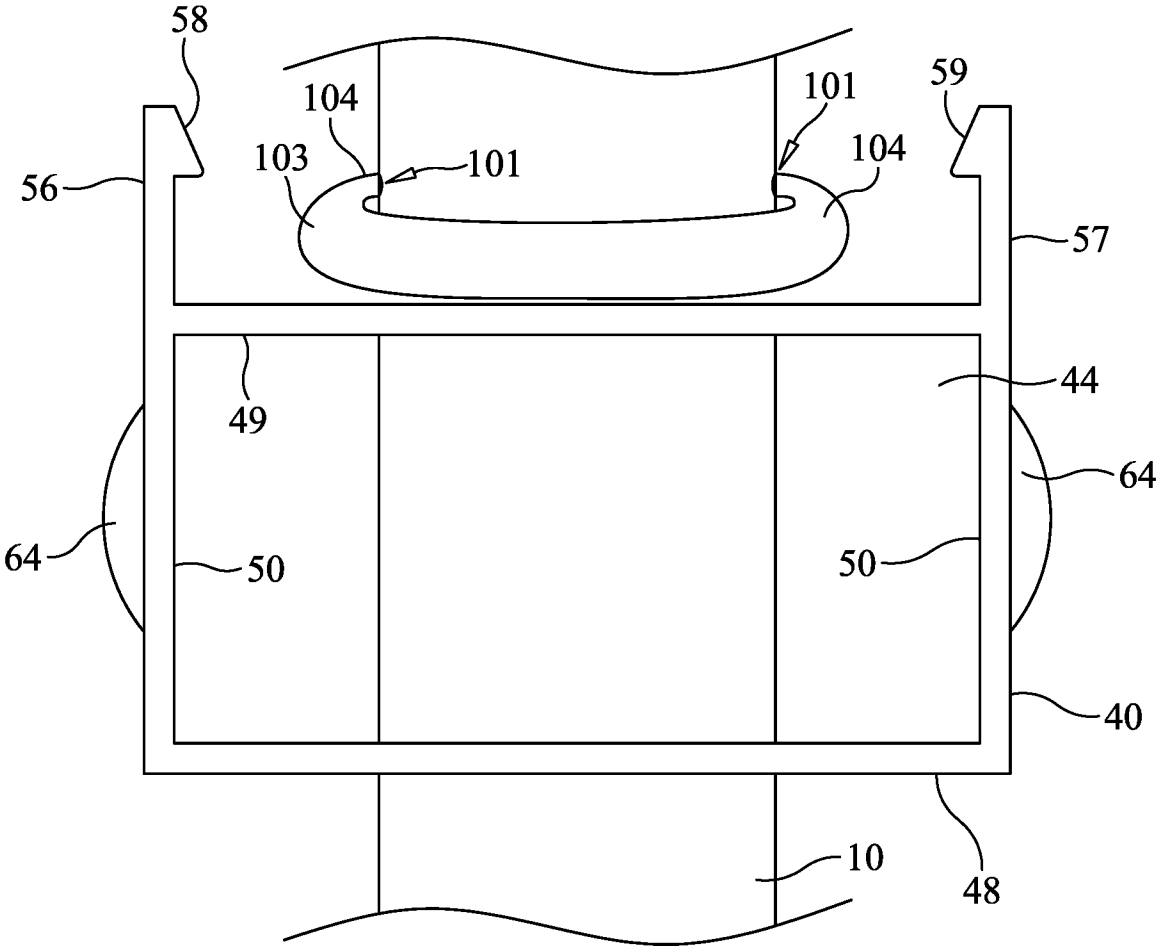
FIG. 30 is an end view of the picket shown in FIG. 28 extending through a railing housing and coupled to the stopper shown in FIG. 29 according to various embodiments described herein.

FIG. 30 illustrates the picket 10 shown in FIG. 28 extended through the railing housing 40 shown in FIG. 7 and coupled to stopper 103. Ends 104 extend into holes 101 and the stopper 103 positions adjacent to wall 49. A railing cover (not shown) may be coupled to railing housing 40 (see, e.g., FIG. 7) to position the stopper 103 within the channel between wall 49 and the cover plate of the railing cover. Accordingly, the panel 4 illustrated in FIG. 27 may include a plurality of pickets 10 as illustrated in FIG. 28. The pickets 10 may include ears 74 at first ends 72 for stably positioning the first ends 72 in the lower rail 8*a* and holes 101 at a second end for receiving a stopper 103, as shown in FIG. 29. The stopper 103 may be positioned in channel 63 between wall 49 and a cover plate 54 of a railing cover 42 as shown in FIGS. 7 & 30.

Figure 31:
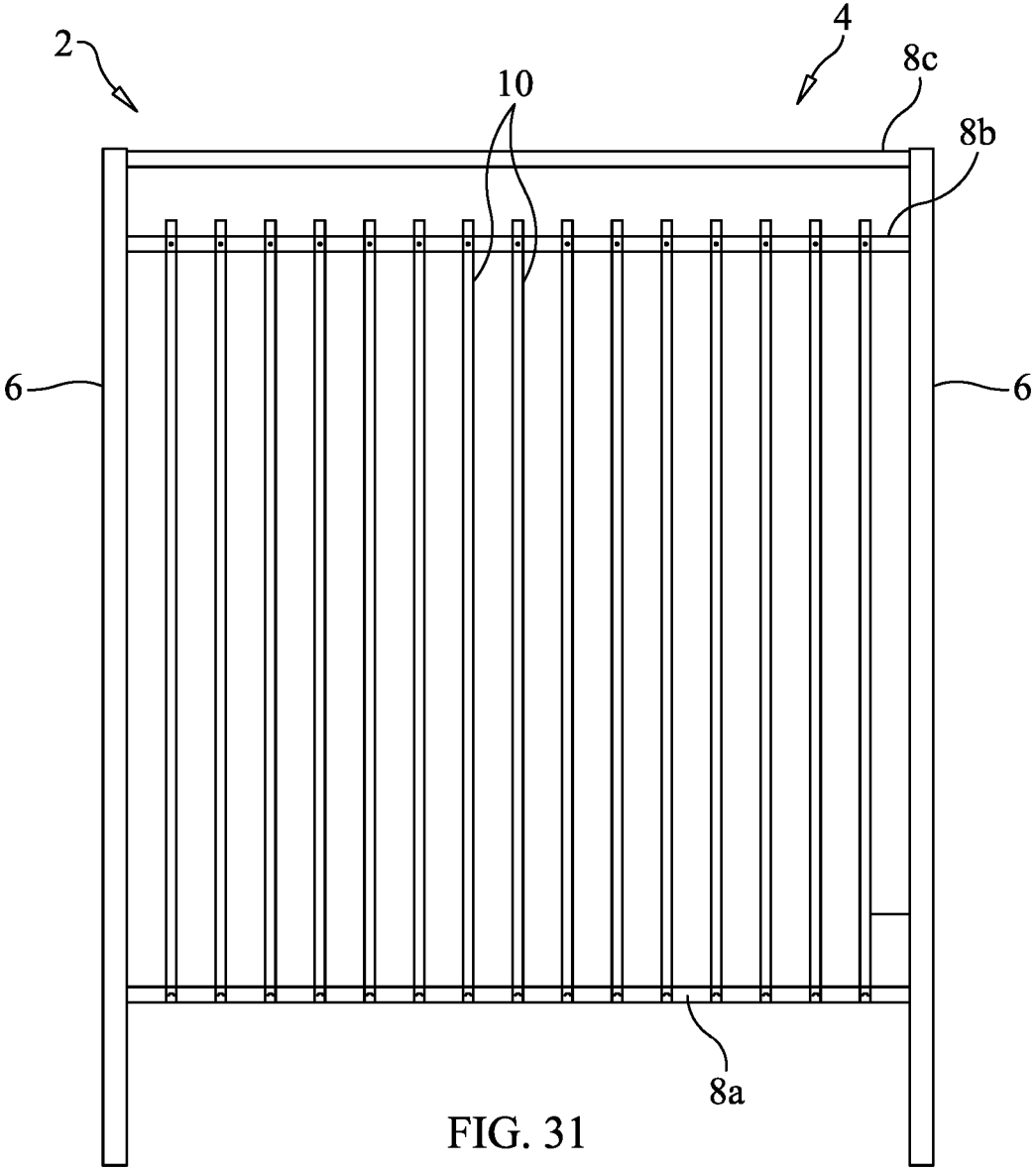
FIG. 31 is a fence panel according to various embodiments described herein.
Figure 32:
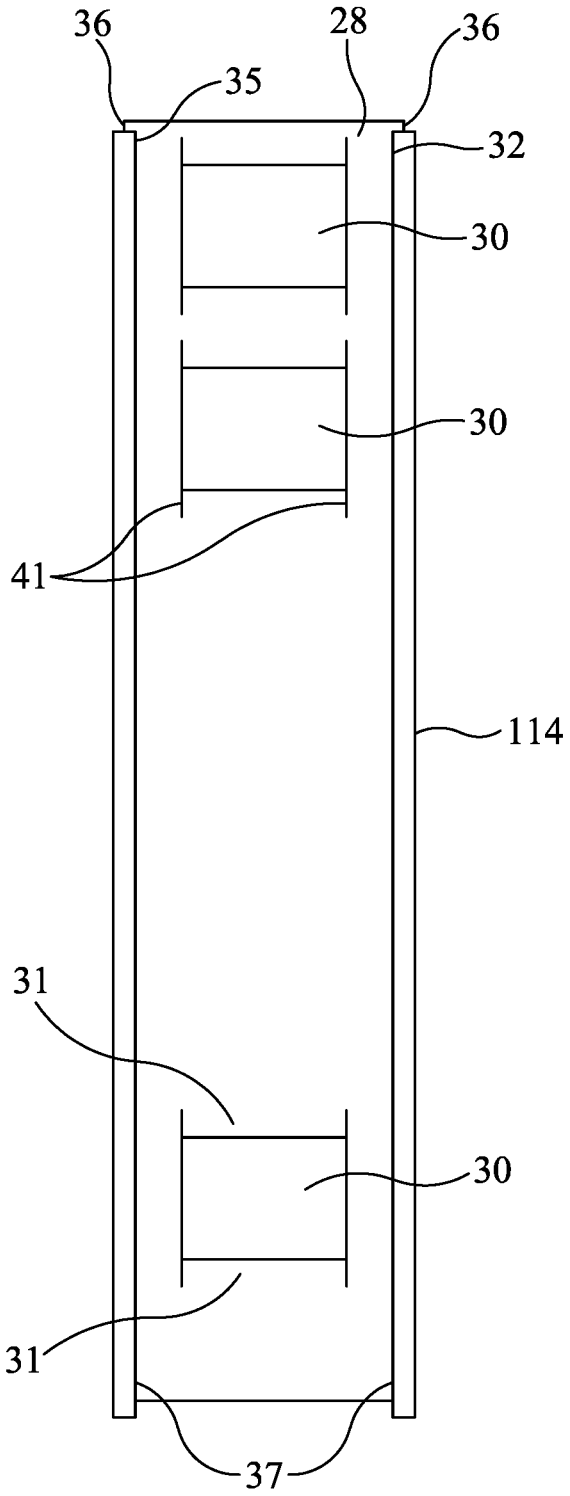
FIG. 32 is a post cover according to various embodiments described herein.

FIG. 31 illustrates an embodiment of a fence panel 4 according to one embodiment. The fence panel 4 includes a lower railing 8*a*, a first upper railing 8*b*, and a second upper railing 8*c* wherein the pickets 10 stably position in the lower railing 8*a* and pass through the first upper railing 8*b*. The pickets 10, lower railing 8*a*, and first upper railing 8*b* may be configured as described above with respect to FIGS. 27-30. The second upper railing 8*c* may include a railing housing similar to railing housing 40 illustrated in FIG. 5A, which may or may not include holes 46. The railing housing may be stably coupled to the posts 6 with wall 48 (see FIG. 5A) in the lower position or an upper (inverted) position. In some instances, a railing cover may be coupled to the railing housing. For example, the railing cover similar to railing cover 42 illustrated in FIG. 6A, which may or may not include holes 52 along the cover plate 54. In some embodiments, railing 8*c* may be a single rail including ears at both ends to stably couple with posts 6. FIG. 32 illustrates an embodiment of a post cover 114 configured for use with a three railing fence panel. The post cover 114 may be similar to post cover 14 described above with respect to FIGS. 3A & 3B and including a third hole 30. In some embodiments, the post cover 114 does not include tabs 31 or tabs 31 formed by cuts 41.

Figure 33:
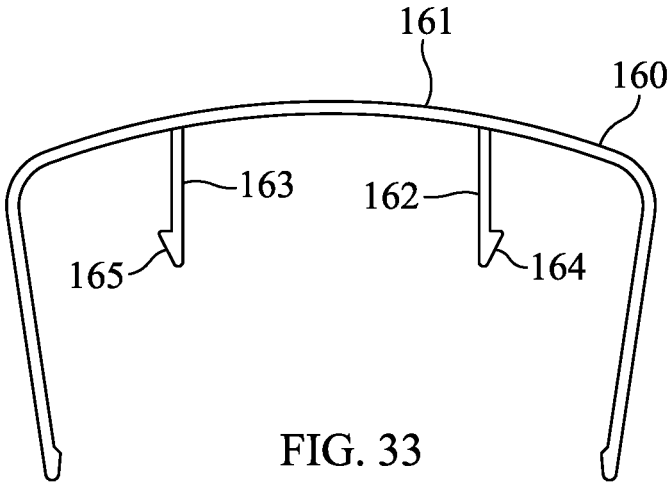
FIG. 33 is a railing cap according to various embodiments described herein.

FIG. 33 illustrates an end view of a railing cap 160 according to one embodiment. The railing cap 160 includes an outer wall 161 extending along an arcuate curve. Other outer wall configurations may also be used. For example, an outer wall 161 may define one or more squared or straight edged lengths along its cross-section and include two or more sides. The outer wall 161 typically extends a longitudinal length corresponding to one or more fence panels. The railing cap 160 further includes walls 162, 163 extending inward from an interior side of the outer wall 161. Walls 162, 163 may extend longitudinally along a length of the railing cap 160 corresponding to the length of the outer wall 161. For example, the walls may extend 162, 163 along one or more segments or the entire length of the railing cap 160 or outer wall 161. Outer wall 161 will typically extend laterally beyond walls 162, 163 and extend downwardly beyond walls 162, 163. The railing cap 160 is configured to couple with a railing or railing housing and includes lips 164, 165 position along walls 162, 163, respectively. The lips 164, 165 are configured to snap fit with a railing cover to stably couple the railing cap 160 to a railing or railing housing.

Figure 34:
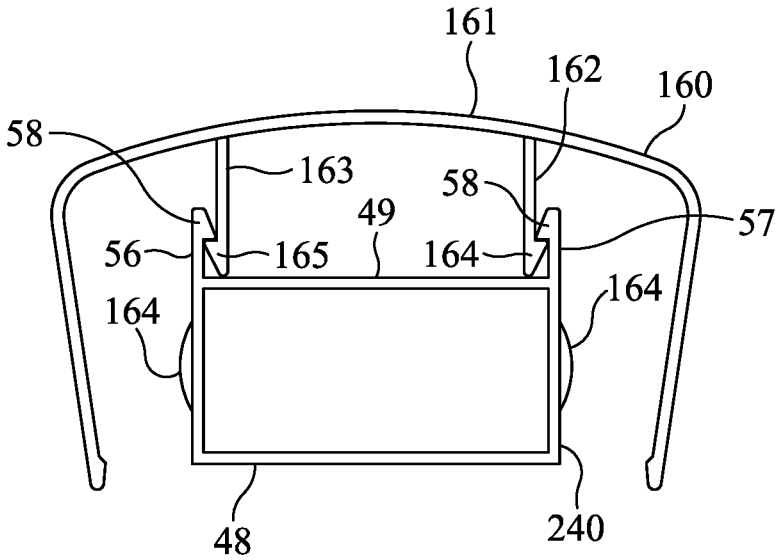
FIG. 34 illustrates the railing cap shown in FIG. 33 coupled to a railing housing according to various embodiments described herein.

FIG. 34 illustrates an end view of the railing cap 160 shown in FIG. 33 stably coupled to a railing housing 240 according one embodiment. Lips 164, 165 snap fit along sidewalls 56, 57 with lips 58, 59. The snap fitment may be similar to that described herein with respect to the snap fitment of railing cover 42 with railing housing 40 of FIG. 7. When stably coupled to the railing housing 240, outer wall 161 typically extends exteriorly of and to or below the lower wall 48 of the railing housing 240.

Figure 36:
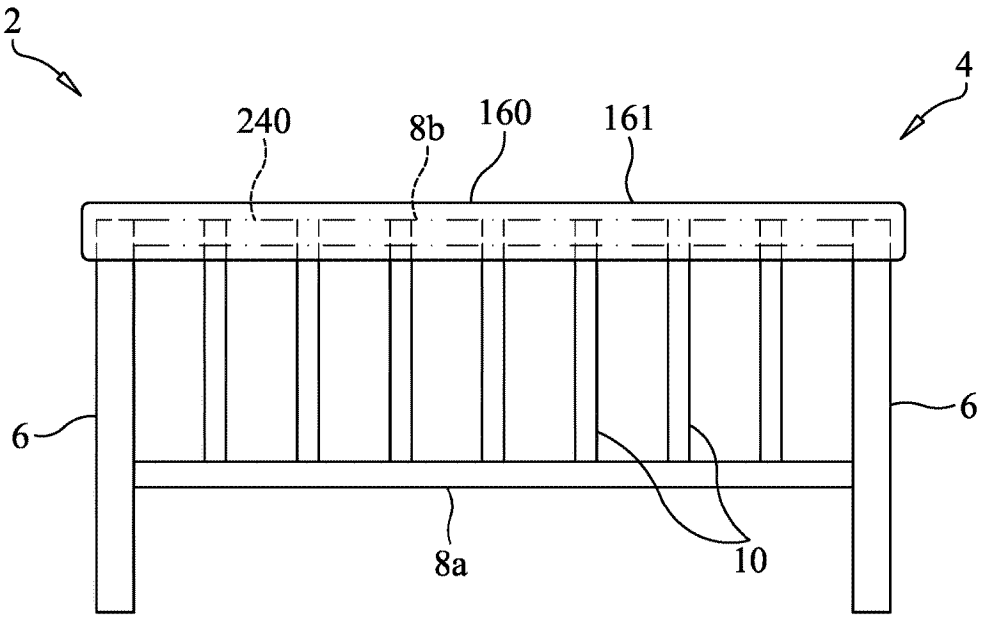
FIG. 36 is a fence panel including a railing cap according to various embodiments described herein.
Figure 35:
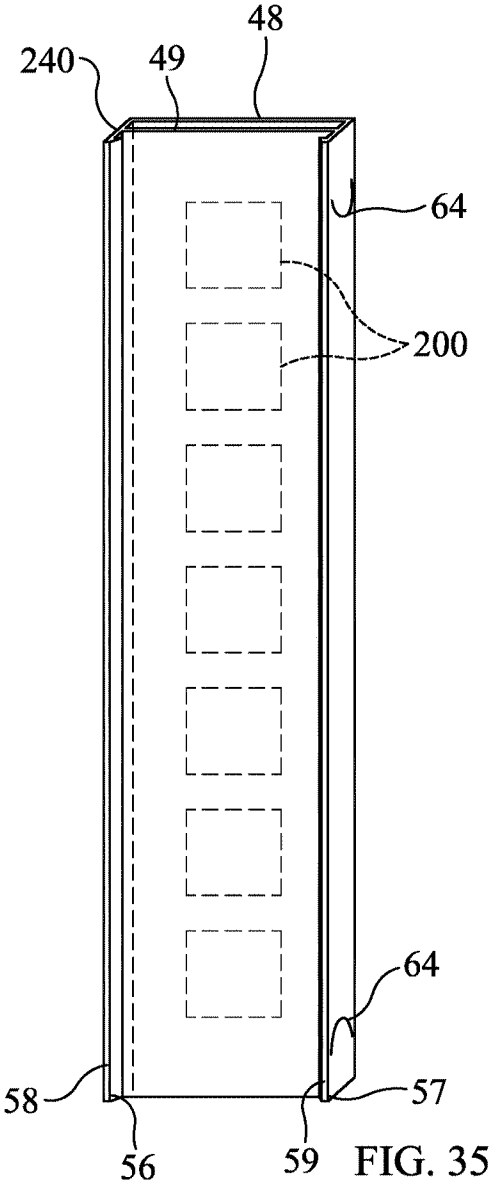
FIG. 35 is a railing housing according to various embodiments described herein.

FIG. 35 illustrates an embodiment of the railing housing 240 configured for snap fitment with the railing cap 160 and also configured for stable coupling to pickets 10, such as in an example fence panel 4 depicted in FIG. 36 (showing railing housing 240 and ends of pickets 10 in ghost). The railing housing 240 includes holes 200 (shown in ghost) defined in wall 48 for receiving pickets 10. Wall 48 may further include tabs, e.g., formed by cuts adjacent to holes 200 similar to those described with respect to FIG. 6B, for snap fitment with picket ears. However, in some embodiments, wall 48 does not include tabs adjacent to holes 200. In other embodiments, railing cover 160 may couple a railing cover similar to railing housing 40 (FIGS. 5A-5C), railing housing 140 (FIG. 15), or a railing housing that does not include holes in wall 48 and 49 for receiving pickets, e.g., for use along an upper rail that does not couple with pickets as in FIG. 31. In one embodiment, picket holes extend through both walls 48, 49 similar to railing housing 140 (FIG. 15), wherein the picket 10 is similar to picket 10 described above with respect to FIG. 28 and includes a hole 101 for coupling to a stopper 103 (see, e.g., FIGS. 29 & 30) to prevent the hole 101 from being pulled below wall 48.

Figure 38:
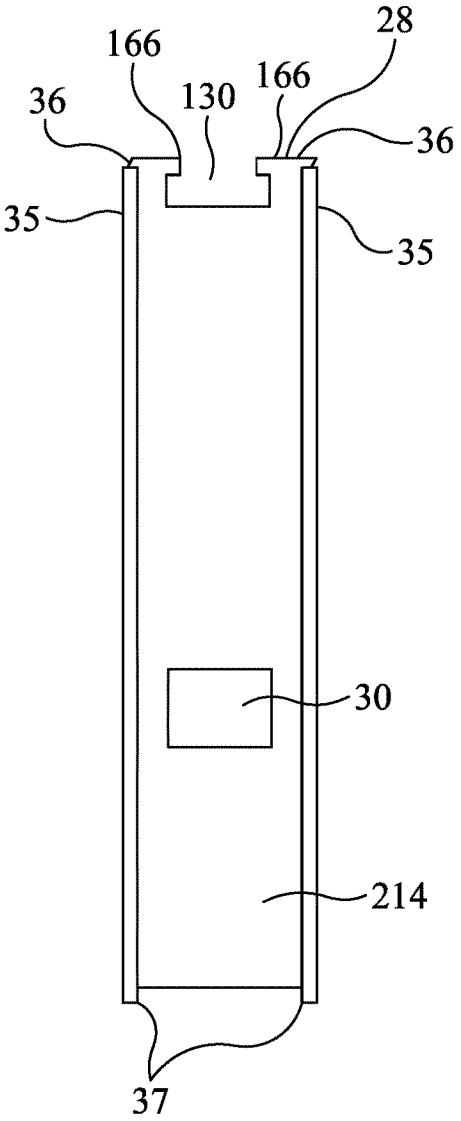
FIG. 38 is a post cover according to various embodiments described herein.
Figure 37:
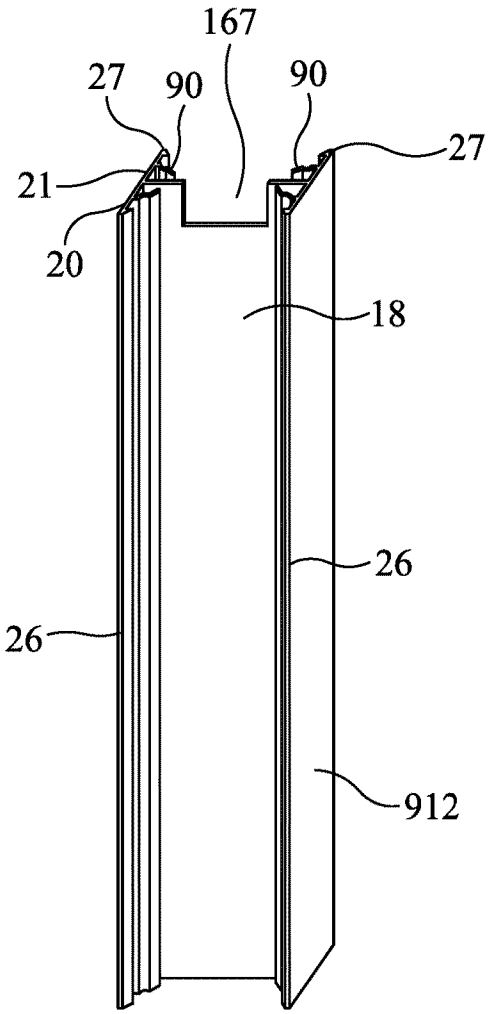
FIG. 37 is a post housing according to various embodiments described herein.
Figure 39A:
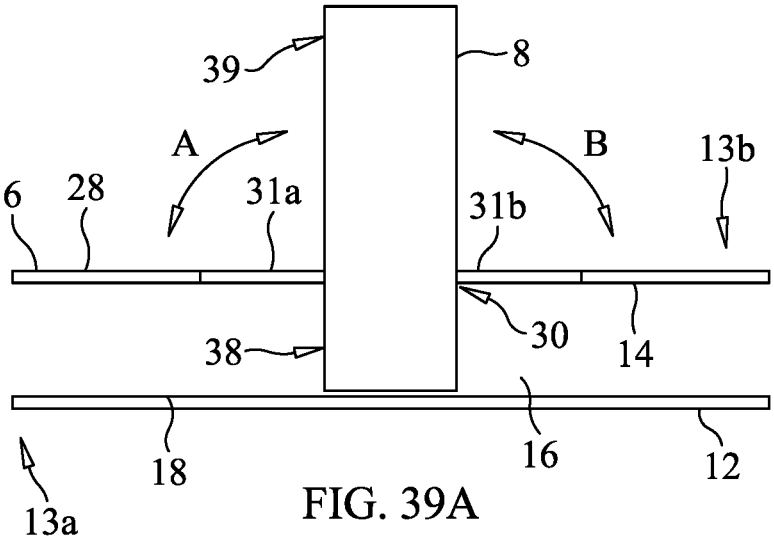
FIGS. 39A-39C illustrate racking of a railing according to various embodiments described herein.
Figure 39B:
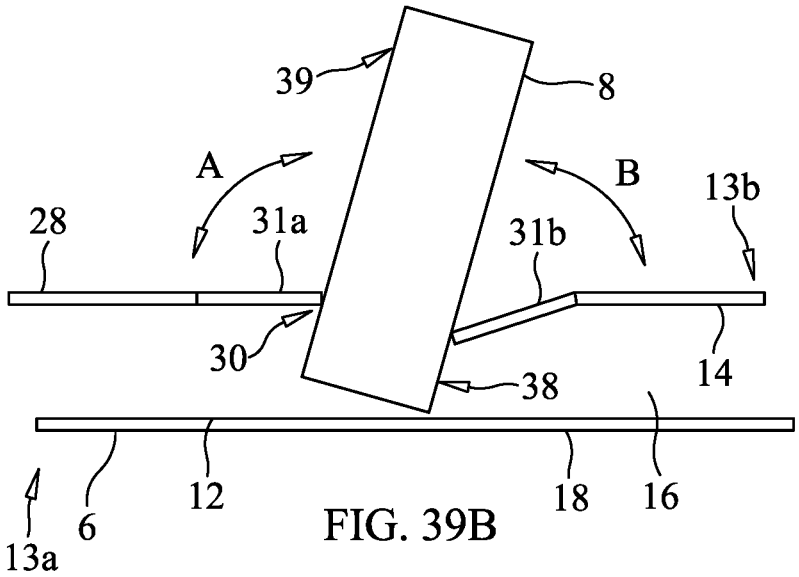
Figure 39C:
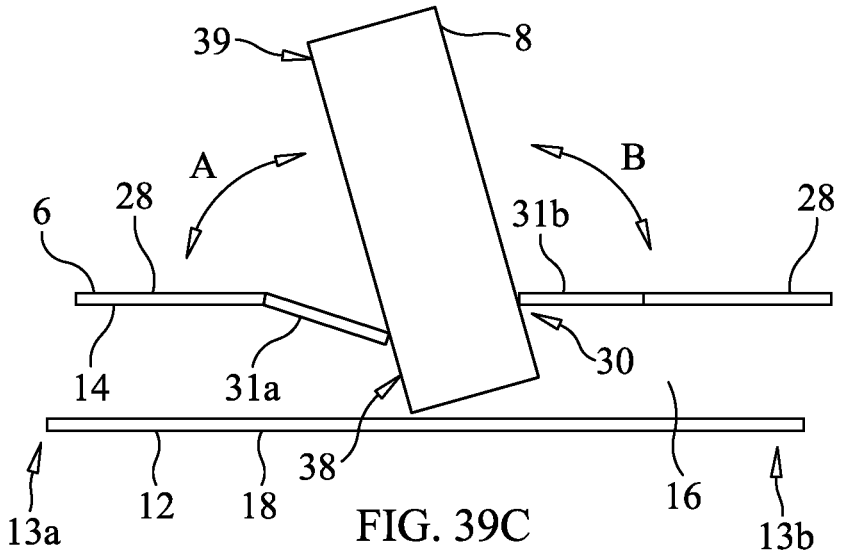

FIG. 37 illustrates an embodiment of a post housing 912 configured to couple to the post cover 214 illustrated in FIG. 38 to form a post 6 to receive railings 8*a*, 8*b*, including railing housing 240 and railing cap 160 in a fence panel 4 configuration as shown in FIG. 36. The post cover 214 may be similar to post covers 14 and 114 described with respect to FIGS. 3A & 3B and FIG. 32, respectively. Post housing 912 may be similar to any post housing described herein. For example, post housing 912 may include arms 90 that extend inwardly from sidewalls 20 dimensioned to limit lateral movement of railings 8*a*, 8*b* when the railing 8*a*, 8*b* is inserted into the post 6. The post cover 214 may couple, e.g., snap fit, with post housing 912 in manner similar to that described above with respect to FIGS. 19 & 21B. The post cover 214 includes a lower hole 30 to stably receive the lower railing 8*a* and an upper hole 130 to stably receive railing housing 240 (e.g., as described above with respect to FIGS. 20 & 22). The upper hole 130 is configured to receive the railing housing 240 between lateral sides of the hole 130. Ears 64 at ends of the railing housing 240 may engage lateral sides of the upper hole 130, e.g., as described above with respect to FIG. 20, to stably couple the railing housing 240 to the post 6. In some embodiments, the arms 90 of post housing 912 may extend inwardly from sidewalls 20 a sufficient distance to position over ears 64 when the railing 8*a*, 8*b* is inserted into the post 6, e.g., as described above with respect to FIG. 22. Upper hole 130 of the post cover 214 provides a passage through which walls 162, 163 of the railing cap 160 may pass. The hole 130 includes inwardly directed extensions 165 configured to position above lips 58 of the railing housing 40 and thereby prevent the railing housing 40 from being pulled vertically from the hole 130. The post housing 912 also includes a hole 167 or passage in wall 18 through which walls 162, 163 of the railing cap 160 may pass.

Figure 16:
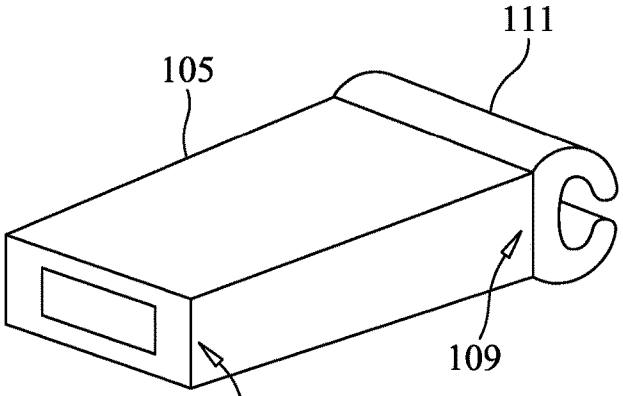
FIG. 16 is an elevated side view in perspective of a railing plug according to various embodiments described herein.

FIG. 16 illustrates a railing plug 105 according to various embodiments. A railing plug 105 may be positioned at the end of a railing to provide a tighter fit when the railing is couple within the post. For example, a railing plug 105 may provide a longitudinal spacer or extender between the railing and a base of a post housing channel to take up play between the end of the railing and the post. The railing plug 105 may increase the margin for error when setting a distance between posts. In some embodiments, the railing plug 105 may function as a silencer that absorbs longitudinal force between the railing and post. As shown, the railing plug 105 extends between a first end 107 and a second end 109. A bumper 111 is positioned on the second end 109. A cross-sectional dimension of the railing plug 105 increases from the first end 107 toward the second end 109 configured for compression fitment to an end of a railing. For example, the first end 107 is dimensioned to be inserted in a channel of a railing housing, such as channel 44 of railing housing 40 (FIGS. 5A-5C). The second end 109 is larger than the channel, thereby preventing the railing plug 105 from inserting completely into the channel. When the railing plug 105 is inserted into the post on the end of the railing, the railing plug 105 may extend the length of the railing. The bumper 111 may position adjacent to or contact the base of a post housing channel. The bumper 111 has a rounded c-shape allowing the bumper 111 to roll along the base when the railing is pivoted within the channel. The c-shape of the bumper 111 may also allow compression to reduce the length of the railing plug 105 if needed or to absorb longitudinal force and provide a tighter longitudinal fit. The railing plug 105 may comprise a resilient elastomeric material such as a durable plastic, rubber-like material, synthetic polymer (HDPE, silicones, etc.).

Figure 17:
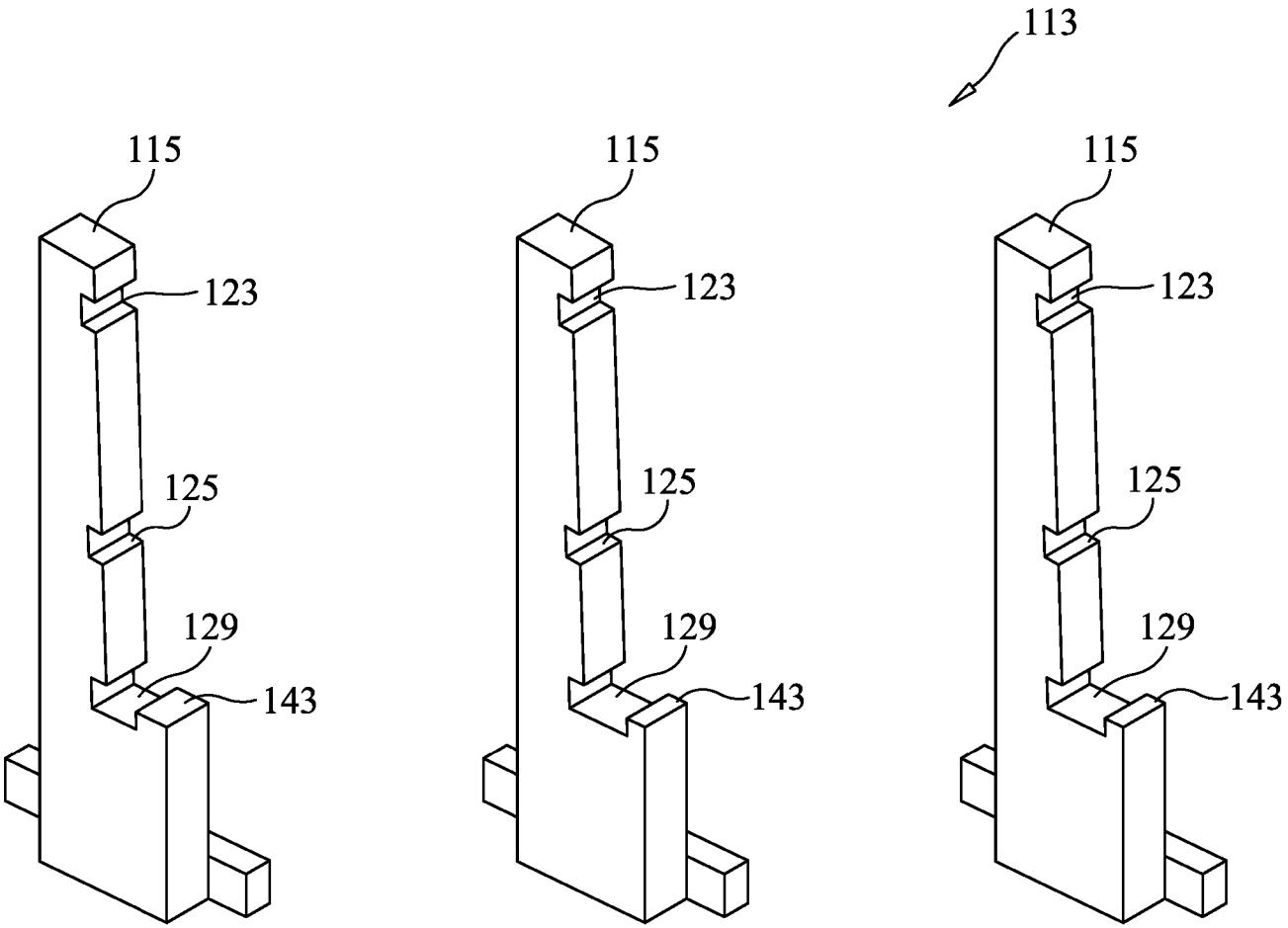
FIG. 17 illustrates a fence assembly system according to various embodiments described herein.

In various embodiments, the fence system 2 includes a fence assembly system configured to support fence components for assembly of a panel. FIG. 17 illustrates a fence assembly system 113 according to various embodiments. The fence assembly system 113 includes a support 115 for supporting railings during assembly. In the illustrated embodiment, three supports 115 are positioned for assembling a panel. The supports 115 may be structured for assembly of various numbers and locations of railings. The supports 115 shown in FIG. 16 include three railing ledges 123, 125, 129 for supporting three railings. Each railing ledge 123, 125, 129 includes a notch 143 for vertically retaining a railing supported on the railing ledge 123, 125, 129. Railing ledge 129 also includes a retainer ledge to provide additional lateral retention of a railing supported on the railing ledge 129. The illustrated supports 115 are structured for assembly of a panel including three railings, wherein the bottom railing may be a railing structured to couple a picket in a manner similar to that shown in FIG. 9 and the two upper railings may be pass through railings or other railing as described above. In some embodiments, supports 115 may be customized to support any number, size, or vertical design of railings. The illustrated notches 143 define generally rectangular cross-sections for supporting generally rectangular railings. However, is other embodiments, the notches 143 may define other cross-sectional shapes or dimensions.

In operation, a user may align the supports 115 for receiving railings. A railing may be positioned on each railing ledge 123, 125, 129 and passed into the notch 143. Pickets may be passed through the holes of the railing and tapped into place for snap fitment. Supports 115 or railings may be longitudinally adjusted to expose all the holes in the railing. Caps may be placed on pickets or the pickets may include integrated caps. A fourth railing similar to the railing positioned on railing ledge 129 may also be positioned over the tops of the pickets and tapped into place to snap fit the tops of the pickets to the fourth railing. The ends of the railings may be extended through holes of a post and tapped into place for snap fitment. Once assembled, the panel may be removed from the supports 115 and installed at a desired location.

Figure 18B:
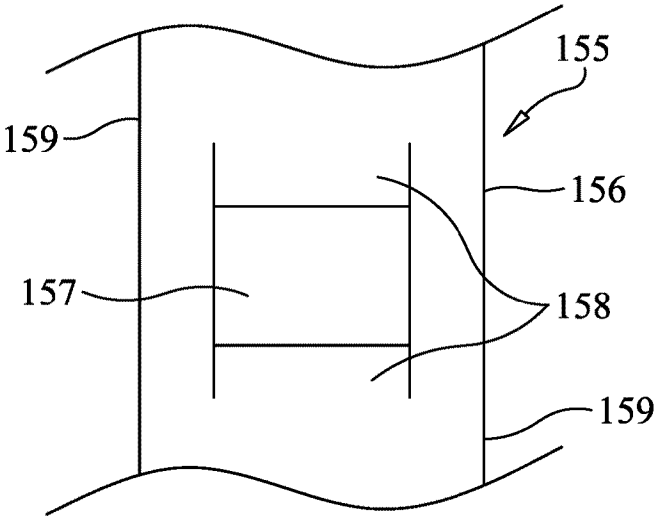
FIG. 18B is a magnified view of the silencer taken from box 18B in FIG. 18A according to various embodiments described herein.
Figure 18A:
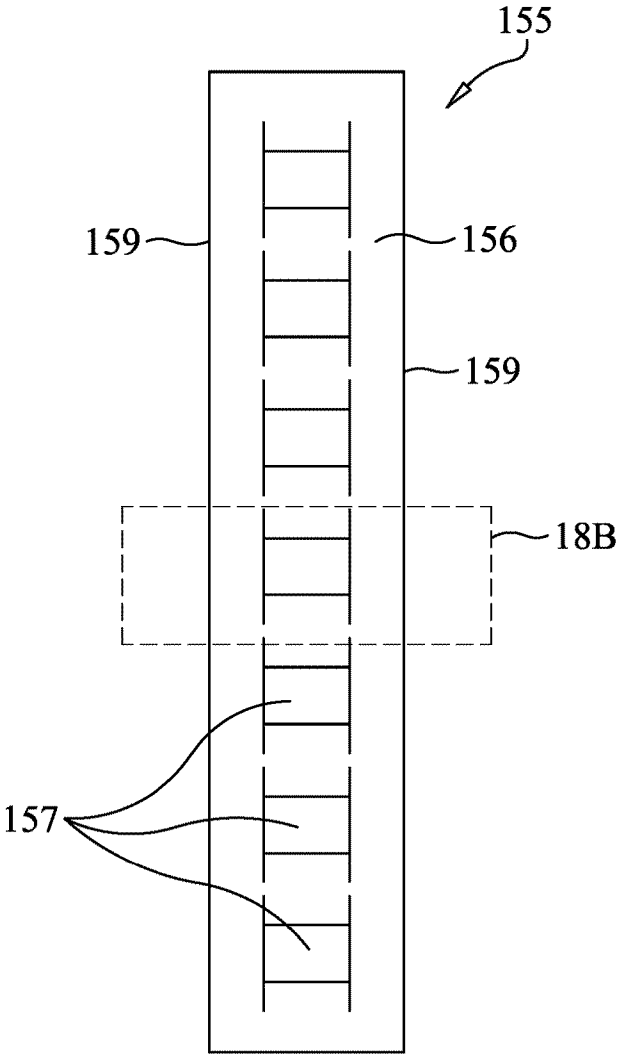
FIG. 18A is a top view of a silencer according to various embodiments described herein.

In various embodiments, the fence system 2 includes a silencer dimensioned to be positioned between interfaced components of the fence system. For example, in some embodiments, silencers may block all or a portion of direct physical contact between railings and posts or railings and pickets. Silencers may also apply compression to inserted ends of railings or pickets to reduce movement and rattling. FIGS. 18A & 18B illustrate a silencer 155 according to various embodiments. The silencer 155 includes a face plate 156 having a longitudinal length. Holes 157 are defined in the face plate 156. The face plate 156 also includes H-cut tabs 158 defining longitudinal ends of the holes 157, as best shown in the magnified view of FIG. 18B taken from box 18B in FIG. 18A. The face plate 156 includes width dimensions between edges 159 approximately equivalent to the width of the upper wall of a railing housing (see, e.g., FIGS. 5A-5C & 15). When the face plate 156 is placed over an upper wall of a railing housing, the holes 157 and width dimensions thereof align with width dimensions of holes through the upper wall of the railing housing. The edges 159 may be dimensioned to snap or slide fit beyond lips defined on extensions of the railing housing and into a slot between the lip and the upper wall of the railing housing. The width dimension of the holes 157 may be approximately equivalent to the width dimension of the holes through the upper wall of the railing housing. The tabs 158 are bendable along the face plate 156 to define a length dimension at the longitudinal ends of the holes 157. Prior to bending, the holes 157 define a length dimension less than the corresponding dimension of a picket that is to be extended through the hole 157. In various embodiments, the tabs 158, face plate 156, or both are made of a durable plastic or polymer. The tabs 158 may further be sufficiently rigid to apply inwardly directed force between the tabs 158 when the tabs 158 are bent or compressed downward by a picket. In use, the silencer 155 may be placed over a top wall of a railing housing. A railing cover (see, e.g., FIGS. 6A-6C) may be couple to the railing housing as described herein. When a picket is passed through the holes 157, the tabs 158 bend or compress downward into the channel of the railing housing. The tabs 158 may be positioned between the picket and railing housing at the longitudinal interfaces to reduce movement and rattling. In some embodiments, similarly configured silencers may be used to silence railings stably coupled to posts by positioning tabs between the longitudinal interfaces of the railing and the holes of the post housing.

Also disclosed is a method of assembling a fence or fence panel 4. The method will be described with reference to FIGS. 1A-39C; however, it will be appreciated that variations in the methods may be included, for example, when additional, fewer, or differently configured components are assembled. The method may include assembling a post 6. Assembling the post 6 may comprise snap fitting, such as slidable snap fitting, a post cover 14 and/or an intermediate post cover 75 over a channel 16, 17 defined in a post housing 12, which may include any post housing configuration described herein, such as post housings 112, 212, 312, 412, 512, 612, 812, and 912. The method may further include snap fitting a post cover 14 onto the intermediate post cover 75, such as described above with respect to FIG. 10 and elsewhere herein in embodiments including an intermediate cover 75. The post housing 12 may be selected according to a desired layout of the fence or fence panel 4. For example, if no additional panels 4 are to be assembled, a single channel post housing, e.g., post housing 112, may be used to assemble an end post 6*a*. If additional panels 4 are to be assembled to a post 6, for example, as exemplified by the dashed panel 4 coupled to multi-panel post 6*b* in FIGS. 1A & 1B, a housing such as post housing 12 having the desired number and orientation of channels 16, 17 may be used to assemble the multi-panel post 6*b*. A multi-panel post 6*b* may be a corner post having two or more channels 16, 17 orientated at angles other than linear. The angles may be fixed, e.g., using corner post 612 (FIG. 23B) or may be adjustable. For example, post housing 312 or 812 may be selected and the assembled post 6*b* may be pivoted to obtain the desired angle (see FIGS. 14B & 26B), which in this embodiment may include 180° (FIG. 14A). If a straight run of two panels is to be assembled, the multi-panel post 6*b* may be a line post comprising housing such as post housings 12, 212, 312, and 412 having two linearly oriented (180°) channels or fittings in an H configuration (see, e.g., FIGS. 2A, 13A, 14A, 21B).

The post cover 14 may be selected according to the particular design of fence or fence panel 4 to be assembled. For example, the post cover 14 may include holes 30 dimensioned, sized, and numbered according to the dimensions, size, and number of railings 8 to be received into the one or more channels 16, 17 through the holes 30. An intermediate post cover 75 may be similarly selected to include holes 76 that are dimensioned and arranged to align with the holes 30 of the selected post cover 14 to receive railings 8 in the desired orientation. In some embodiments, post covers 14 that do not include holes 30 may be couple over an unused channel 16, 17 to form an end post 6*a*. As introduced above with respect to FIG. 1B, a panel 4 and components thereof may be configured to be rackable. For example, a post 6 and railing 8 may be rackable such that the post 6 and railing 8 may be used in multiple orientations, which may include both perpendicular and non-perpendicular orientations. If non-perpendicular orientations are desired, post components may be selected wherein corresponding holes 30, 76 are offset or offsetable, e.g., by relative sliding of the components as described herein. Thus, a single set of post housings 12, intermediate post covers 75, and post covers 14 may be configured to stably couple railings 8 in multiple orientations.

The method may also include assembling one or more railings 8, e.g., an upper 8*a* and a lower railing 8*b* (see, e.g., FIGS. 1A & 1B). Assembling a rackable railing 8 may comprise snap fitting a railing cover 42 (see, e.g., FIGS. 6A-6C) over a channel 44 defined in a railing housing 40 (see, e.g., FIGS. 5A-5C), which may include any railing housing configuration described herein, such as railing housing 140, 240, and which may be accomplished as described with respect to FIG. 7 and elsewhere herein. The railing housing 40 and railing cover 42 may include corresponding holes 46, 52 wherein snap fitting the railing cover 42 over the channel 44 may include aligning corresponding holes 46, 52. In one example, the holes 46 in the railing housing 40 are larger in at least one dimension than the corresponding holes 52 in the railing cover 42. In one such embodiment, a rackable railing housing 40 defines holes 46 suitable for use with a picket 10 that may be positioned at multiple orientations or angles. The railing cover 42 that is couple to the railing housing 40 may be selected according to the desired orientation of the picket 10 to be stably coupled, e.g., via snap fitment, to the railing 8, as described above and elsewhere herein. The holes 52 in the railing cover 42 may be dimensioned to provide a tight coupling for a picket 10 in a desired orientation, e.g., angle with respect to the railing 8 (see, e.g., FIGS. 1A & 1B). The railing housing 40 may therefore be configured for use with multiple orientations of pickets 10 determined by the orientation provided by the hole in the railing cover 42.

As introduced above, despite tight coupling of railings 8 and pickets 10, in various embodiments, panels 4 may be rackable (see, e.g., FIG. 1B). For example, the railing cover 46 may be slidable along the railing housing 40 when the two are slidable when coupled to longitudinally offset the corresponding holes 46, 52 and allow pickets 10 to be stably coupled to the railing 8 at non-perpendicular or perpendicular angles. Longitudinally offsetting the corresponding holes 46, 52 relative to the position of the holes 46, 52 for stably coupling a picket 10 at a perpendicular orientation, e.g., by sliding the railing cover relative to the perpendicular orientation alignment, allows pivoting of the picket 10 to non-perpendicular orientations with respect to the railing 8. Thus, a single set of railing housings 40 and railing covers 46 may be configured to stably couple pickets 10 at multiple angles.

The method may also include stably coupling the railing 8 and post 6, which may be similar to the snap fit shown in FIGS. 11, 20, 22, to stably couple the railing 8 and post 6, e.g., snap fitting a first end of the railing 8 to a first post 8*a* and a second end of the railing 8 to a second post 8*b*. In one example, snap fitting a railing 8 and post 6 includes extending the end of the railing 8 through holes 30 of a post cover 14 or corresponding holes 76, 30 of an intermediate post cover 75 and a post cover 14 and into a channel 16 of the post housing 12. Dimensions of the holes 30 in the post cover 14 may be similar to corresponding dimensions of the railing 8 to provide a close fit. A dimension of the holes 76 in the intermediate post cover 75 may be similar to a corresponding dimension of the railing 8 that includes ears 64 located at an end 38, 39 of the railing 8. In these or another embodiment, one or both holes 76, 30 may be dimensioned such that the railing 8 can only be installed in a correct orientation. In one example, snap fitting the railing 8 and post 6 may include extending the end of a railing 8 through a hole 30 in the post cover 14 or corresponding holes 76, 30 of the post cover 14 and intermediate post cover 75 such that ears 64 deform inwardly as the end is pushed through hole 30 or hole 76 and into the channel 16. After clearing the edges of the post cover plate 28 or, in embodiments with both a post cover 14 and an intermediate post cover 75, both post cover plates 77, 28 defining the holes 30, 76 therein, the ears 64 may resiliently spring open, outwardly, or return to an open or outward position, preventing the railing 8 from being removed from the post 6. In some embodiments, ears 64 may compress or bend inward when the end of the railing extends into the channel 16 adjacent to arms 90 and then spring out to a greater width after passing the arms 90 (see, e.g., FIG. 22). In one embodiment, the method may include positioning railings 8 into notches 143 of one or more supports 115 (see, e.g., FIG. 16) and then aligning corresponding holes 76, 30 of posts 6 with railing ends 38, 39 and snap fitting the ends 38, 39 into the post 6.

The method may also include snap fitting one or more railings 8 and one or more pickets 10, which may be similar to that described above with respect to FIG. 9. In some embodiments, the picket 10 may be snap fit into a lower railing 8*a* (see, e.g., FIGS. 1A & 1B), an upper railing 8*b*, or both. For example, each picket 10 may be snapped into the lower railing 8*a*. Each picket 10 may also be snapped into the upper railing 8*b*. The upper railing 8*b* may be similar to the lower railing 8*a* as described herein and may be rotated 180° to receive the picket 10 through the corresponding holes 46, 52. An upper railing 8*b*, middle railing, or another railing 8 may be a pass through railing 8 wherein a picket 10 extends completely through the railing 8. For example, the railing 8 may include railing housing 140 (FIG. 15). One or more ends 72, 73 of the picket 10 may include fitment features structured for snap fitment when extended into the channel 44 of the railing housing 40. In one embodiment, the fitment features include ears 74, e.g., resilient tabs, that may deform during insertion of the picket 10 through the corresponding holes 46, 52 in the railing cover 42 and railing housing 40 and then spring open, outward, or return to an open or outward position when positioned in the channel 44 of the railing housing 40. The picket 10 may include dimensions similar to dimensions of hole 52 to provide a tight fit with the hole 52 when inserted therethrough. For example, a picket 10 having rectangular ends 72, 73 may be extended through rectangular holes 52 in railing cover 42 that provide a close fit into the rectangular hole 52 in the railing cover 42. A dimension of the holes 46 may be similar to a corresponding dimension of an end 72, 73 of the picket 10. Ears 74 may be located at an end 72, 73 of the picket 10. In these or another embodiment, one or both holes 46, 52, may be dimensioned such that the picket 10 can only be installed in a correct orientation. Snap fitting the picket 10 may include extending ends 38, 39 of the picket 10 through aligned holes 46, 52 of the railing cover 42 and railing housing 40 such that the fitment features, e.g., ears 74, positioned at the ends 38, 39 of the picket 10 compress or bend inward and spring open, outwardly, or return to an open or outward position when extended through the corresponding holes 46, 52 and are positioned within the channel 44. For example, the ears 74 may deform inwardly as the end 72, 73 of the picket 10 is pushed into the railing cover 42 and then into the channel 44 of the railing housing 40. The open or outward position of the ears 74 when installed may cooperate with the respective hole 46 in the railing housing 40 to prevent the picket 10 from being removed from the railing 8. For example, the ears 74 may extend to an outward extent larger than a corresponding dimension of the hole 46 such that the ears 74 prevent removal of the picket 10. In some embodiments, the method may include locating a silencer 155 at the interface between the picket 10 and the railing housing 40 prior to coupling the railing cover 42 and inserting the picket 10.

Snap fitting one or more railings 8 and one or more pickets 10 may also include passing an end 72, 73 of a picket 10 through a pass through railing as described above. Pickets 10 that include fitment features at both ends 72, 73 may be coupled to railings 8 at both ends 72, 73, such as a lower railing 8*a* and an upper railing 8*b* (see, e.g., FIGS. 1A & 1B). For example, a first end 72 of picket 10 may be coupled into lower railing 8*a* and second ends 73 of picket 10 may be coupled into upper railing 8*b*. Once located within the channel 44 of the railing housing 40, the ears 74 may spring open, outwardly, or return to an open or outward position to provide a rigid coupling. A rubber mallet can be used to install the upper railing and ensure that all couplings are tight. Once all the ears 64, 74 have been clicked into place, pickets 10 and railings 8 may not be reasonably removed from the panel 4, making for a solid coupling without fasteners.

In embodiments wherein the panel 4 is rackable the railings 8 may be movable when coupled to the posts 6. Thus, a railing 8 may be pivoted within a post channel 16, 17 from a first orientation to a second orientation. The first and second orientation may differ by 5°, 10°, 20°, 30°, 40° or more, for example. In one embodiment, a railing 8 may be pivoted 30° or more from the first orientation corresponding to the initial alignment, such as perpendicular, of the railing 8 and hole 30. For example, the railing 8 may be pivoted 30° upward or downward. Pivoting the railing 8 may compress tabs 31 to maintain a tight fit. Pivoting the railing 8 may slide the post cover 14 (see, e.g., FIGS. 39A-39C) or, in embodiments including both a post cover 14 and intermediate post cover 75, the intermediate post cover 75 relative to the post housing 12, post cover 14, or both. The relative slide may alter the alignment of the corresponding holes 30, 76 to accommodate the cross-section of the railing 8 at the pivoted angle. For example, the first orientation may be perpendicular and the second orientation may be non-perpendicular and the relative slide may longitudinally offset the corresponding holes 30, 76, thereby allowing the post 6 to remain plumb while stably coupled to the railing 8 at the non-perpendicular angle. Similarly, a picket 10 may be pivoted within the railing 8 channel 44 from a first orientation to a second orientation. The first and second orientation may differ by 5°, 10°, 20°, 30°, 40° or more, for example. Pivoting the picket 10 may compress one or more tab 70. Pivoting the picket 10 may slide the railing cover 46 relative to the railing housing 40. The relative slide may alter the alignment of the corresponding holes 46, 52 to accommodate the cross-section of the picket 10 at the pivoted angle. For example, the first orientation may be perpendicular and the second orientation may be non-perpendicular and the relative slide may longitudinally offset the corresponding holes 46, 52, thereby allowing the picket 10 to remain plumb while stably coupled to railings 8 at the non-perpendicular angle.

In various embodiments, the method may include additional steps or variations. For example, in one embodiment, a picket 10 may extend completely through or extend through and be coupled with a pass through railing 8 positioned between a lower railing 8*a* and an upper railing 8*b*. In some embodiments, one or more pickets 10 may be coupled into a lower railing 8*a* and rest in the channel 44 of an upper railing 8*b* without snap fitment therein. For example, a picket 10 may include fitment features positioned only at one end 72, 73. In another embodiment, one or more pickets may be coupled into a lower railing 8*a* and pass through an upper railing 8*b* wherein a stopper 103 retains the picket 10 position with respect to the upper railing 8*b*. In one embodiment, one or more pickets 10 may be coupled into the upper railing 8*b* and rest in the channel 44 of the lower railing 8*a* without snap fitment therein.

In various embodiments, the fence system 2 may be configured such that it may be assembled without special tools. The fence system 2 may also be configured such that it may be assembled without small components such as bolts, nuts, screws or other small fixation devices. For example, using the features of the fence system 2 described herein, fence posts 6, railings 8, and picket 10 may be coupled through snap fitment to thereby lock railings 8 and pickets 10 into a desired fence configuration. It is contemplated, however, that some embodiments may include certain features that may require special tools or small components. For example, embodiments may include fewer of the snap fitment, such as slidable snap fitment, features and components described herein or include additional components that are not configured for snap fitment. For example, some components may be fitted with threaded fittings configured to receive bolts, screws, threaded collars, flanges, or other fitment features. In some embodiments, the fence system 2 includes posts, railings, pickets, or combinations thereof that are not structured to snap fit. In these or other embodiments, the fence system 2 includes post housings, intermediate post covers, post covers, railing housings, railing covers, or combinations thereof that are not structured to snap fit. In any one of the above or another embodiment, the fence system 2 may include post covers, railing covers, railing housings, or combinations thereof that do not include H-cut tabs or tabs. In any one of the above or another embodiment, the fence system 2 does not include railings, posts, or both having arcuate ears or ears. It will also be appreciated that one or more components described above may be integrated. For example, in one embodiment, a post housing and post cover or post housing and one or both of an intermediate post cover and post cover may be integrated as a unitary component. In another embodiment, an intermediate post cover and post cover may be integrated as a unitary component. The fence system 2 disclosed herein may include additional features providing additional flexibility with respect to customization of a panel or multiple panels. For example, in various embodiments, a post cover may be varied with respect to the location of holes to change the location of where railings stably couple to the post. In some embodiments, the post housing is configured for snap fitment with a plurality interchangeable or selectable post covers or intermediate post covers. For example, at least one of the plurality of post covers or intermediate post covers may comprise an post cover plate or intermediate post cover plate that defines a configuration of holes that is different than a configuration of holes defined through a post cover plate or intermediate post cover plate of at least one of the other post covers or intermediate post covers. In some embodiments, post covers or intermediate post covers, including interchangeable post covers and interchangeable intermediate post covers, may include post cover plates or intermediate post cover plates that define holes in configurations of two railings or more than two railings, for example. In this way, the post may be customized by selecting a post cover for fitment with the post housing that provides a desired railing number, size, orientation, or other hole design. This may be in addition to rackability features of the post covers and intermediate post covers described herein.

Any references to "various embodiments," "certain embodiments," "some embodiments," "one example," "one embodiment," "an example," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment." Furthermore, the phrases "in one such embodiment" or "in certain such embodiments," or "in one example," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. For example, fence systems wherein one or more posts, rails, pickets, or any combination thereof include snap covers and ears consistent with the present disclosure are intended to be within the scope of the present disclosure. As such, it is to be understood that the description set forth herein is merely exemplary and illustrative of the disclosed embodiments and is not intended to limit the scope of the invention as defined solely by the claims. Terminology such as upper, lower, top, bottom, lateral, longitudinal, etc., is used herein with respect to the embodiments described to provide a better understanding of the structures of the various components. It will also be appreciated that fences and components thereof may be used in many orientations and such terminology is not to be construed as limiting. For example, various railings and railing components thereof may be reoriented, e.g., rotated 180°, for use as top or bottom railings.

What is claimed is:

1. A fence system for stably coupling posts, railings, and pickets to assemble fence panels, the system comprising:

a post having a longitudinal length, wherein the post comprises a post housing comprising a base wall, and a post cover comprising a cover plate that defines a hole therethrough and adapted to position the hole over the base wall to provide an opening to a channel between the base wall and the cover plate, a first sidewall and a second sidewall, each extending from the base wall and defining a lateral side of the channel, and a first arm extending into the channel below the cover plate from the first sidewall at a downward angle toward the base wall and a second arm extending into the channel below the cover plate from the second sidewall at a downward angle toward the base wall; and a railing having a longitudinal length between a first end and a second end, the first end dimensioned to extend into the channel through the hole and therein snap fit with the post, wherein, when the first end of the railing is snap fit with the post, the railing is pivotable to change an angle the railing extends from the post relative to the longitudinal length of the post, and wherein the railing comprises a railing housing comprising an upper wall and a lower wall that defines a channel, the upper wall further defining a hole into the channel, and a railing cover comprising a cover plate that defines a hole therethrough and adapted to at least partially position the hole over the hole in the upper wall, the railing comprising at least one ear positioned at the first end of the railing, wherein a lateral distance between the first arm and the second arm corresponds to a lateral cross-sectional dimension of the railing to limit lateral movement of the first end of the railing when the railing is coupled to the post, and wherein a lateral cross-sectional dimension of the railing taken from the ear is greater than the lateral distance between the first arm and the second arm, and wherein the ear resiliently bends or compresses inward when extended through the lateral distance between the arms, decreasing the lateral cross-sectional dimension of the railing corresponding to the ear, and springs outward when positioned within the channel beyond the arms defining the lateral distance thereby increasing the lateral cross-sectional dimension of the railing at the first end greater than the lateral distance between the arms to snap fit the railing with the post; and a picket extending along a longitudinal length between a first end and a second end, wherein the first end of the picket is dimensioned to extend into the channel of the railing housing through the corresponding holes through the upper wall of the railing housing and the railing cover plate and snap fit therein, wherein, when the first end of the picket is snap fit with the railing, the picket is pivotable to adjust an angle the picket extends from the railing relative to the longitudinal length of the railing, wherein at least one of the post cover or railing cover is slidable with respect to the respective post housing or railing housing such that the respective cover is slidable relative to the respective housing when the respective railing or picket is pivoted, and wherein at least one of the post cover or the railing cover includes at least one bendable tab defining a longitudinal end of the hole defined therethrough that bends to accommodate an increased cross-section of a respective railing or picket with respect to the hole when the respective railing or picket is pivoted.

2. A fence system for stably coupling posts and railings to assemble fence panels, the system comprising:

a post extending along a longitudinal length between a first end and a second end, the post comprising a post housing comprising a base wall, a post cover comprising a cover plate that defines a hole therethrough and adapted to position the hole over the base wall to provide an opening to a channel between the base wall and the cover plate, a first sidewall and a second sidewall, each extending from the base wall and defining a lateral side of the channel, and a first arm extending into the channel below the cover plate from the first sidewall at a downward angle toward the base wall and a second arm extending into the channel below the cover plate from the second sidewall at a downward angle toward the base wall; and a railing having a longitudinal length between a first end and a second end, the first end dimensioned to extend into the channel through the hole and therein couple with the post, wherein, when the first end of the railing is coupled with the post, the railing is pivotable to change an angle the railing extends from the post relative to the longitudinal length of the post, the railing comprising at least one ear positioned at the first end of the railing, wherein a lateral distance between the first arm and the second arm corresponds to a lateral cross-sectional dimension of the railing to limit lateral movement of the first end of the railing when the railing is coupled to the post, and wherein a lateral cross-sectional dimension of the railing taken from the ear is greater than the lateral distance between the first arm and the second arm, and wherein the ear resiliently bends or compresses inward when extended through the lateral distance between the arms, decreasing the lateral cross-sectional dimension of the railing corresponding to the ear, and springs outward when positioned within the channel beyond the arms defining the lateral distance thereby increasing the lateral cross-sectional dimension of the railing at the first end greater than the lateral distance between the arms to snap fit the railing with the post.

3. The system of claim 2, wherein the post cover includes a first tab positioned along a first side of the cover plate and that defines a first longitudinal end of the hole and a second tab positioned at a second side of the cover plate and that defines a second longitudinal end of the hole;

wherein, when the first end of the railing is coupled to the post, the first tab bends toward the channel when the railing is pivoted in a first direction and the second tab bends toward the channel when the railing is pivoted in a second direction;

wherein an angle between the railing and the first side of the cover plate decreases when the railing is pivoted in the first direction and increases when the railing is pivoted in the second direction; and wherein an angle between the railing and the second side of the cover plate increases when the railing is pivoted in the first direction and decreases when the railing is pivoted in the second direction.

4. The system of claim 3, wherein the tabs are H-cut tabs.

5. The system of claim 3, wherein the post cover slides toward the second end of the post when the railing is pivoted in the first direction, and wherein the post cover slides toward the first end of the post when the railing is pivoted in the second direction.

6. The system of claim 2, wherein the post housing and post cover are adapted to couple by snap fitment, wherein each of the first and second sidewalls includes a lip, and wherein the post cover defines two slots, each corresponding to one of the lips and adapted to receive the corresponding lip, to snap fit the post housing and the post cover.

7. The system of claim 6, wherein the post cover comprises first and second sidewalls, each sidewall extending from the cover plate and including a lip that at least partially defines one of the two slots, wherein each of the lips has an angled surface configured to engage an angled surface of one of the lips of the post housing to direct snap fitment when compressed against the opposing angled surface.

8. A fence system for stably coupling railings and pickets to assemble fence panels, the system comprising:

a post extending along a longitudinal length between a first end and a second end, the post comprising a post housing comprising a base wall, a post cover comprising a cover plate that defines a hole therethrough and adapted to position the hole over the base wall to provide an opening to a channel between the base wall and the cover plate, a first sidewall and a second sidewall, each extending from the base wall and defining a lateral side of the channel, and a first arm extending into the channel below the cover plate from the first sidewall at a downward angle toward the base wall and a second arm extending into the channel below the cover plate from the second sidewall at a downward angle toward the base wall; and a railing that extends along a longitudinal length between a first end and a second end, the railing comprising a railing housing comprising an upper wall and a lower wall that define a channel, the upper wall further defining a hole into the channel, a railing cover configured to slidably couple to the railing housing above the upper wall, wherein the railing cover comprises a cover plate defining a hole that at least partially positions over the hole through the upper wall of the railing housing when the railing housing and the railing cover are coupled, and at least one ear positioned at the first end of the railing, wherein a lateral distance between the first arm and the second arm corresponds to a lateral cross-sectional dimension of the railing to limit lateral movement of the first end of the railing when the railing is coupled to the post, and wherein a lateral cross-sectional dimension of the railing taken from the ear is greater than the lateral distance between the first arm and the second arm, and wherein the ear resiliently bends or compresses inward when extended through the lateral distance between the arms, decreasing the lateral cross-sectional dimension of the railing corresponding to the ear, and springs outward when positioned within the channel beyond the arms defining the lateral distance thereby increasing the lateral cross-sectional dimension of the railing at the first end greater than the lateral distance between the arms to snap fit the railing with the post; and a picket extending along a longitudinal length between a first end and a second end, wherein the first end of the picket is dimensioned to extend into the channel of the railing housing through the corresponding holes through the upper wall and the railing cover plate and couple therein, wherein, when the first end of the picket is coupled to the railing, the picket is pivotable to change an angle the picket extends from the railing relative to the longitudinal length of the railing, and wherein the railing cover longitudinally slides relative to the railing housing when the picket is pivoted.

9. The system of claim 8, wherein the railing cover includes a tab defining at least one longitudinal end of the hole defined through the cover plate that bends to accommodate an increased cross-section of the picket with respect to the hole when the picket is pivoted.

10. The system of claim 8, wherein the railing cover includes a first tab positioned along a first side of the cover plate and that defines a first longitudinal end of the hole and a second tab positioned at a second side of the cover plate and that defines a second longitudinal end of the hole, wherein, when the first end of the picket is coupled to the railing, the first tab bends toward the upper wall when the picket is pivoted in a first direction and the second tab bends toward the upper wall when the picket is pivoted in a second direction, wherein an angle between the picket and the first side of the cover plate decreases when the picket is pivoted in the first direction and increases when the picket is pivoted in the second direction, and wherein an angle between the picket and the second side of the cover plate increases when the picket is pivoted in the first direction and decreases when the picket is pivoted in the second direction.

11. The system of claim 10, wherein the tabs are H-cut tabs.

12. The system of claim 10, wherein the railing cover slides toward the second end of the railing when the picket is pivoted in the first direction, and wherein the railing cover slides toward the first end of the railing when the picket is pivoted in the second direction.

13. The system of claim 8, wherein the picket comprises at least one ear positioned at the first end, wherein a lateral cross-sectional dimension of the picket taken from the ear is greater than a corresponding lateral dimension of the hole through the upper wall which the first end extends to couple the picket and the railing, and wherein the ear resiliently bends or compresses inward when extended through the lateral dimension of the hole in the upper wall, decreasing the lateral cross-sectional dimension of the picket corresponding to the ear, and springs outward when positioned within the channel beyond the upper wall, thereby increasing the lateral cross-sectional dimension of the picket at the first end greater than the lateral dimension of the hole in the upper wall to snap fit the picket and the railing.

14. The system of claim 8, wherein the railing housing and the railing cover couple by snap fitment, wherein the railing housing further comprises first and second sidewalls, each sidewall extending from the upper wall and including a lip, and wherein the railing cover defines two slots, each corresponding to one of the lips and configured to receive the corresponding lip, to snap fit the railing housing and the railing cover.

15. The system of claim 14, wherein the railing cover further comprises first and second sidewalls, each sidewall extending from the cover plate and including a lip that at least partially defines one of the two slots, wherein each of the lips has an angled surface configured to engage an angled surface of one of the lips of the railing housing to direct snap fitment when compressed against the opposing angled surface.

* * * * *